US007785762B2

(12) United States Patent
Niimi

(10) Patent No.: US 7,785,762 B2
(45) Date of Patent: Aug. 31, 2010

(54) IMAGE FORMING APPARATUS AND IMAGE FORMING METHOD

(75) Inventor: Tatsuya Niimi, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 917 days.

(21) Appl. No.: 11/611,179

(22) Filed: Dec. 15, 2006

(65) Prior Publication Data

US 2010/0196049 A1 Aug. 5, 2010

(30) Foreign Application Priority Data

Dec. 15, 2005 (JP) ..... 2005-361191
Sep. 21, 2006 (JP) ..... 2006-255190

(51) Int. Cl.
*G03G 21/06* (2006.01)

(52) U.S. Cl. ..... 430/125.2; 399/159; 430/64; 430/65

(58) Field of Classification Search ..... 430/125.2, 430/64, 65; 399/159
See application file for complete search history.

(56) References Cited

U.S. PATENT DOCUMENTS 4,959,288 A * 9/1990 Ong et al. ..... 430/58.7
5,576,131 A * 11/1996 Takai et al. ..... 430/59.2
5,871,876 A 2/1999 Ikuno et al.
6,355,390 B1 * 3/2002 Yamanami et al. ..... 430/60
6,558,863 B2 5/2003 Rokutanzono et al.
2002/0028400 A1 * 3/2002 Shimada et al. ..... 430/58.05
2004/0002013 A1 * 1/2004 Bender et al. ..... 430/58.65
2004/0033428 A1 2/2004 Niimi
2004/0053149 A1 3/2004 Toda et al.
2004/0234875 A1 11/2004 Toda et al.
2005/0069797 A1 3/2005 Niimi et al.

(Continued)

FOREIGN PATENT DOCUMENTS

JP 54-022834 2/1979

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 164-168.*

(Continued)

*Primary Examiner*—Christopher RoDee
(74) *Attorney, Agent, or Firm*—Oblon, Spivak, McClelland, Maier & Neustadt, L.L.P.

(57) ABSTRACT

An image forming apparatus including an image bearing member for bearing a latent electrostatic image including a substrate, an intermediate layer containing a metal oxide, a photosensitive layer including a charge transport layer and a charge generating layer containing an organic charge generating material, an image forming device for forming the latent electrostatic image on the image bearing member, a developing device for developing the latent electrostatic image with a toner to form a visualized image, a transfer device for transferring the visualized image to a recording medium, a fixing device for fixing the transferred image on the recording medium; and a discharging device including a light source that provides light having a wavelength shorter than 500 nm for optically discharging the image bearing member to remove remaining charges thereon by irradiating the image bearing member with light having a wavelength shorter than 500 nm which is absorbed by the metal oxide in the intermediate layer.

17 Claims, 9 Drawing Sheets

U.S. PATENT DOCUMENTS

| | | | | |
|---|---|---|---|---|
| 2005/0175911 | A1 | 8/2005 | Tamoto et al. | |
| 2006/0008719 | A1 | 1/2006 | Niimi | |
| 2006/0057479 | A1 | 3/2006 | Niimi et al. | |
| 2006/0134540 | A1 | 6/2006 | Kondo et al. | |
| 2006/0177749 | A1* | 8/2006 | Tamoto et al. | 430/65 |
| 2006/0197823 | A1 | 9/2006 | Ohta et al. | |
| 2006/0198659 | A1 | 9/2006 | Niimi | |
| 2006/0292480 | A1* | 12/2006 | Niimi | 430/124 |

FOREIGN PATENT DOCUMENTS

| | | |
|---|---|---|
| JP | 60-088981 | 5/1985 |
| JP | 61-036784 | 2/1986 |
| JP | 62-038491 | 2/1987 |
| JP | 62-087981 | 4/1987 |
| JP | 62-156172 | 7/1987 |
| JP | 62-290768 | 12/1987 |
| JP | 01-217490 | 8/1989 |
| JP | 01-274186 | 11/1989 |
| JP | 04-174489 | 6/1992 |
| JP | 05-032905 | 2/1993 |
| JP | 05-313033 | 11/1993 |
| JP | 06-334272 | 12/1994 |
| JP | 07-199759 | 8/1995 |
| JP | 07-321409 | 12/1995 |
| JP | 07-335975 | 12/1995 |
| JP | 08-088441 | 4/1996 |
| JP | 09-189930 | 7/1997 |
| JP | 09-265202 | 10/1997 |
| JP | 09-275242 | 10/1997 |
| JP | 2001-019871 | 1/2001 |
| JP | 2002-287382 | 10/2002 |
| JP | 2004-045996 | 2/2004 |
| JP | 2004-045997 | 2/2004 |
| JP | 2004-083859 | 3/2004 |
| JP | 2005-018991 | 1/2005 |
| JP | 2005-031110 | 2/2005 |

OTHER PUBLICATIONS

U.S. Appl. No. 11/625,873, filed Jan. 23, 2007, Niimi.
U.S. Appl. No. 11/669,957, filed Feb. 1, 2007, Niimi.
U.S. Appl. No. 09/566,958, filed May 8, 2000, Niimi, et al.

* cited by examiner

IMAGE FORMING APPARATUS AND IMAGE FORMING METHOD

BACKGROUND OF THE INVENTION

1. Field of the Invention

The present invention relates to an image forming apparatus and an image forming method.

2. Discussion of the Background

Recently, the development of the information processing systems using electrophotography has been significant. Among these, optical printers, which convert information into digital signals to optically record the information, have been extremely improved in terms of the quality of printing and reliability. This digital recording technology is applied to not only printers but also typical photocopiers, which leads to the development of digital photocopiers. In addition, it is anticipated that a typical analogue photocopier using this digital recording technology is more and more demanded because such a photocopier has various kinds of information processing functions. Further, with the diffusion and the improvement of performance of home computers, the development of a digital color printer to output color images and documents increasingly speeds up.

Negative-positive development is adopted in most of such digital image forming apparatus. This is because most of the images (originals) output by a typical image forming apparatus are characters (letters) so that the writing ratio based on the total area of an output sheet (image) is relatively low, i.e., from 5 to 10%.

The conversion from analogue to digital has an aspect that the positive-positive development is converted into the negative-positive development. The significant difference therebetween is a change from irradiating an entire original with light and thereafter an image bearing member with the resultant light to writing only information of letters, etc. on an image bearing member. This has an advantage in that since the information portion of an original is low, i.e., not greater than 10%, the output time of a light source can be reduced to about not greater than a tenth, which leads to elongation of life of a writing light source.

In an image forming apparatus using the negative-positive development, charges remain in the portion (non-image portion, background portion) on the surface of an image bearing member where writing is not performed by a writing light source. Since these remaining charges may affect the performance of the next charging process, a discharging process is introduced. There are methods of discharging, for example, an optical discharging method in which a photocarriers generated by light erase the surface remaining charges, a method in which an electroconductive brush is brought into contact with an image bearing member to leak the surface remaining charges, and a method in which a reverse bias is applied to the surface of an image bearing member to cancel the surface remaining charges.

With the improvement on the quality of image and the advance of colorization, the image forming apparatuses of late can perform writing and developing with a relatively high definition and the information (originals) input on the image forming apparatus is somewhat changing. As described above, letters used to be main images in originals but now photographs, colorized pictures, and graphs are inserted these days. In an original in which various kinds of patterns are input as signals, when the history of the image formed just one cycle before is not completely erased, the newly formed image may be affected thereby. In most case, this results in production of an abnormal image referred to as the residual image. When a residual image is produced, the image bearing member is already non-uniformly charged before the charging process starts. When a writing is uniformly performed in a particular area of the image bearing member, the charging voltage should be almost uniform but due to the history of the image formed one cycle before, the actual charging voltage is non-uniform. This happens especially when gradation is written. When a latent electrostatic image is formed in a state in which the charging voltage is non-uniform and developed by a developing device, the development is not correctly performed and the obtained image seems as if the image formed just one cycle before reflects.

There are two reasons for this. One is that, as image formation is performed at an extremely high speed, the capacity (charging ability) of a charging device tends to be insufficient. Therefore, when the surface charges on an image bearing member is not uniform before charging, this charged state is reflected in the next charging process, which results in non-uniformity of charging. The other is that, due to the size reduction of an image forming apparatus, colorization and the onset of a tandem type, a charging roller is used more frequently. A charging roller charges the surface of an image bearing member by the difference of the bias between the image bearing member and the charging roller caused by discharging therebetween. However, when the surface charges on an image bearing member is not uniform before charging, this history is left in the next charging.

Therefore, how to make the surface voltage (surface charges) of an image bearing member before charging uniform is the key. Consequently, the discharging process is a significant process to improve the quality of images.

The discharging methods mentioned above except for the optical discharging method have the following drawbacks. The method using an electroconductive brush requires a member contacting the surface of an image bearing member. Therefore, the abrasion between the contacting member and the image bearing member is inevitable and has an adverse impact on the durability of the member and the image bearing member. In addition, the effect of leaking charges may be reduced when the surface of an image bearing member and of the contacting member is contaminated. Furthermore, considering the transfer time of the charges, the leaking method is not suitable for high speed printing.

In the case of the method in which a reversed bias is applied, when the bias condition is insufficient, the remaining charges on the surface of an image bearing member is not sufficiently cancelled. To the contrary, when the bias is applied too much, the surface of an image bearing member is reversibly charged. As to a typical image bearing member, only positive charges can be transferred. Therefore, when the surface of an image bearing member is positively charged, the positive charges are not cancelled. Therefore, for next charging, these positive charges are cancelled first and thereafter, the image bearing member is negatively charged. This accelerates the deficiency of the capacity of a charging device. In addition, when the surface of an image bearing member is positively charged, traps are easily generated in a photosensitive layer and the residual voltage of the image bearing member tends to be generated. As a result, the life of the image bearing member is shortened.

Consequently, the optical discharging method is now the best selection as the discharging process for use in an image forming apparatus.

As described above, the image forming apparatus adopting a digital system has become prevalent recently, in which the negative-positive development is adopted in terms of what is described above. Therefore, the significance of the discharging in the negative-positive development is relatively large in comparison with the positive-positive development taken by the analogue system.

That is, in the positive-positive development, when optical discharging is performed after transfer, the entire of an image bearing member is irradiated with light but actually the area corresponding to the portion on which letters, etc., are written is discharged. The area is 10% at best based on the total area of the surface of the image bearing member.

In contrast, in the negative-positive development, the non-irradiated portion (where writing is not performed) is actually discharged. This means, when the same original as in the case of the positive-positive development is used, almost 90% of the total surface area of an image bearing member is actually discharged. "Actually discharged" means that the image bearing member has surface charges in the optically discharged area and the surface charges are erased by photocarriers generated in the image bearing member by irradiation of light by a discharging device.

This means that, in the typically used positive-positive development and the negative-positive development, the ratio of the surface charges of an image bearing member which are erased is totally different (reversed). This difference is about 10 times with regard to discharging. However, image bearing members have been used as they are without studying the influence of the discharging process on an image bearing member significantly.

As technologies with regard to discharging devices, unexamined published Japanese patent applications Nos. (hereinafter referred to as JOP) S60-88981 and S62-87981 describe that optical fatigue and charging fatigue can be prevented by irradiation of suitable discharging light containing light having a short wavelength in the case of an image forming apparatus using an inorganic image bearing member (Se based or a-Si). The image bearing members for use in JOP S60-88981 and S62-87981 are inorganic image bearing members, which have an essentially different photocarrier generating mechanism from those of an image bearing member using an organic charge generating material, which is described later. The technologies applicable to an inorganic based optical discharging may not be applicable to an organic based optical discharging. The development used in S60-88981 and S62-87981 is the positive-positive development, meaning that the discharging does not have the same weight as for the negative-positive development. Furthermore, the discharging light contains light having a wavelength of not less than 500 nm. As the result of the experiment using the technologies described in S60-88981 and S62-87981, it is found that the restraint effect on the rise of the residual voltage is not sufficient.

JOP S61-36784 describes that the residual voltage can be removed by discharging with light having a wavelength which almost matches the specific photosensitive wavelength of a dye-sensitized image bearing member. In other words, discharging is performed using light having a wavelength in the range in which the light is not absorbed by the sensitizing dye. However, the original material (e.g., polyvinyl carbazole) of the dye-sensitized image bearing member does not absorb visible light so that a sensitizing dye is used which can absorb visible light. Therefore, in the technology, discharging is performed with light having a wavelength in the range in which the light is not absorbed by the dye but polyvinyl carbazole. In this wavelength range, photocarriers are not effectively generated so that discharging is not effectively performed and polyvinyl carbazole is optical fatigued. Therefore, this technology is not effective in some cases. In addition, also the development method is the positive-positive development. The meaning of discharging is totally different from the case in which the negative-positive development is used. Therefore, when this technology is applied to a negative-positive development case, which is the target of the present invention, the effect is not sufficient.

JOP S62-38491 describes that the deterioration of the sensitivity ascribable to the optical fatigue of an image bearing member having a photosensitivity on the long wavelength side and a low or practically no photosensitivity on the short wavelength side can be restrained by discharging the image bearing member with light having a short wavelength. However, when a relatively high speed image forming apparatus is used and discharging is performed with light which is low or practically not sensitive, the discharging performance is not sufficient and abnormal images are produced in some cases. It is desired that an image bearing member has sufficient photosensitivity to discharging light. The technology described in JOP S62-38491 is not possible to deal with the drawback mentioned above for the current image forming apparatus. Furthermore, the technology described in JOP S62-38491 is not specific with regard to the wavelength of discharging light.

JOPs H01-217490 and H01-274186 describe that the residual voltage is reduced by discharging by irradiating a positive charging type image bearing member in which a charge generating layer is accumulated on a charge transport layer with light having a wavelength of not greater than 620 nm. The discharging light contains light having a wavelength of not less than 500 nm. It is found from the result of the experiment in which technologies of JOPs 1-101-217490 and 1-101-274186 are applied that the rise of the residual voltage is not sufficiently restrained.

JOP H04-174489 describes that the rise of the residual voltage is restrained in an environment of a high temperature and a high humidity by discharging by irradiation using two kinds of luminous diodes simultaneously. The discharging light contains light having a wavelength of not less than 500 nm. It is found from the result of the experiment in which the technology of JOP H04-174489 is applied that the rise of the residual voltage is not sufficiently restrained.

Japanese patent No. (hereinafter referred to as JP) 3460285 describes that discharging is effectively performed by irradiating a single layered image bearing member containing an organic pigment with light containing a wavelength of not less than the half value width of the maximum absorption of light of the photosensitive layer. In general, a practically usable organic pigment has an absorption peak in the visible light range. Therefore, the technology of JP 3460285 is not sufficient to restrain the rise of the residual voltage.

JOP 2002-287382 describes that the residual voltage can be reduced and the occurrence of ghost can be restrained by discharging by selecting the wavelength where the sensitivity of an image bearing member for discharging light is higher than the sensitivity thereof for writing light. In this technology, the discharging wavelength varies depending on the material for use in an image bearing member. Therefore, it is impossible to specify the wavelength of discharging light. In addition, in general, an organic pigment has a light absorption peak in the visible light range. Thereby, its spectroscopy sensitivity peak also exists in the visible light range. Thereby, the technology of JOP 2002-287382 cannot produce a discharging technology using light having a wavelength shorter than 500 nm.

JOP 2005-31110 describes that, in discharging of an image forming apparatus using a charge generating material dispersion type (single layered) image bearing member, irradiation of light having wavelength having a relatively low spectroscopic absorption of the image bearing member is performed.

This technology is used to remove the residual charges generated in a photosensitive layer bulk over repetitive use of a single layered image bearing member. That is, in the case of a single layered image bearing member, the charge generating material is uniformly dispersed in the bulk and light having a wavelength which has a high absorption ratio is absorbed around the surface of the photosensitive layer. This phenomenon is used for improving the definition of a single layered image bearing member. The writing light has a wavelength which is largely absorbed in a photosensitive layer to reduce the energy of irradiation and to generate photocarriers only near the surface of the photosensitive layer. Thereby, the transfer distance of charges having a polarity reverse to the polarity of the charging of the surface of an image bearing member is small, which prevents diffusion caused by Coulomb repulsion. On the other hand, the irradiation light hardly reaches the inside of the photosensitive layer bulk. Therefore, charge having the same polarity as the charges on the surface of the image bearing member tend to be trapped in the photosensitive layer bulk and may raise the residual voltage. It is impossible to cancel these charges. Considering this, light having a wavelength which can reach the bulk in depth is used as the discharging light to generate photocarriers at deep positions (close to the electric pole or the center of the photosensitive layer) in the photosensitive layer bulk, thereby canceling these charges.

To the contrary, different from a single layered photosensitive layer, the charge generating layer in a layered image bearing member is relatively extremely thin. In addition, the ratio of absorption of light is not greater than 90% even at the maximum absorption wavelength (in other words, at least 10% of writing light passes through the charge generating layer). This means, the generation of charges still occurs in the entire photosensitive layer bulk. Consequently, the effect described in JOP 2005-31110 is not true in the case of a layered image bearing member.

JOP 2004-45996 describes that discharging is performed by light irradiation to the soret band of a phthalocyanine compound and a fluorescent lamp is used as the discharging light source.

Furthermore, JOP 2004-45997 describes that discharging is performed for an image bearing member containing a phthalocyanine compound by using a fluorescent lamp.

FIG. 1 is a spectroscopic luminescent spectrum of light of a fluorescent lamp. A fluorescent lamp includes bright lines and in addition a large luminescence in the range of from 500 to 650 nm. The amount of irradiation of light, i.e., the amount of luminescent amount, depends on the area of FIG. 1. Therefore, the light having the wavelength range (from 500 to 650 nm) is mainly used as the light of a fluorescent lamp with which an image bearing member is irradiated.

In JOPs 2004-45996 and 2004-45997, discharging using a red LED light having a wavelength of 680 nm is compared with discharging using a fluorescent lamp. Judging from the spectrum of FIG. 1, the comparison is made between discharging using a red LED light having a wavelength of 680 nm and discharging by luminescence in the wavelength range of from 500 to 650 nm. Since the light corresponding to the soret band of a phthalocyanine compound is not zero, it is true that there is irradiation of light to the soret band. However, the composition of light occupies more than the composition corresponding to the soret band, which means the absorption in the area other than the soret band is large.

JOP 2005-181991 describes an image forming apparatus in which all of writing light wavelength ($\lambda a$), discharging light wavelength ($\lambda b$), and the maximum spectroscopic sensitivity wavelength ($\lambda c$) are in the range of from 380 to 520 nm and the following relationship: $\lambda a<\lambda b<\lambda c$ is satisfied. Optical discharging by light having a wavelength in the blue light range is common in the technology described in JOP 2005-181991 and the present invention. However, it is impossible for the image bearing member (intermediate layer) of JOP 2005-181991 to absorb the discharging light so that the effect of the present invention is not expected.

In these situations, improvement on the quality of images and the durability, including colorization, is demanded for the printer and the photocopier mentioned above. There are two issues for the improvement on the quality of images for a digital apparatus. One is how to uniformly form a latent electrostatic image with fine dots. The other is how to reduce the occurrence of various kinds of abnormal images. In addition, with regard to the improvement on durability, it is highly effective to elongate the life of an image bearing member.

There are various kinds of approaches to solve these issues. The thing common in both issues is how to restrain the deterioration of an image bearing member caused by electrostatic fatigue for use in these image forming apparatuses. To be specific, it is how to restrain the rise of the residual voltage (voltage at irradiated portions) during repetitive use.

To restrain the rise of the residual voltage, the design (composition, structure, etc.) of an image bearing member has been devised in the development so far. However, the electrostatic fatigue of an image bearing member greatly depends on the compositions thereof and the process conditions. From a point of developers of an image bearing member, the developers are required to deal with each process condition. Under these circumstances, the study on the electrostatic fatigue of an image bearing member based on the process conditions have hardly been made.

SUMMARY OF THE INVENTION

Because of these reasons, the present inventors recognize that a need exists for an image forming apparatus and an image forming method by which quality images can be stably produced at a high speed.

Accordingly, an object of the present invention is to provide an image forming apparatus and an image forming method by which quality images can be stably produced at a high speed.

Briefly this object and other objects of the present invention as hereinafter described will become more readily apparent and can be attained, either individually or in combination thereof, by an image forming apparatus including an image bearing member for bearing a latent electrostatic image including a substrate, an intermediate layer containing a metal oxide, a photosensitive layer formed of a charge transport layer and a charge generating layer containing an organic charge genetrating material, an image forming device for forming the latent electrostatic image on the image bearing member, a developing device for developing the latent electrostatic image with a toner to form a visualized image, a transfer device for transferring the visualized image to a recording medium, a fixing device for fixing the transferred image on the recording medium, and a discharging device including a light source that provides light having a wavelength shorter than 500 nm for optically discharging remaining charges on the image bearing member by irradiating the image bearing member with light having a wavelength shorter than 500 nm which is absorbed by the metal oxide in the intermediate layer.

It is preferred that, in the image forming apparatus mentioned above, a non-surface treated metal oxide is used as the metal oxide.

It is still further preferred that, in the image forming apparatus mentioned above, the transmission factor of the charge generating layer for light having a wavelength shorter than 500 nm is not less than 10%.

It is still further preferred that, in the image forming apparatus mentioned above, the organic charge generating material is an azo pigment represented by the following chemical structure (1):

[Chemical Structure 1]

[Chemical structure 1]

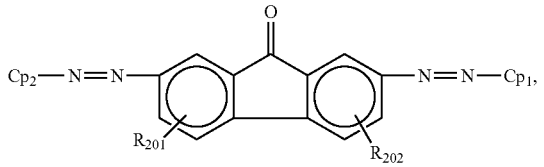

wherein $Cp_1$ and $Cp_2$ independently represent coupler residues, $R_{201}$ and $R_{202}$ independently represent one of hydrogen atom, a halogen atom, an alkyl group, an alkoxy group, and cyano group and $Cp_1$ and $Cp_2$ are represented by the following chemical structure (2):

[Chemical Structure 2]

[Chemical structure 2]

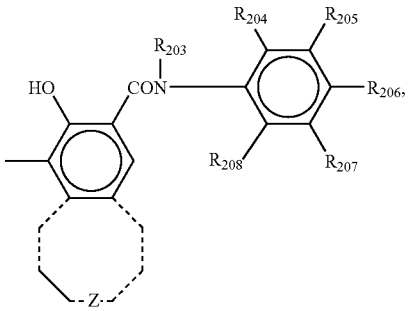

wherein $R_{203}$ represents hydrogen atom, an alkyl group, or an aryl group, $R_{204}$, $R_{205}$, $R_{206}$, $R_{207}$ and $R_{208}$ independently represent hydrogen atom, nitro group, cyano group, a halogen atom, a halogenated alkyl group, an alkyl group, an alkoxy group, a dialkyl amino group or a hydroxyl group, and Z represents atom groups for forming a substituted or non-substituted aromatic series carbon ring or a substituted or non-substituted aromatic hetrocyclic ring.

It is still further preferred that, in the image forming apparatus mentioned above, the organic charge generating material is titanyl phthalocyanine having a crystal form having a CuKα X ray diffraction spectrum having a wavelength of 1.542 Å such that a maximum diffraction peak is observed at a Bragg (2θ) angle of 27.2±0.2°, main peaks at a Bragg (2θ) angle of 9.4±0.2°, 9.6±0.2°, and 24.0±0.2°, and a peak at a Bragg (2θ) angle of 7.3±0.2° as a lowest angle diffraction peak, and having no peak between the peak of 9.4°±0.2° peak and the peak of 7.3°±0.2° and no peak at 26.3°.

It is still further preferred that, in the image forming apparatus mentioned above, the transmission factor of the charge transport layer for the light for discharging is not less than 30%.

It is still further preferred that, in the image forming apparatus mentioned above, a protective layer is provided overlying the photosensitive layer.

It is still further preferred that, in the image forming apparatus mentioned above, the transmission factor of the protective layer for the light for discharging is not less than 30%.

It is still further preferred that, in the image forming apparatus mentioned above, the protective layer includes at least one of an inorganic pigment and a metal oxide having a specific resistance of not less than $10^{10}$ Ω·cm.

It is still further preferred that, in the image forming apparatus mentioned above, the protective layer is formed by curing a radical polymeric monomer having at least three functional groups which does not have a charge transport structure and a radical polymeric compound having one functional group which has a charge transport structure. It is still further preferred that, in the image forming apparatus mentioned above, the radical polymeric compound having one functional group which has a charge transport structure for use in the protective layer is at least one kind represented by the following chemical structures (3) and (4):

Chemical Structure 3

Chemical structure 3

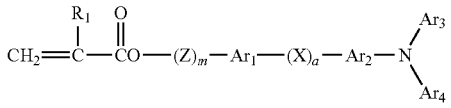

Chemical Structure 4

Chemical structure 4

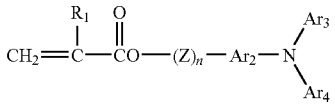

wherein, $R_1$ represents hydrogen atom, a halogen atom, an alkyl group, an aralkyl group, an aryl group, cyano group, nitro group, an alkoxy group, —$COOR_7$, wherein $R_7$ represents hydrogen atom, a substituted or non-substituted alkyl group, a substituted or non-substituted aralkyl group or a substituted or non-substituted aryl group, a halogenated carbonyl group or $CONR_8R_9$, wherein $R_8$ and $R_9$ independently represent hydrogen atom, a halogen atom, a substituted or non-substituted alkyl group, a substituted or non-substituted aralkyl group or a substituted or non-substituted aryl group, $Ar_1$ and $Ar_2$ independently represent a substituted or unsubstituted arylene group, $Ar_3$ and $Ar_4$ independently represent a substituted or unsubstituted aryl group, X represents a substituted or non-substituted alkylene group, a substituted or non-substituted cycloalkylene group, a substituted or non-substituted alkylene ether group, oxygen atom, sulfur atom or a vinylene group, Z represents a substituted or non-substituted alkylene group, a substituted or non-substituted alkylene ether divalent group or an alkyleneoxy carbonyl divalent group, and a represents 0 or 1, m and n represent an integer of from 0 to 3.

It is still further preferred that, in the image forming apparatus mentioned above, the radical polymeric compound having one functional group which has a charge transport structure for use in the protective layer is at least one kind represented by the following chemical structure (5)

[Chemical Structure 5]

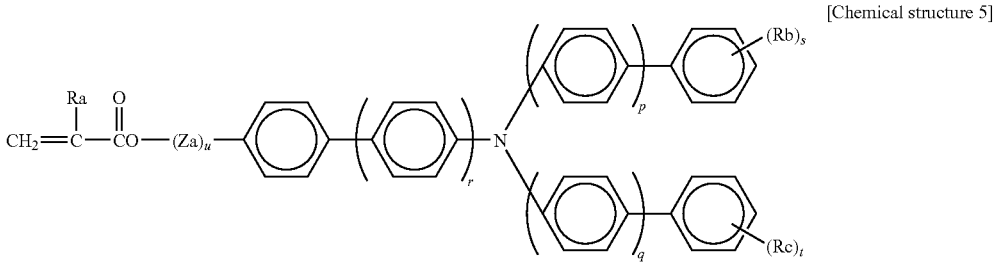

wherein u, r, p, q represent 0 or 1, s and t represent an integer of from 0 to 3, Ra represents hydrogen atom or methyl group, Rb and Rc independently represent an alkyl group having 1 to 6 carbon atoms, and Za represents methylene group, ethylene group, —$CH_2CH_2O$—, —$CHCH_3CH_2O$—, or —$C_6H_5CH_2CH_2$—.

It is still further preferred that, in the image forming apparatus mentioned above, the intermediate layer includes a charge blocking layer and a moiré prevention layer containing a metal oxide.

It is still further preferred that, in the image forming apparatus mentioned above, the image writing light for use in the image forming device has a wavelength shorter than 450 nm.

It is still further preferred that the image forming apparatus mentioned above includes a plurality of the image bearing members, the image forming devices, the developing devices, the transfer devices, and the discharging devices.

It is still further preferred that the image forming apparatus mentioned above further includes a process cartridge detachably attached to the main body of the image forming apparatus and including the image bearing member and at least one device selected from the group consisting of the image forming device, the developing device, the discharging device and a cleaning device.

As another aspect of the present invention, an image forming method is provided which includes forming a latent electrostatic image on an image bearing member including a substrate, an intermediate layer containing a metal oxide, a photosensitive layer formed of a charge transport layer and a charge generating layer containing an organic charge generating material, developing the latent electrostatic image with a toner to form a visualized image, transferring the visualized image to a recording medium, fixing the transferred image on the recording medium, optically discharging the image bearing member to remove remaining charges thereon by irradiating the image bearing member with light having a wavelength shorter than 500 nm which is absorbed by the metal oxide in the intermediate layer.

It is preferred that, in the image forming method, an image writing light for use in forming the latent electrostatic image has a wavelength shorter than 450 nm.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
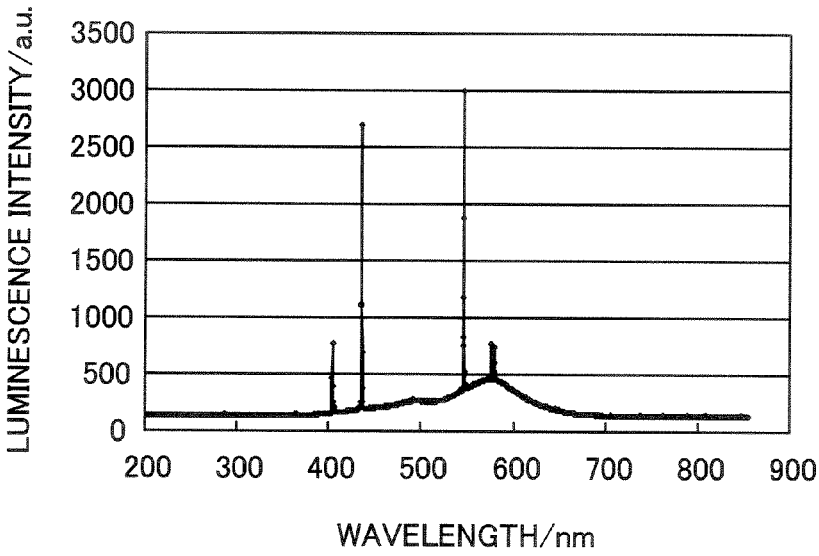
FIG. 1 BACKGROUND ART
FIG. 1 is a diagram illustrating a spectroscopic luminescent spectrum of a fluorescent light.

The present invention will be described below in detail with reference to several embodiments and accompanying drawings.

The object of the present invention is to solve the drawbacks mentioned above and to achieve the following. That is, the present invention has an object of providing a highly durable image forming apparatus and a corresponding image forming method in which high definition images can be formed by restraining the rise of the residual voltage during repetitive use of an image bearing member.

The inventors of the present invention have studied the influence of the process conditions on the electrostatic fatigue, especially the residual voltage, of an image bearing member.

In the repetitive use of an image forming apparatus, the electrostatic fatigue test for the image bearing member from which a developing device, a transfer device and a cleaning device are removed while restraining the affect on the shape and the physicality except for the electrostatic property of the image bearing member is performed just by charging, writing and discharging as follows: (A) the amount of charges passing through the image bearing member is measured while varying the writing ratio of writing light; and (B) the amount of charges passing through the image bearing member is measured while erasing the surface charges only by discharging light without performing writing.

The following knowledge is obtained by evaluating the residual voltage of the image bearing member from the measuring results of (A) and (B).

(1) the rise of the residual voltage of an image bearing member depends on the amount of charges passing through the image bearing member. The amount of the rise of the residual voltage is uniform from a point of the amount of charges passing through the image bearing member even while changing the writing ratio.

(2) The amount of charges passing through the image bearing member depends on the amount of irradiation of light (to be exact, the amount of absorption of light by the image bearing member) for one cycle of image formation regardless of writing and discharging.

(3) In the case of the negative-positive development, most of the irradiation of light is provided by optical discharging.

Furthermore, a transfer device is attached to provide a reverse bias to an image bearing member before the discharging process and the same experiment as described above is performed. The surface voltage of the image bearing member before discharging is made to be measurable and a reverse bias is made to be applicable varying the reverse bias under the condition that the surface voltage of the image bearing member before discharging is almost the same as the surface voltage after the discharging performed in the experiments of (1) to (3) mentioned above. When the electrostatic fatigue test is performed in this state, the rise of the residual voltage of the image bearing member is extremely small and just depends on the writing ratio. That is, the influence of discharging is not observed at all.

Judging from the results obtained above, the following can be concluded.

(4) When the surface voltage of the image bearing member is reduced before discharging, the rise of the residual voltage hardly occurs. In other words, when the surface voltage of the image bearing member is low at the time of discharging, the irradiation of discharging light does not contribute to the rise of the residual voltage.

(5) When a reverse bias is applied and the surface voltage of the image bearing member is reduced, as described in (1), the amount of charges passing through the image bearing member accounts for the amount of the rise of the residual voltage.

Based on (1) to (5) mentioned above, it can be concluded that the rise of the residual voltage depends on the amount of charges passing through the image bearing member, most of which is produced in the discharging process. Therefore, hot to control the discharging process is a key to controlling the rise of the residual voltage.

The amount of charges passing through the image bearing member described in (1) represents the amount of the charges per unit surface area passing through the image bearing member in one image formation cycle and depends on the amount of the generation of photocarriers. Therefore, the amount depends on the charging voltage (electric field intensity applied to the image bearing member), the amount of irradiation of light, the irradiated area, the electrostatic capacity (layer thickness) of the image bearing member, carrier generation efficiency, etc., among the image formation conditions. However, it is hard to greatly vary these items for the target image forming apparatus.

For example, a large change in the charging voltage brings the following changes. When the charging voltage is greatly increased, the hazard to an image bearing member increases. When the charging voltage is greatly decreased, the background potential (the potential between the charging voltage of the image bearing member and the developing bias) is decreased and the development potential (the potential between the developing bias and the voltage of the irradiated portion of the image bearing member) is decreased. Thereby, the image formation conditions, especially the development conditions, are extremely regulated, which limits the latitude of the system.

A large change in the amount of irradiation causes the following changes. When the amount of irradiation of light is reduced, the image density becomes insufficient and the contrast is not visible. To the contrary, an increased amount of irradiation causes a phenomenon in which dots are crushed.

The electrostatic capacity (layer thickness) of an image bearing member and the carrier generation efficiency do not greatly change unless the materials for use in the image bearing member are changed. Currently, the selection of the main materials (charge generating materials, charge transport materials, etc.) of an image bearing member for use in a high speed image forming apparatus with high durability and stability is limited so that it is extremely difficult to change from the main materials currently used to totally different materials.

Therefore, the amount of charges passing through an image bearing member implemented in the target image forming apparatus does not extremely fluctuate and largely depends on the amount of irradiation of light.

The amount of irradiation of light represents the amount of irradiation of light on an image bearing member in one cycle of image formation (charging, writing, developing, transferring and discharging). A fixing process is included in the image formation but does not have a direct contact with an image bearing member. Therefore, the fixing process is excluded from the following description. That is, the irradiation of light on an image bearing member has two kinds, which are the irradiation of writing light and of discharging light.

In general, a current image forming apparatus performing a digital writing takes the negative-positive development method as the result of reflection of the actual writing ratio in an original, i.e., not greater than 10% in most cases. Thereby, the stress on a writing light source is reduced. However, in light of an image bearing member, it is desired that the surface voltage thereon is cancelled (levelized) before the next image formation cycle to prevent the influence on the next charging. This is done by optical discharging to reduce the surface voltage of the image bearing member as much as possible before the charging in the next image formation process.

As described above, since the writing ratio is about 10%, not less than 90% of the surface area of the image bearing member has charges at the time of discharging. Optical discharging is performed by irradiating the surface of the image bearing member with light to produce photocarriers by which the surface remaining charges are cancelled. That is, not less than 90% of the amount of charges passing through the image bearing member in one cycle of image formation is generated in the discharging process.

These are performed in a typical image forming apparatus adopting the negative-positive development except for the cases in which images written in the entire of an original are continuously output. However, in fact, as described above, the electrostatic fatigue of an image bearing member has not been analyzed so much from a discharging process point of view.

The inventors of the present invention have made a study on the control of the rise on the residual voltage (voltage at irradiated portions) by the process condition and have found that the discharging process in the image formation cycle has a great impact as described above.

Next, how the rise of the residual voltage (voltage at irradiated portions) occurs during repetitive use of an image bearing member is analyzed. As a result of the analysis, it is found that, in a high speed process in which writing is performed with strong light, for example, a laser beam, on a layered image bearing member including an electroconductive substrate, an intermediate layer, a charge generating layer and a charge transport layer, the carrier transfer in the intermediate layer and/or the carrier infusion from the charge generating layer serve as a rate limiting factor and cause the rise of the residual voltage (voltage at irradiated portions).

In such an image bearing member having the structure mentioned above, a positive hole transport material is typically used in the charge transport layer so that the surface of the image bearing member is negatively charged. Therefore, among the photocarriers produced in the charge generating layer, positive holes are infused into and traverse the charge transport layer and cancel the surface charges. On the other hand, the electrons are infused into and traverse the intermediate layer, reach the electroconductive substrate and cancel the charges (positive holes) having the reverse polarity which are induced during charging. Since a positive hole transport material is used in the charge transport layer, the responsive speed is about several tens of μ seconds as the transport time according to the current technology. Thereby, such an image forming apparatus can output about several tens of images per minute.

On the other hand, the intermediate layer contains a material having an N type like conductivity and thereby has an electron transportability. However, a typical intermediate layer has a variety of functions, for example, (1) covering the surface of a substrate (to reduce the surface roughness), (2) preventing the occurrence of moiré, (3) transporting electrons and (4) preventing the infusion of positive holes from the substrate. Especially, in the negative-positive development taken in the present invention, it can be said that the background fouling serves as a rate limiting factor of the life of an image bearing member. Therefore, the function of (4) mentioned above is highly considered.

To fortify the function of preventing the infusion of positive holes, the intermediate layer is devised such that the intermediate layer has a rectification function (passing only electrons), has a large resistance and increases the time constant by increasing the layer thickness thereof. However, it is difficult to impart a complete rectification property so that the design is made considering the balance, meaning that the charge transportability is inevitably reduced, even if it is slight, or the infusion property of electrons from the charge generating layer to the intermediate layer is made to worsen. Therefore, it is found that electrons are accumulated in the intermediate layer (or charge generating layer) during repetitive use of the image bearing member, which causes the rise of the residual voltage (voltage at irradiated portions).

Furthermore, the inventors of the present invention have studied on the conditions of discharging light, mainly wavelength thereof. As described above, in an image forming apparatus adopting the negative-positive development, photocarriers of the image bearing member are produced mostly (not less than 90%) in the optical discharging process. The discharging light properly functions as long as the discharging light can be absorbed by an image bearing member (to be exact, charge generating layer). Generally, a light source, for example, an LED array and a fluorescent lamp, is used to uniformly irradiate an image bearing member with light in the longitudinal direction thereof. In the past, fluorescent lamps have been used but have the following problems because the fluorescent lamp also emits light which is absorbed in a charge generating layer:

(1) Since part of light is absorbed in a charge transport layer, an ample amount of light may not reach a charge generating layer, which leads to an extreme increase of the amount of light; and (2) As a result of the absorption of the discharging light by a charge generating material, the charge generating material may deteriorate, in case of which the electrostatic characteristics of the image bearing member deteriorate.

To overcome these drawbacks, generally a red LED emitting light having a wavelength of from 600 nm to less than 700 nm has been used. The light emitted by this red LED is not absorbed in typically used charge transport material. Therefore, the two problems stated above are cleared. In addition, there are a great number of charge generating materials which can sufficiently absorb the light. Also, a relatively inexpensive cost of such an LED is another advantage. This has been the way of general consideration.

As the result of the analysis of the rise of the residual voltage (voltage at irradiated portions) mentioned above, the inventors of the present invention have come to doubt whether discharging by irradiation of light, for example, a red LED, having a relatively long wavelength is optimal during repetitive use of an image bearing member and studied on the dependency on the wavelength of discharging light. To be specific, the study has been made on the rise of the residual voltage during repetitive use of an image bearing member using various kinds of wavelengths formed in combination of a monochromatic laser beam, a light source and a filter.

As a result, it is found that the discharging using a red color light, which has been thought to be suitable, raises the residual voltage more in comparison with light having a shorter wavelength than that of the red color light. To be specific, the rise of the residual voltage can be significantly limited by discharging with light which can be absorbed by an intermediate layer. To be more specific, the light is light having a wavelength shorter than 500 nm and can be optically absorbed by a metal oxide contained in an intermediate layer.

With the thus obtained knowledge, the inventors of the present invention have made the present invention.

According to the study made by the inventors of the present invention, it is found by finely dissembling the irradiation light at the time of discharging that when the amount of light which can be absorbed in an intermediate layer (metal oxide) is increased for irradiation, the rise of the residual voltage can be further restrained. Furthermore, when light having a long wavelength (not less than 500 nm) and which is not absorbed by the intermediate layer (metal oxide) is mixed in discharging light, the residual voltage rises according to the mixed amount of the light having a long wavelength. Therefore, the methods described in the JOPs and JP mentioned above are insufficient as a technology by which the residual voltage can be restrained in consideration of the improvement on the durability and the quality of images The wavelength of the discharging light described in the present invention which can be absorbed by a metal oxide is defined as the wavelength having an energy larger (i.e., shorter in wavelength) than the energy corresponding to the width of the inhibition band of the metal oxide. The width is referred to as the energy gap or band gap between the electroconductive band and the valence band. FOr example, when a metal oxide is a rutile type titanium oxide, the energy gap is 3.0 eV and about 410 nm in wavelength conversion. This is the longest wavelength of light which can be absorbed by the rutile type titanium oxide. That is, the light having a wavelength shorter than the about 410 nm can be absorbed by the rutile type titanium oxide. In addition, the discharging light having a wavelength shorter than 500 nm described in the present invention represents light which does not contain light having a wavelength of not shorter than 500 nm and is hereinafter referred to as the discharging light having a wavelength shorter than 500 nm.

The wavelength of light which can be absorbed by a metal oxide is defined as the wavelength of light having a larger energy than the energy gap as described above. The method of measuring the energy gap is described below. In general, there are three methods therefor.

The first method is a method in which the spectroscopic reflective spectrum of an intermediate layer is measured to obtain the absorption end on the long wavelength side. This can be easily measured with a spectroscopic absorption spectrum device in the market. This method is used in Examples and Comparative Examples of the present invention. The wavelength of light which can be absorbed by an intermediate layer is obtained as the wavelength on the shorter wavelength side than the absorption end obtained by this method.

The second method is a method in which, after the spectroscopic absorption spectrum and the luminescence spectrum of an intermediate layer are obtained, both spectra are plotted in the same graph to obtain the wavelength of the intersection thereof. These can be measured by a spectrophotometer and a spectrophotofluorometer in the market. The wavelength of light which can be absorbed by an intermediate layer is obtained as the wavelength on the shorter wavelength side than the wavelength (intersection) obtained by the method.

The third method is a method in which the difference between measured energy levels of the electroconductive band and of the valance band is obtained as the energy gap. This method requires an exclusive device and is not prevalent. The wavelength of light which can be absorbed by an intermediate layer is obtained as the wavelength on the shorter wavelength side than the wavelength obtained by converting the energy gap, the unit of which is energy, in the wavelength unit.

The mechanism of how the rise of the residual voltage of an image bearing member during repetitive use thereof can be restrained by using discharging light which can be absorbed by a metal oxide is not clear in detail. Currently, the considerable mechanism is described as follows.

When discharging is performed by using light having a wavelength longer than the wavelength of light which can be absorbed by a metal oxide during repetitive use of an image bearing member, all the photocarriers generated in the image bearing member are produced in the charge generating layer. The positive holes produced are infused into the charge generating layer and the electron produced are infused into the intermediate layer. Each thereof is transferred to either of the surface of the image bearing member or the substrate thereof to cancel the surface charges or induced charges (the charges induced on the substrate side during the main charging). In the high speed process targeted by the present invention, the electron transport speed in the intermediate layer is slower than the positive hole transport speed in the charge generating layer. Therefore, electrons are accumulated in the intermediate layer during repetitive use.

In contrast, when discharging is performed by using light which can be absorbed by the metal oxide, photocarriers are produced in a charge generating layer but the discharging light is not completely absorbed in the charge generating layer and reaches an intermediate layer. When the intermediate layer contains a metal oxide which can absorb the discharging light, the metal oxide in the intermediate layer absorbs the discharging light and produces photocarriers via a photoexcitation state. Since the photocarriers are produced in the intermediate layer, there is no infusion process of photocarriers from the charge generating layer, resulting in good efficiency. The photocarriers produced in the intermediate layer cancel the residual charges (electrons) accumulated at or before the prior image formation so that the rise of the residual voltage can be restrained.

In addition, a typical organic charge generating materials for use in an charge generating layer absorbs visible light and pass discharging light having a wavelength shorter than 500 nm in some extent so that a sufficient amount of light reaches an intermediate layer and can produce photocarriers therein. In addition, the organic charge generating material does not completely absorb light having a wavelength shorter than 500 nm due in terms of the structure thereof. Therefore, since a sufficient amount of photocarriers can be produced in the charge generating layer as in the case of discharging light having a wavelength of not shorter than 500 nm, the discharging light having a wavelength shorter than 500 nm does not have an adverse impact on optical discharging itself.

To sufficiently obtain this effect, it is desired that the discharging light reaches the intermediate layer in an image bearing member in a sufficient amount. To achieve this, the discharging light having a wavelength shorter than 500 nm passes through the charge generating layer and the charge transport layer, which are provided on or above the intermediate layer, in a sufficient amount.

Some of the materials suitably used as the charge transport materials for use in an image bearing member absorb light having a wavelength shorter than 500 nm. The effect of the present invention may be not sufficiently obtained with such materials. In addition, it is not possible to secure the stability of electrostatic characteristics of an image bearing member during repetitive use thereof even with a material which passes light having a wavelength shorter than 500 nm when the material does not have a sufficient charge transport ability.

Therefore, the desired characteristics of the charge transport material for use in the present invention are, for example; (1) the light having a wavelength shorter than 500 nm passes through the charge transport material in the state in which a charge transport layer is formed. To be specific, it is preferred that at least 30% of the discharging light passes through the charge transport material; (2) the charge transport material has good compatibility, for example, energy matching, with an organic charge generating material. Thereby, the photocarriers generated in the charge generating layer can be smoothly infused; and (3) the charge transport material has a stability during repetitive use of an image bearing member as a material. Specific examples thereof include the durability against oxidation gasses produced by a charging device and the stability against conduction for an extended period of time.

In addition, the desired characteristics of the charge generating material for use in the present invention are, for example; (1) the light having a wavelength shorter than 500 nm passes through the charge generating material in the state in which a charge generating layer is formed. To be specific, it is preferred that at least 10% of the discharging light passes through the charge transport material; (2) the efficiency of photocarrier production is high; and (3) the charge generating material has a stability during repetitive use of an image bearing member as a material. Specific examples thereof include the durability against oxidation gasses produced by a charging device and the stability against conduction for an extended period of time.

Image Forming Apparatus and Image Forming Method

The image forming apparatus includes an image bearing member, an image forming device, a developing device, a transfer device, a fixing device and a discharging device and can have optional other devices, for example, a cleaning device, a recycling device and a controlling device. The image bearing member includes a substrate on or above which an intermediate layer containing a metal oxide and a layered photosensitive layer are provided. The layered photosensitive layer includes a charge generating layer containing an organic charge generating material and a charge transport layer. The discharging device includes a light source emitting light having a wavelength shorter than 500 nm which can be absorbed by the metal oxide contained in the intermediate layer.

The image forming method of the present invention includes an image forming process, a developing process, a transfer process, a discharging process and a fixing process and can optionally have other processes, for example, a cleaning process, a recycling process and a controlling process. In the discharging process, a light source emitting light having a wavelength shorter than 500 nm is used.

The image forming method of the present invention can be suitably performed by the image forming apparatus of the present invention. The image forming process can be performed by the image forming device. The developing process can be performed by the developing device mentioned above. The transfer process can be performed by the transfer device mentioned above. The discharging process can be performed by the discharging device mentioned above. The fixing process can be performed by the fixing device mentioned above. The other processes can be performed by the other devices mentioned above.

The image forming apparatus of the present invention includes an image bearing member, an image forming device for forming a latent electrostatic image thereon, a developing device for developing the latent electrostatic image with a toner to visualize the image, a transfer device for transferring the visualized image to a recording medium, a discharging device for removing residual charges on the image bearing member and a fixing device for fixing the transferred image transferred on the recording medium. The discharging device has a light source irradiating the image bearing member with discharging light having a wavelength shorter than 500 nm.

Image Bearing Member

As long as a metal oxide is contained in the intermediate layer and an organic charge generating material is contained in the charge generating layer, there is no specific limit to the image bearing member with regard to its material, form, structure, size, etc. Any known image bearing member can be selected for use. As for the substrate, an electroconductive substrate is preferred.

Next, the image bearing member for use in the present invention is described in detail with reference to drawings.

Figure 2:
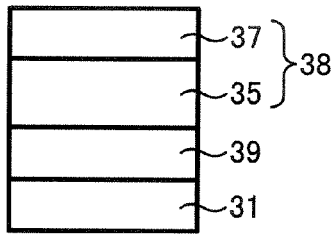
FIG. 2 is a diagram illustrating an example of the layer structure of the image bearing member for use in the present invention.

FIG. 2 is a cross section illustrating an example of the structure of the image bearing member for use in the present invention. The structure is a layered structure in which an intermediate layer 39, a charge generating layer 35 and a charge transport layer 37 are provided on a substrate 31. The charge generating layer 35 and the charge transport layer 37 form a photosensitive layer 38. The intermediate layer 39 contains a metal oxide. The charge generating layer 35 contains an organic charge generating material as the charge generating material. The main content of the charge transport layer 37 is a charge transport material.

Figure 3:
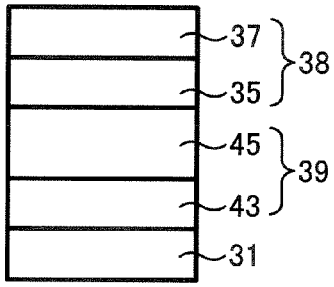
FIG. 3 is another example of the layer structure of the image bearing member for use in the present invention.

FIG. 3 is a cross section illustrating another example of the structure of the image bearing member for use in the present invention. The intermediate layer 39 includes a charge blocking layer 43 and a moire prevention layer 45 containing a metal oxide. The charge generating layer 35 containing an organic charge generating material as the charge generating material and the charge transport layer 37 containing a charge transport material as its maincomponent form the photosensitive layer 39 and are accumulated on the intermediate layer 39.

Figure 4:
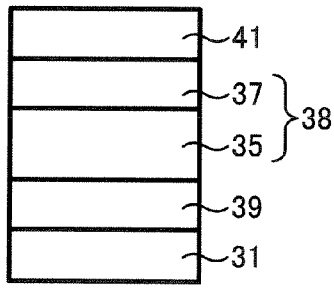
FIG. 4 is another example of the layer structure of the image bearing member for use in the present invention.

FIG. 4 is a cross section illustrating yet another example of the structure of the image bearing member for use in the present invention. There are provided on the substrate 31 the intermediate layer 39 containing a metal oxide, the charge generating layer 35 containing an organic charge generating material as the charge generating material, the charge transport layer 37 containing a charge transport material as its maincomponent. The charge generating layer 35 and the charge transport layer 37 form a photosensitive layer 38. Furthermore, a protective layer 41 is provided on the charge transport layer 37.

Materials having a volume resistance of not greater than $10^{10}$ Ω·cm can be used as a material for the substrate 31. For example, there can be used plastic or paper having a film form or cylindrical form covered with a metal, for example, aluminum, nickel, chrome, nichrome, copper, gold, silver, and platinum, or a metal oxide, for example, tin oxide and indium oxide by depositing or sputtering. Also a board formed of aluminum, an aluminum alloy, nickel, and a stainless metal can be used. Further, a tube which is manufactured from the board mentioned above by a crafting technique, for example, extruding and extracting, and surface-treatment, for example, cutting, super finishing and glinding, is also usable. In addition, an endless nickel belt and an endless stainless belt can be used as the substrate 31.

An electroconductive substrate can be formed by applying to the substrate 31 a liquid of application in which electroconductive powder is dispersed in a suitable binder resin can be used as the substrate for use in the present invention.

Specific examples of such electroconductive powder include carbon black, acetylene black, metal powder, for example, powder of aluminum, nickel, iron, nichrome, copper, zinc and silver, and metal oxide powder, for example, electroconductive tin oxide powder and ITO powder.

Specific examples of the binder resins which are used together with the electroconductive powder include thermoplastic resins, thermosetting resins, and optical curing resins, for example, a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenol resin, and an alkyd resin. Such an electroconductive layer can be formed by dispersing the electroconductive powder and the binder resins mentioned above in a suitable solvent, for example, tetrahydrofuran (THF), dichloromethane (MDC), methyl ethyl ketone (MEK), and toluene and applying the resultant to a substrate.

Also, an electroconductive substrate formed by providing a heat contraction tube on a suitable cylindrical substrate as an electroconductive layer can be used as the substrate 31 of the present invention. The heat contraction tube can be formed of a material, for example, polyvinyl chloride, polypropylene, polyester, polystyrene, polyvinylidene chloride, polyethylene, chloride rubber, and TEFLON® in which the electroconductive powder mentioned above is contained.

Among these, an aluminum disc substrate, which can be easily subject to anodic oxidization film forming treatment, is most preferred for use. The aluminum means solid aluminum or aluminum alloy. To be specific, aluminum or aluminum alloy of JIS1000 to 1999, 3000 to 3999 and 6,000 to 6,999 are most suitable. Anodic oxidized film is formed by anodic oxidizing various kinds of metals and alloyed metals in an electrolyte solution. Among these, a film referred to as alumite formed by anodic oxidizing aluminum or aluminum alloy in an electrolyte solution is most suitable for an image bearing member. Especially, this film is excellent in preventing the point deficiency (black spot and background fouling) which occurs when the reversal development (negative and positive development) is used.

Anodic oxidization treatment is conducted in acid bathing using, for example, chromium acid, sulfuric acid, oxalic acid, phosphoric acid, acidium boricum and sulfamic acid. Among these, sulfuric acid bathing is most preferred. For example, the anodic oxidization treatment is conducted under the conditions of the density of sulfuric acid of from 10 to 20%, bathing temperature of from 5 to 25° C., electricity density of from 1 to 4 $A/dm^2$, electrolyzation voltage of from 5 to 30 V and treatment time of from about 5 to about 60 minutes but is not limited thereto. The thus formed aniodic oxidized film is porous and has a high insulation property so that the surface of the film is extremely unstable. Therefore, the physicality of the aniodic oxidized film tends to change overtime. To avoid this change, the aniodic oxidized film is preferably subject to sealing treatment. There are methods of sealing, for example, a method of dipping an aniodic oxidized film in an aqueous solution containing nickel fluoride and nickel acetate, a method of dipping an aniodic oxidized film in boiling water, and a method of using pressurized vapor. Among these, the method of dipping an aniodic oxidized film in an aqueous solution containing nickel acetate is most preferred. Washing treatment of the aniodic oxidized film follows the sealing treatment. This treatment is to remove excessive materials, for example, metal salts, attached while in the sealing treatment. When these excessive materials remain on the surface of a substrate (i.e., an aniodic oxidized film), such materials may have an adverse impact on the quality of the layer formed on the substrate and cause background fouling because the materials have a low resistance in general. The washing treatment can be done with purified water once but normally is performed through multiple stages. It is preferred to use water as clean (deionized) as possible for the last washing treatment. In addition, it is also preferred that abrasive washing using an abrasive member is contained in the multiple washing stages. The thus obtained aniodic oxidized film preferably has a thickness of from about 5 to about 15 μm. An aniodic oxidized film that is too thin tends to have an insufficient barrier effect and an aniodic oxidized film that is too thick tends to have too large a time constant as an electrode so that the residual voltage may rise and the response of an image bearing member worsen.

Next, the intermediate layer 39 is described. The intermediate layer for use in the present invention contains a metal oxide. In general, an intermediate layer is mainly formed of a resin. Considering the case in which a photosensitive layer is formed on the intermediate layer (i.e., resin) using a solvent, the resin is preferably hardly soluble in a typically used organic solvent. Specific examples of such resins include water soluble resins, for example, polyvinyl alcohol, casein, and sodium polyacrylate, alcohol soluble resins, for example, copolymerized nylon and methoxymethylized nylon and curing resins which form a three-dimensional mesh structure, for example, polyurethane, melamine resins, phenol resins, alkyd-melamine resins and epoxy resins.

In addition, the intermediate layer 39 contains a metal oxide to reduce the residual voltage and to prevent the occurrence of moiré in addition. Specific examples of the metal oxide include titanium oxides, silica, alumina, zirconium oxides, tin oxides and indium oxides. Among these, titanium oxides, zinc oxides and tin oxides are effectively used. Among the titanium oxides, rutile type titanium oxides are preferred. Anataze type titanium oxides can be also used. However, considering that photocarriers are generated and light the anatase type titanium oxide can absorb has a wavelength shorter than that of light the rutile type titanium oxide can absorb, the discharging light is preferred to have a short wavelength for the anatase type titanium oxide. Taking into account the spectroscopic transmission factor of a charge generating layer, the selection of the charge generating material may be relatively limited in the case of the anatase type titanium when compared with the rutile type titanium oxide. Therefore, the rutile type titanium oxide is more preferred.

The absorption wavelength range of these metal oxides varies depending on contained impurities and the crystal type. Therefore, according to the methods mentioned above, the absorption wavelength range is obtained by actually measuring the energy gap of the used material or an intermediate layer containing the material.

The absorption limit wavelength (i.e., the longest wavelength below which light having a wavelength can be absorbed) obtained from the energy gap of titanium oxide, zinc oxide and tin oxide, which are effectively used in the present invention, are about 410 nm, about 388 nm and about 350 nm, respectively. As described above, these values are used just for reference and change according to the amount of impurities contained in the used material and the crystal type.

In addition, it is preferred to use a non-surface treated metal oxide as the metal oxide. This is because non-surface treated surface area of a metal oxide decreases with surface treatment, which has an adverse impact on the transport of carriers produced by the metal oxide, resulting in the deterioration of the effect of the present invention. When a surface treated metal oxide is used to improve, for example, dispersion stability, the degree of the surface treatment is limited to the minimal level.

These intermediate layers can be formed by using a suitable solvent and a suitable coating method. Silane coupling agents, titanium coupling agents and chromium coupling agents can be used in for the intermediate layer 39. The thickness of the intermediate layer 39 is preferably from 0.1 to 5 μm.

The intermediate layer 39 has at least two functions other than the generation of photocarriers at the time of discharging. One is a function of preventing charges having a reverse polarity induced at the electrode when an image bearing member is charged from infusing into the photosensitive layer 38. The other is a function of preventing the production of moiré images which may occur when writing is performed with a coherent light, for example, a laser beam. It is effective to use a function separation type intermediate layer in which these two functions are independently held by two or more layers for an image bearing member for use in the present invention. The charge blocking layer 43 and the moiré prevention layer 45 of a function separation type intermediate layer are described.

The charge blocking layer 43 has a function of preventing charges having a reverse polarity induced at the electrode (substrate 31) when an image bearing member is charged from infusing from the substrate 31 to the photosensitive layer 38. In the case of negative charging, induced positive holes are prevented by this function. When positively charged, induced electrons are prevented thereby. As specific examples of the charge blocking layer, there are an aniodic oxidized film represented by aluminum oxide layer, an insulating layer formed by inorganic material represented by SiO, a layer formed by glassy network of a metal oxide, a layer formed of polyphosphazene, a layer formed of an aminosilane reactive product, a layer formed of an insulating binder resin, and a layer formed of a curing resin. Among these, the layer formed of an insulating binder resin or a curing resin, which can be formed by a wet application method, can be preferably used. When the moiré prevention layer 45 and the photosensitive layer 38 are formed on or above the charge blocking layer 43 by a wet application method, the charge blocking layer is desired to be formed by a material or composition insoluble in the liquid of application for use in the wet application method.

Specific examples of the binder resin include thermoplastic resins, for example, polyamides, polyesters, and copolymers of vinyl chlorides and vinyl acetates, and thermocuring resins, for example, a thermocuring resin formed by thermally polymerizing a compound having multiple active hydrogens (hydrogens contained in —OH, $NH_2$, —NH, etc.), a compound having multiple isocyanate groups, and optionally a compound having multiple epoxy resins. Specific examples of the compound having multiple active hydrogens include polyvinyl butyral, phenoxy resins, phenol resins, polyamides, polyesters, polyethylene glycols, polypropylene glycols, polybutylene glycol, and acrylic resins containing a hydroxylethyl methacrylate group containing active hydrogens. Specific examples of the compound having multiple isocyanate groups include tolylene diisocyanate, hexamethylene diisocyanate, and diphenyl methane diisocyanate and their polymers. Specific examples of the compound having multiple epoxy groups include bisphenol A type epoxy resins. Among these, in terms of film forming property, environmental stability and anti-chemical property, polyamides resins are most preferred. Among the polyamides, N-methoxy methylated nylon is most suitable. N-methoxy methylated nylon can be obtained by modifying a polyamide containing polyamide 6 as its component by the method proposed by, for example, T. L. Cairns (J. Am. Chem. Soc. 71. P651, published in 1949). N-methoxy methylated nylon is obtained by substituting the hydrogen in the amide linkage of the original polyamide with methoxymethyl group. The substitution ratio can be determined from a wide range according to the modification condition. The ratio is preferably not less than 15 mol % and more preferably not less than 35 mol % to restrain the hydroscopic property in some degree and have a good affinity for alcohol and environmental stability. In addition, as the amide substration ratio (the degree of N—N-methoxy methylation) increases, alcohol solution affinity increases. However, since the influence of side chain groups on the bulk side around the main chain becomes strong, the relaxed state of the main chain, the coordination state between the main chains, etc. change. Thereby, the hydroscopic property increases while the crystallization property decreases, which leads to the drop of the melting point and the deterioration of the mechanical strength and elasticity. Therefore, the substitution ratio is preferably not greater than 85 mol % and more preferably not greater than 70 mol %. As the result of the study, it is found that nylon 6 is preferred and then nylon 66 is next preferred but copolymerized nylon of nylons 6, 66 and 610 is not so preferred contrary to the description in JOP H09-265202.

In addition, a thermoplastic resin formed by thermally polymerizing an oil free alkyd resin and an amino resin, for example, butylated melamine resins, and a photocuring resin formed of a combination of a resin having an unsaturated linkage, for example, a polyurethane having an unsaturated linkage and/or an unsaturated polyester, and a photopolymerization initiator, for example, a thioxanthone based compound and methylbenzyl formate can be used as the binder resin.

It is also good to have a function of restraining the infusion of charges from a substrate by adding an electroconductive polymer having a rectification property and/or an acceptor or doner resin/compound selected according to the charging polarity.

Furthermore, the thickness of the charge blocking layer is from 0.1 to less than 2.0 μm and preferably from 0.3 to less than 2.0 μm. When a charge blocking layer that is too thick is used, the residual voltage tends to significantly rise due to repetitive charging and irradiation especially at a low temperature and low humidity environment. When a charge blocking layer that is too thin is used, the blocking effect tends to be reduced. A charge blocking layer can be formed on a substrate by a known method, for example, a blade coating method, a dip coating method, a spray coating method, a beat coating method and a nozzle coating method. Medicines, solvents, additives, curing promoting agents, etc., can be added, if desired. Subsequent to coating, curing or drying treatment by, for example, drying, heating, and light, is conducted.

The moiré prevention layer 45 is a layer having a function of preventing the production of moiré images caused by optical coherence inside the photosensitive layer 38 when writing is performed by a coherent light, for example, a laser beam. To form a function separation type intermediate layer, the moiré prevention layer 45 contains a metal oxide so that the moiré prevention layer 45 can have a function of generating photocarriers upon application of discharging light. Fundamentally, the moiré prevention layer 45 has a function of scattering the writing light mentioned above. Due to this function, it is effective for the moiré prevention layer 45 to contain a material having a large refraction index.

When the intermediate layer 39 is structured by the charge blocking layer 43 and the moiré prevention layer 45, the effect is significantly increased by contacting the moiré prevention layer 45 with the charge generating layer 35.

In addition, an image bearing member having a function separation type intermediate layer prevents the infusion of charges from the substrate 31 at the charge blocking layer 43. It is preferred that the moiré prevention layer 45 has a function of at least transporting charges having the same polarity as the charges on the surface of the image bearing member in terms of prevention of the rise of the residual voltage. For example, in the case of a negatively charged image bearing member, it is preferred to impart electroconductivity to the moiré prevention layer 45. Therefore, it is preferred to use a metal oxide having electron conductivity or an electroconductive metal oxide. The effect of the present invention can be significantly improved by using an electron conductive material, for example, an acceptor, in the moiré prevention layer 45.

The same binder resins as those for use in the charge blocking layer 43 can be used for the moiré prevention layer 45. Considering that the photosensitive layer 38 (the charge generating layer 35 and the charge transport layer 37) is provided on the moiré prevention layer 45, it is desired to use a binder resin which is insoluble in the liquid of application for use in the photosensitive layer 38.

As the binder resin, thermocuring resins are suitably used. Especially, a mixture of an alkyd resin and a melamine resin is most suitably used. The mixing ratio (alkyd resin to melamine resin) in weight is a significant factor for determining the structure and the characteristics of the moiré prevention layer 45 and preferably from 5/5 to 8/2. A ratio of the melamine resin that is too great is not preferred because the volume contraction tends to be large, which may lead to the occurrence of layer application deficiency and the rise of the residual voltage. A ratio of the alkyd resin that is too great is not preferred because the bulk resistance is excessively low, which may lead to the deterioration of the background fouling despite of the effect on the reduction of the residual voltage of an image bearing member.

In the moiré prevention layer 45, the volume ratio of the metal oxide to the binder resin has a significant importance. It is desired that the volume ratio of the metal oxide to the binder resin is from 1/1 to 3/1. When the ratio is too low, not only does the moiré prevention function tend to deteriorate, but also the rise of the residual voltage tends to increase during repetitive use. To the contrary, when the ratio is too high, the binding ability of the binder resin tends to be inferior and the surface property of the layer tends to deteriorate, which may have an adverse impact on the property of the photosensitive layer 38, which is provided on or above the moiré prevention layer 45. This impact can be significant when the photosensitive layer 38 is a layered type and a thin layer, for example, the charge generating layer 45, is formed therein. When the volume ratio is too high, the binder resin may not completely cover the surface of the metal oxide. Thereby, the metal oxide and a charge generating material directly contact each other, which leads to the increase of the probability of production of thermocarriers, resulting in an adverse impact on the anti-background fouling property.

Further, by using two kinds of metal oxides having different particle diameters in the moiré prevention layer 45, it is possible to improve the covering ability to the substrate 31 and restrain the production of moiré images. Also, pinholes, which cause the production of abnormal images, can be removed thereby. The ratio (D2/D1) of the average particle diameters of the two metal oxides, i.e., a metal oxide T1 having a large particle diameter D1 and a metal oxide T2 having a small diameter D2, is desired to satisfy the following relationship: $0.2<D2/D1\leqq 0.5$. When the particle diameter ratio is too small, the activity at the surface of the metal oxides increases, which may lead to significant deterioration of the electrostatic stability of the image bearing member containing the metal oxides. In addition, when the particle diameter ratio is too large, the ability to cover the substrate 31 deteriorates so that production of moiré and/or abnormal images may not be restrained. The average particle diameter is obtained from the particle diameter distribution obtained when a strong dispersion is performed in an aqueous medium.

In addition, the average particle diameter D2 of the metal oxide T2 has a significant importance and D2 preferably satisfies the following relationship: $0.05\ \mu m<D2<0.20\ \mu m$. When D2 is too small, the covering ability deteriorates, which may cause moiré images. To the contrary, When D2 is too large, the filling ratio of the metal oxides in the moiré prevention layer 45 is decreased so that the effect of restraining the background fouling is not sufficient.

Also, the mixing ratio (by weight) of the two metal oxides is another significant factor and it is preferred to satisfy the following relationship: $0.2\leqq T2/(T1+T2)\leqq 0.8$. When the ratio of T2/(T1+T2) is too small, the filling ratio of the metal oxides is not greatly large so that the effect of restraining the background fouling is not sufficient. When the ratio of T2/(T1+T2) is too large, the covering ability deteriorates, which may cause moiré images.

In addition, the thickness of the moiré prevention layer 45 is from 1 to 10 μm and preferably from 2 to 5 μm. When the layer thickness is too low, the effect is not sufficient. When the layer thickness is too high, the residual voltage rises, which is not preferred.

The metal oxides are dispersed with a solvent and a binder resin by a known method using, for example, a ball mill, a sand mill and an attritor. The liquid dispersions is applied to a substrate by a known method, for example, a blade coating, a dip coating, a spray coating, a bead coating and a nozzle coating with optional agents, solvents, additives, curing promotion agents, etc., desired for curing (cross linking). Subsequent to coating, the layer is dried or cured by treatment of drying, heating, light, etc.

Next, the photosensitive layer 38 is described. The photosensitive layer 38 is formed of the charge generating layer 35 containing an organic charge generating material as the charge generating material and the charge transport layer 37 containing a charge transport material as its main component.

The charge generating layer 35 is formed by dispersing the organic charge generating material with an optional binder resin in a suitable solvent by using a ball mill, an attritor, a sand mill and/or supersonic and applying the liquid dispersions to the intermediate layer 39 followed by drying.

Specific examples of the optional binder resins for use in the charge generating layer 35 include polyamides, polyurethanes, epoxy resins, polyketones, polycarbonates, silicone resins, acrylic resins, polyvinyl butyrals, polyvinyl formals, polyvinyl ketones, polystyrenes, polysulfones, poly-N-vinyl carbazoles, polyacrylamides, polyvinyl benzals, polyesters, phenoxy resins, copolymers of vinylchloride-vinyl acetates, polyvinyl acetates, polyphenylene oxidos, polyvinyl pyridines, cellulose-based resins, caseine, polyvinyl alcohols, and polyvinyl pyrrolidones. The content of the optional binder resin is from 0 to 500 parts by weight and preferably from 10 to 300 parts by weight based on 100 parts by weight of a charge generating material.

Specific examples of the solvents include isopropanol, acetone, methylethylketone, cyclohexane, tetrahydrofuran, dioxane, ethylcellosolve, ethyl acetate, methyl acetate, dichloromethane, dichloroethane, monochlorobenzene, cyclohexane, toluene, xylene, and ligroin. Usable methods of coating a liquid of application are, for example, a dip coating method, a spray coating method, a bead coating method, a nozzle coating method, a spinner coating method and a ring coating method. The layer thickness of the charge generating layer 35 is from about 0.01 to about 5 μm and preferably from 0.1 to 2 μm.

In addition, it is preferred that the transmission factor of the charge generating layer 35 at the wavelength of discharging light is not less than 10%. The upper limit of the transmission factor of the charge generating layer 35 at the wavelength of discharging light is regulated by the relationship to the transmission factor of the charge generating layer 35 at the wavelength of writing light. When the charge generating layer 35 does not have a sufficient light absorption for the writing light, the optical extinction is not sufficient when a latent electrostatic image is formed. Therefore, the transmission factor of the charge generating layer 35 at the wavelength of writing light is preferably not greater than 30%. When the transmission factor is too large, the optical extinction is not sufficient, which may cause a problem. In addition, when the transmission factor of the charge generating layer 35 at the wavelength of discharging light is too small, the discharging light does not sufficiently reach the intermediate layer 39 so that the effect of the present invention may not be sufficiently obtained.

As the charge generating material, organic charge generating materials can be used. Specific examples thereof include phthalocyanine based pigments, for example, metal phthalocyanine and non-metal phthalocyanine, azulenium salt pigments, methine squaric acid pigments, azo pigments having carbazole skeleton, azo pigments having triphenyl amine skeleton, azo pigments having dibenzothiophene skeleton, azo pigments having fluorenone skeleton, azo pigments having oxadiazole skeleton, azo pigments having bisstilbene skeleton, azo pigments having distyryl oxadiazole skeleton, azo pigments having distyryl carbazole skeleton, perylene based pigments, anthraquinone based or polycyclic quinone based pigments, quinone imine pigments, diphenyl methane based pigments, triphenyl methane based pigments, benzoquinone based pigments, naphthoquinone based pigments, cyanine based pigments, azomethine based pigments, indigoid based pigments, and bisbenzimidazole pigments. These charge generating materials can be used alone or in combination.

Among these, the azo pigments represented by the following chemical structure (1) are effectively used as the charge generating material of the present invention. Especially, asymmetric azo pigments having $Cp_1$ and $Cp_2$ which are different from each other are effectively used because the asymmetric azo pigments have a large carrier generation efficiency.

[Chemical Structure 1]

[Chemical structure 1]

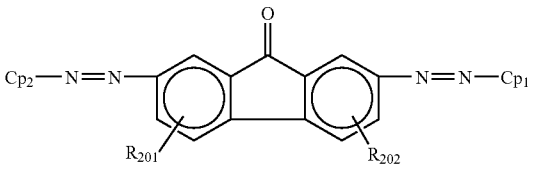

In the chemical structure 1, $Cp_1$ and $Cp_2$ individually represent coupler residue groups. $R_{201}$ and $R_{202}$ independently denote one of hydrogen atom, a halogen atom, an alkyl group, an alkoxy group, and cyano group. $Cp_1$ and $Cp_2$ are represented by the following chemical structure 2:

[Chemical Structure 2]

[Chemical structure 2]

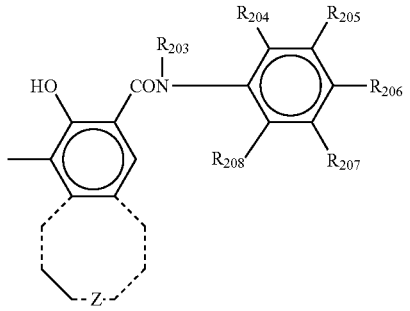

In the chemical structure 2, $R_{203}$ represents one of hydrogen atom, an alkyl group, for example, methyl group and ethyl group, and aryl group, for example, phenyl group. $R_{204}$, $R_{205}$, $R_{206}$, $R_{207}$ and $R_{208}$ independently represent one of hydrogen atom, nitro group, cyano group, a halogen atom, for example, fluorine atom, chlorine atom, bromium atom and iodine atom, an alkyl group, for example, methyl group and ethyl group, an alkoxy group, for example, methoxy group and ethoxy group, dialkyl amino group and hydroxyl group. Z represents an atom group forming a substituted or non-substituted aromatic carbon ring or a substituted or non-substituted aromatic heterocyclic ring.

Titanyl phthalocyanines can be effectively used as the charge generating material of the present invention. Among these, titanyl phthalocyanine having a crystal form having a CuKα X ray diffraction spectrum having a wavelength of 1.542 Å such that a maximum diffraction peak is observed at a Bragg (2θ) angle of 27.2±0.2°, main peaks at a Bragg (2θ) angle of 9.4±0.2°, 9.6±0.2°, and 24.0±0.2°, and a peak at a Bragg (2θ) angle of 7.3±0.2° as the lowest angle diffraction peak, and having no peak between the peak of 9.4°±0.2° peak and the peak of 7.3°±0.2° and no peak at 26.3° efficiently produces carriers and can be used as the charge generating material of the present invention.

With regard to the organic charge generating material contained in the image bearing member for use in the present invention, the effect thereof appears by making the particle size thereof small. The average particle diameter is preferably not greater than 0.25 μm and more preferably not greater than 0.2 μm. The size of the charge generating material contained in the photosensitive layer 38 can be controlled by removing coarse particles having a particle diameter not less than 0.25 μm after dispersion of the charge generating material.

The average particle diameter means the volume average particle diameter and is measured using an ultracentrifugal automatic particle size measuring device (CAPA-700, manufactured by Horiba Ltd.). The volume average particle diameter is calculated as the particle diameter (the median particle diameter) corresponding to the cumulative 50% particle diameter. However, since this method has a possibility that a minute quantity of coarse particles is not detected, it is desired to directly observe charge generating powder or a liquid dispersion thereof with an electron microscope to obtain an accurate size.

As a result of the study on the minute defect based on further observation of the liquid dispersions, the phenomenon is recognized as follows. In a typical method of measuring the average particle size, when particles having an extremely large size are present in an amount of not less than a couple percent, these particles can be detected. But the measuring device cannot detect large particles present in a small amount, for example, about not greater than 1% based on the total amount. Consequently, such large particles cannot be detected by simply measuring the average particle size, which makes understanding the minute defect mentioned above difficult.

Figure 5:
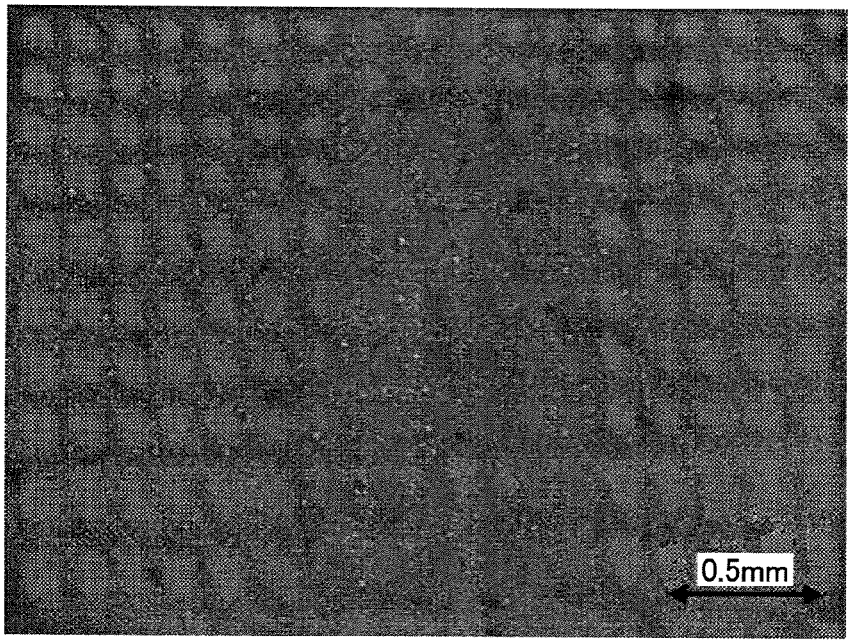
FIG. 5 is a photograph illustrating the state in which the liquid dispersion is prepared in a short dispaersion time.
Figure 6:
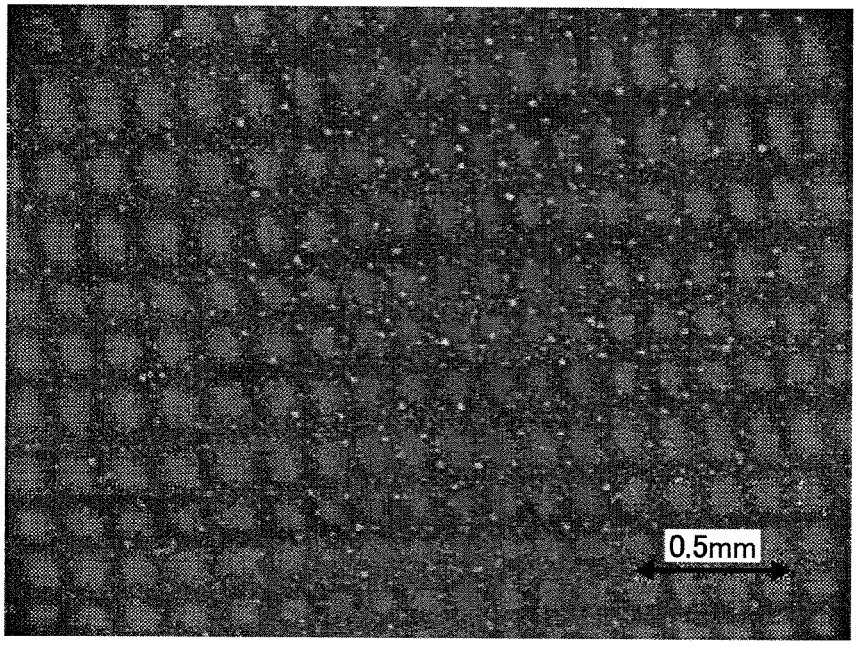
FIG. 6 is a photograph illustrating the state in which the liquid dispersion is prepared in a long dispaersion time.

FIGS. 5 and 6 are photographs illustrating the states of two kinds of a liquid dispersion formed under the same dispersion conditions except for the dispersion time. FIG. 5 is a photograph of a liquid dispersion formed in a short dispersion time. Black particles, which represent remaining coarse particles, are observed in the photograph of FIG. 5 as compared with the photograph of a liquid dispersion of FIG. 6 which is formed in a relatively long dispersion time.

Figure 7:
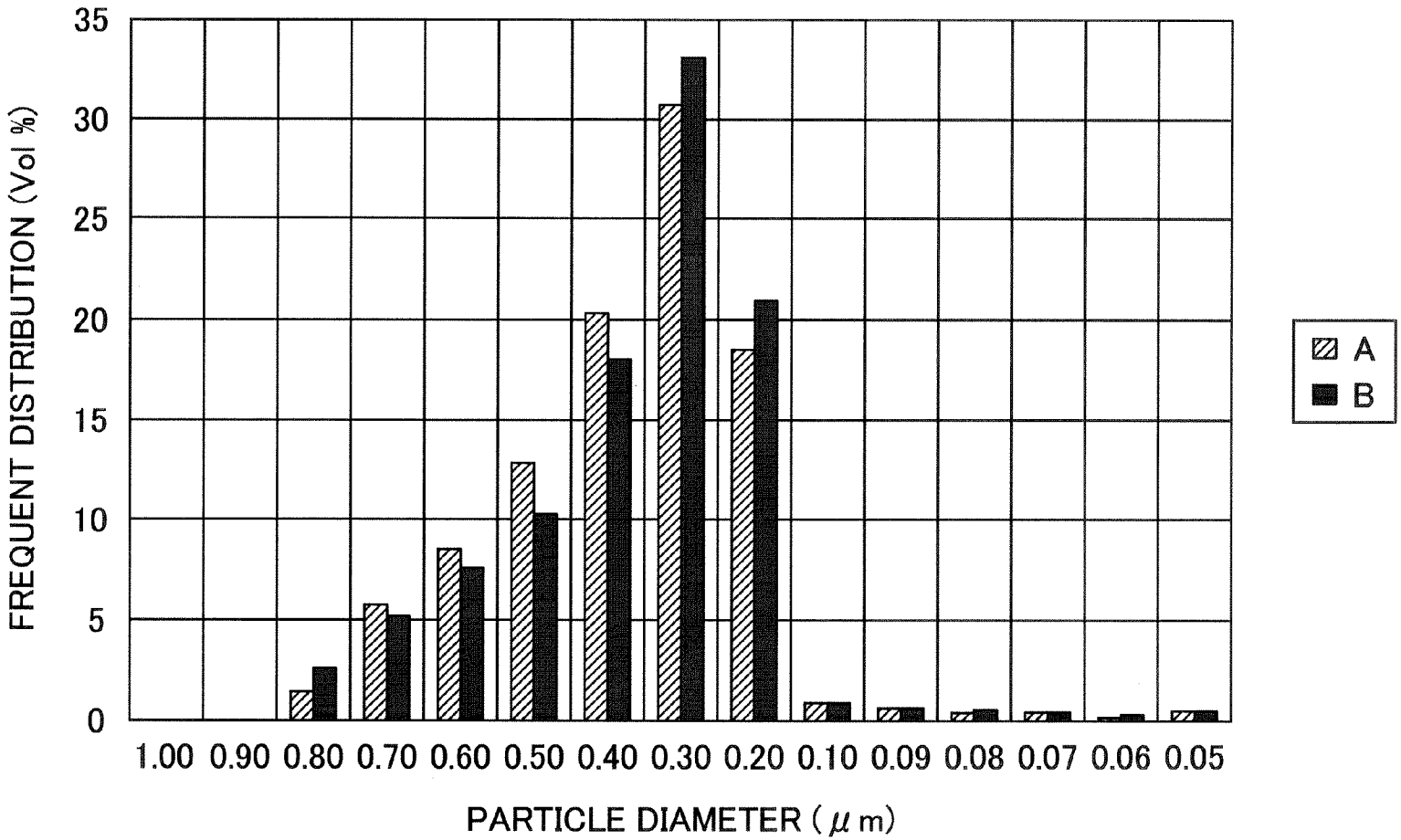
FIG. 7 is a diagram illustrating the average particle diameter and the particle size distribution for the liquid dispersion of FIGS. 5 and 6.

The average particle diameter and the particle size distribution of these two kinds of liquid dispersions are measured by a known method using a marketed ultracentrifugal automatic particle size measuring device (CAPA-700, manufactured by Horiba Ltd.). The results are shown in FIG. 7. A in FIG. 7 corresponds to the particle diameter and the particle size of the liquid dispersions of FIG. 5 and B in FIG. 7 corresponds to the particle diameter and the particle size of the liquid dispersions of FIG. 6. When both are compared, there is actually no difference with regard to the particle size distribution. The average particle diameters of A and B are 0.29 μm and 0.28 μm, respectively. Considering the measuring error, it is difficult to determine that there is a difference between A and B.

Therefore, it is difficult to detect a minute quantity of large particles remaining in a liquid dispersion simply by a known method for measuring an average particle size. Therefore, it is understood that such a method is not sufficient to obtain particles suitable for the current negative-positive development having a high definition. Such large particles existing in a minute quantity can be recognized only when the liquid of application is observed with a microscope.

Next, a method of removing coarse particles after dispersing organic charge generating material is described.

In the method, after preparing a a liquid dispersion in which particles are made to be as fine as possible, the liquid dispersions is filtered with a suitable filter.

A liquid dispersion can be prepared by a known method. The organic charge generating material and an optional binder resin are dispersed in a suitable solvent with a ball mill, an attritor, a sand mill, a bead mill or supersonic. The binder resin can be selected based on the electrostatic characteristics of an image bearing member and the solvent can be selected based on the wettability to a pigment and the dispersability thereof.

In this method, it is possible to remove large particles present in a minute amount which cannot be observed or detected by particle size measurement. In addition, the method is also extremely effective in light of obtaining a sharp particle size distribution. Specifically, the liquid dispersions prepared as described above is subject to filtration with a filter having an effective mesh size of not greater than 5 μm and preferably not greater than 3 μm. A liquid dispersion containing only organic charge generating material having a small particle size, i.e., not greater than 0.25 μm and preferably not greater than 0.2 μm, can be prepared by this method. When an image bearing member using this titanyl phthalocyanine is installed in an image forming apparatus, the effects of the present invention is further significant.

A particle size of the filtered a liquid dispersion that is too large or a particle size distribution thereof that is too broad may increase the loss by the filtration and cause clogging during the filtration, which leads to make the further filtration impossible. Therefore, with regard to the liquid dispersions before filtration, it is desired to perform the dispersion by which the average particle size is not greater than 0.3 μm with a standard deviation of 0.2 μm. When the average particle size is too large, the loss of the filtration tends to increase and when the standard deviation is too large, the filtration may take long.

The charge generating material for use in the present invention has an extremely strong hydrogen bond force, which is characteristic to a charge generating material having a high sensitivity. Thereby, the interaction between dispersed pigment particles is extremely strong. Consequently, charge generating material particles dispersed by a dispersion device are highly likely to reagglomerate by dilution so that, as described above, such agglomerated materials can be removed by using a filter having a mesh not larger than a particular size. Since the liquid dispersions is in a thixotropy state, particles having a particle diameter smaller than that of the effective mesh diameter of the filter are also removed. In addition, it is possible to change structural viscosity liquid to a state close to Newtinian by filtration. When coarse particles of the charge generating material are removed as described above, the effect of the present invention can be extremely improved.

Selection of the filters filtering a liquid dispersion depends on the size of coarse particles to be removed. According to the study by the inventors of the present invention, it is found that coarse particles having a size of about 3 μm have an adverse effect on images when such coarse particles exist in an image bearing member for use in an image forming apparatus performing image formation with a definition of about 600 dpi. Therefore, a filter used preferably has an effective mesh size not greater than 5 μm and more preferably not greater than 3 μm. With regard to the effective mesh size, it is more effective to remove large particles with a small effective mesh size. But when the effective mesh size is too small, the desired pigment particles may be filtered as well. Therefore, there is a suitable effective mesh size. In addition, when the effective mesh size is too small, there are problems such that it takes a long time to complete filtration, the filter is clogged, and the burden is too heavy when a pump, etc., is used to send liquid. A filter is desirably made of a material insoluble in a solvent for use in a liquid dispersion to be filtered.

The charge transport layer 37 is mainly formed of a charge transport material and can be formed by dissolving or dispersing a charge transport material and a binder resin in a suitable solvent and applying the resultant liquid to the charge generating layer 35 followed by drying. It is possible to add a plastic agent, a leveling agent and an anti-oxidizing agent, if desired.

There are two types of the charge transport materials, which are a positive hole transport material and an electron transport material.

Specific examples of such positive hole transport materials include poly-N-vinylcarbazoles and their derivatives, poly-γ-carbazolyl ethyl glutamates and their derivatives, pyrene-formaldehyde condensation compounds and their derivatives, polyvinyl pyrenes, polyvinyl phenanthrenes, polysilanes, oxazole derivatives, oxadiazole derivatives, imidazole derivatives, monoaryl amine derivatives, diaryl amine derivatives, triaryl amine derivatives, stilbene derivatives, α-phenyl stilbene derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bisstilbene derivatives, enamine derivatives and other known materials. These charge transport materials can be used alone or in combination.

Specific examples of such electron transport material include electron acceptance materials such as chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothhiophene-5,5-dioxide, and benzoquinone derivatives.

Specific examples of the binder resins include thermal curing resins and thermal plastic resins, for example, polystyrenes, styrene-acrylonitrile copolymers, styrene-butadiene copolymers, styrene-maleic acid anhydride copolymers, polyesters, polyvinyl chlorides, vinyl chloride-vinyl acetate copolymers, polyvinyl acetates, polyvinyl vinylidenes, polyarates, phenoxy resins, polycarbonates, cellulose acetate resins, ethyl cellulose resins, polyvinyl butyrals, polyvinyl formals, polyvinyl toluene, poly-N-vinylcarbazols, acrylic resins, silicone resins, epoxy resins, melamine resins, urethane resins, phenol resins, and alkyd resins.

The content of the charge transport material is from 20 to 300 parts by weight and preferably from 40 to 150 parts by weight based on 100 parts by weight of a binder resin. The layer thickness of the charge transport layer 37 is preferably from about 5 to about 100 μm.

Specific examples of the solvents include tetrahydrofuran, dioxane, toluene, dichloromethane, monochlorobenzne, dichloroethane, cyclohexanone, methyl ethyl ketone, and acetone. Among these, to reduce the burden on the environment, the use of a non-halogenated solvent is preferred. Preferred specific examples thereof include cyclic ethers, for example, tetrahydrofuran, dioxolane and dioxane, aromatic hydrocarbons, for example, toluene and xylene and their derivatives.

In an embodiment of the present invention, the charge generating layer 35 and the charge transport layer 37 are formed on the intermediate layer 39. Therefore, it is preferred to select a suitable charge transport material to make discharging light reach the intermediate layer 39 in a sufficient amount to obtain the discharging function (i.e., generation of photocarriers in the intermediate layer 39). In addition, the charge transport layer 37 tends to deteriorate while the charge transport material repetitively absorbs discharging light, which may lead to the rise of the residual voltage to the contrary. In the structure described above, the transmission factor of the charge transport layer 37 for discharging light is not less than 30%, preferably not less than 50% and more preferably not less than 85%.

To obtain such a transmission factor, it is preferred to select a suitable charge transport material for discharging light. Among the charge transport materials mentioned above, a charge transport material having triarylamine skeletone is preferred for the image bearing member for use in the present invention because such a charge transport material easily transmits discharging light having a wavelength shorter than 500 nm and has a great transferability.

Among the charge transport materials having triarylamine skeletone, especially the charge transport material represented by the following chemical structure 5 is effectively used.

[Chemical Structure 5]

[Chemical structure 5]

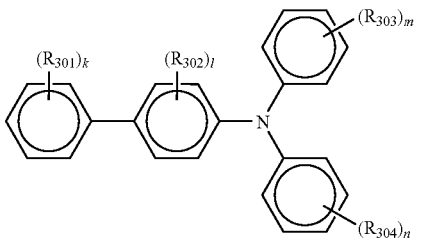

In the chemical structure 3, $R_{301}$, $R_{303}$ and $R_{304}$ represent hydrogen atom, an alkoxy group, a thioalkoxy group, an aryloxy group, a methylene dioxy group, a non-substituted alkyl group, a halogen atom or a substituted or non-substituted aryl group. $R_{302}$ represents hydrogen atom, an alkoxy group, a substituted or non-substituted alkyl group or a halogen atom. p, q, r and s independently represent an integer of from 1 to 4. When p, q, r and s are 2, 3 or 4, each of $R_{301}$, $R_{302}$, $R_{303}$ and $R_{304}$ can be the same or different.

In the present invention, a plasticizing agent and a leveling agent can be contained in the charge transport layer 37, if desired.

Specific examples of the plasticizing agent include dibutyl phthalate and dioctyl phthalate, which are used for typical resins. The addition amount of the plasticizing agent is preferably from 0 to 30 weight % based on a binder resin.

Specific examples of the leveling agent include silicone oils, for example, dimethyl silicone oil and methyl phenyl silicone oil, and polymers or oligomers having perfluoroalkyl groups in its side chain. The addition amount of the leveling agent is preferably from 0 to 1 weight % based on a binder resin.

In the image bearing member for use in the present invention, the protective layer 41 can be optionally provided on or above the photosensitive layer 38 for protection. Recently, computers have been used in daily life, and therefore, a high-speed printing and the size reduction are demanded for a printer. The protective layer 41 provided on or above a photosensitive layer can improve the durability of an image bearing member. Therefore, the image bearing member for use in the present invention having a high sensitivity can be fully utilized without producing abnormal images.

There are two types of the protective layers 41 for use in the present invention. One is a layer in which a filler is added in a binder resin. The other is a layer in which a cross linking type binder is used.

The structure in which a filler is added is described first.

Specific examples of the materials for use in the protective layer 41 include ABS resins, ACS resins, olefin-vinyl monomer copolymers, chlorinated polyether, allyl resins, phenolic resins, polyacetals, polyamides, polyamideimides, polyallylsulfones, polybutylenes, polycarbonates, polyarylates, polyethersulfones, polyethylenes, polyethyleneterephthalates, polyimides, acrylic resins, polymethylpentenes, polypropylenes, polyphenyleneoxides, polysulfones, polystyrenes, AS resins, butadiene-styrene copolymers, polyurethanes, polyvinyl chlorides, polyvinylidene chlorides, epoxy resins, etc. Among these resins, polycarbonates and polyarylates are preferably used.

In addition, to improve the anti-abrasion property of the protective layer 41, fluorine-containing resins, for example, polytetrafluoroethylene, and silicone resins can be used therefor. Further, combinations of such resins and an inorganic filler, for example, a titanium oxide, an aluminum oxide, a tin oxide, a zinc oxide, a zirconium oxide, a magnesium oxide, a potassium titanate and silica or an organic filler can also be used therefor. These inorganic fillers may be subjected to a surface-treatment.

In addition, organic and inorganic fillers can be used in the protective layer 41. Suitable organic fillers include powders of fluorine-containing resins, for example, polytetrafluoroethylene, silicone resin powders, amorphous carbon powders, etc. Specific examples of the inorganic fillers include powders of metals, for example, copper, tin, aluminum and indium; metal oxides, for example, alumina, silica, tin oxide, zinc oxide, titanium oxide, alumina, zirconia, indium oxide, antimony oxide, bismuth oxide, calcium oxide, tin oxide doped with antimony and indium oxide doped with tin; and potassium titanate. In terms of the hardness of a filler, the inorganic fillers are preferred. In particular, silica, titanium oxide and alumina are effectively used.

The content of the filler in the protective layer 41 is preferably determined depending on the species of the filler used and the conditions of the electrophotographic process using the resultant image bearing member, but the content of a filler on the uppermost surface side of the protective layer 41 is preferably not less than 5% by weight, more preferably from 10 to 50% by weight, and even more preferably from 10 to 30% by weight, based on the total weight of the solid portion thereof.

The filler included in the protective layer 41 preferably has a volume average particle diameter of from 0.1 to 2 μm, and more preferably from 0.3 to 1 μm. When the average particle diameter is too small, the anti-abrasion property of the resultant image bearing member is not satisfactory. In contrast, when the average particle diameter is too large, the surface property of the resultant protective layer deteriorates or the protective layer 41 is not formed.

The average particle diameter of a filler described in the present invention means a volume average particle diameter unless otherwise specified, and is measured using an ultracentrifugal automatic particle size measuring device (CAPA-700, manufactured by Horiba Ltd.). The volume average particle diameter is calculated as the particle diameter (the median particle diameter) corresponding to the cumulative 50% particle diameter. In addition, it is preferred that the standard deviation of the particle diameter distribution curve of the filler used for the protective layer 41 is not greater than 1 μm. When the standard deviation is too large (i.e., when the filler has too broad particle diameter distribution), the effect of the present invention is not clearly obtained.

In addition, pH of a filler for use in the present invention has a large effect on the resolution of images produced and the dispersability of the filler. One of the thinkable reasons is as follows. Hydrochloric acid used in the preparation of a filler (in particular, metal oxides) may remain therein. When the content of the remaining hydrochloric acid is large, the resultant image bearing member tends to produce blurred images. In addition, hydrochloric acid can have an adverse effect on the dispersibility of the filler depending on the remaining amount thereof.

Another reason is that the chargeability of a filler (in particular, a metal oxide) is greatly affected by the pH of the fillers. In general, particles dispersed in a liquid are positively or negatively charged and ions having the reverse polarities agglomerate for electric neutralization. As a result, electric double layers are formed and thereby the particles are stably dispersed in the liquid. As the distance from the particle increases, the potential (i.e., zeta potential) dwindles to zero in an electrically neutral area. As the absolute value of zeta potential increases, the repulsion between particles is strong, meaning that the stability of the dispersion is high. As the absolute value of zeta potential approaches to zero, the particles easily aggregate and are unstable. The zeta potential of a system greatly depends on the pH thereof. The zeta potential becomes zero at a particular pH, meaning that the system has an isoelectric point. Therefore, to stabilize a dispersion system, it is preferred to increase the absolute value of zeta potential by keeping away from the isoelectric point of the system.

It is preferred that the protective layer contains a filler having a pH of 5 or higher at the isoelectric point to prevent production of a blurred image. In other words, a filler having a highly basic property is preferably used in the image bearing member for use in the present invention to increase the prevention effect. A filler having a high basic property at an isoelectric point has a high zeta potential (i.e., the filler is stably dispersed) in an acidic system.

In this invention, the pH of a filler means the pH value of the filler at the isoelectric point, which is determined by the zeta potential of the filler. Zeta potential can be measured by a laser beam potential meter manufactured by Otsuka Electronics Co., Ltd.

In addition, to prevent production of blurred images, a filler having a high electric resistance (i.e., not less than $1\times10^{10}$ Ω·cm in resistivity) is preferably used. Further, a filler having a pH not less than 5 and a filler having a dielectric constant not less than 5 can be particularly preferably used. A filler having a dielectric constant not less than 5 and/or a pH not less than 5 can be used alone or in combination. In addition, a filler having a pH not less than 5 and a filler having a pH less than 5, or a filler having a dielectric constant not less than 5 and a filler having a dielectric constant less than 5 can also be used in combination. Among these fillers, α-alumina, which has a high insulating property, a high thermal stability and an anti-abrasion property due to its hexagonal close-packed structure, is particularly preferred in terms of prevention of formation of blurred images and improvement of anti-abrasion property of the resultant image bearing member.

In the present invention, the specific resistivity of a filler is defined as follows. The specific resistivity of a powder such as a filler fluctuates depending on the filling factor thereof. Therefore, it is desired to measure the specific resistivity under a constant condition. In the present invention, the resistivity is measured by a device having a similar structure to that of the device illustrated in FIG. 1 of JOP H05-113688. The surface area of the electrodes of the device is 4.0 $cm^2$. Before the specific resistivity of a sample powder is measured, a load of 4 kg is applied to one of the electrodes for 1 minute and the amount of the sample powder is adjusted such that the distance between the two electrodes is 4 mm.

The specific resistivity of the sample powder is measured while the sample powder is under pressure of the weight (i.e., 1 kg) of the upper electrode without any other load. The voltage applied to the sample powder is 100 V. HIGH RESISTANCEMETER (manufactured by Yokogawa Hewlett-Packard Co.) is used to measure the resistivity not less than $10^6$ Ω·cm. A digital multimeter (manufactured by Fluke Corp.) is used to measure the specific resistivity less than $10^6$ Ω·cm. The thus obtained resistivity is defined as the resistivity of the present invention.

The dielectric constant of a filler is measured as follows. A cell similar to that used in measuring the specific resistivity is also used to measure the dielectric constant. After a load is applied to a sample powder, the electric capacity of the sample powder is measured using a dielectric loss measuring instrument (manufactured by Ando Electric Co., Ltd.) to determine the dielectric constant of the powder.

These fillers can be subject to surface treatment using at least one surface treatment agent to improve the dispersion property of the fillers in a protective layer. When a filler is poorly dispersed in a protective layer, the following problems occur:

(1) the residual potential of the resultant image bearing member increases;

(2) the transparency of the resultant protective layer decreases;

(3) coating defects occur in the resultant protective layer;

(4) the anti-abrasion property of the protective layer deteriorates; and (5) the durability of the resultant image bearing member deteriorates.

These problems can lead to a large problem inhibiting the improvement on the quality of images and the duration property of the resultant image bearing member.

Suitable surface treatment agents include known surface treatment agents. Among these, surface treatment agents which can maintain the highly insulative property of a filler used are preferred.

As the surface treatment agents, titanate coupling agents, aluminum coupling agents, zircoaluminate coupling agents, higher fatty acids, combinations of these agents with a silane coupling agent, $Al_2O_3$, $TiO_2$, $ZrO_2$, silicones, aluminum stearate, and the like, can be preferably used to improve the dispersibility of fillers and to prevent formation of blurred images. These materials can be used alone or in combination.

When a filler treated with a silane coupling agent is used, the resultant image bearing member tends to produce blurred images. However, when a silane coupling agent is used in combination with one of the surface treatment agents mentioned above, the affect of the silane coupling is possibly restrained.

The coating weight of a surface treatment agents is preferably from 3 to 30% by weight, and more preferably from 5 to 20% by weight, based on the weight of the treated filler although the weight is determined depending on the average primary particle diameter of the filler.

When the content of the surface treatment agent is too low, the dispersibility of the filler is not improved. In contrast, when the content is too high, the residual potential of the resultant image bearing member significantly increases.

These fillers can be dispersed using a proper dispersion machine. In this case, the fillers are preferably dispersed to an extent that the aggregated particles are dissociated and primary particles of the fillers are dispersed to improve the transparency of the resultant protective layer.

In addition, a charge transport material can be contained in the protective layer 41 to enhance the photo-responsive property and to reduce the residual potential of the resultant image bearing member. The charge transport materials mentioned above for use in the charge transport layer 37 and known charge transport material can also be used for the protective layer 41.

When a low molecular weight charge transport material is used in the protective layer 41, the concentration of the charge transport material may be gradated in the thickness direction of the protective layer 41 with the surface side being thinner. Specifically, it is preferred to reduce the concentration of the charge transport material at the surface portion of the protective layer 41 to improve the anti-abrasion property of the resultant image bearing member. The concentration of the charge transport material means the ratio of the weight of the charge transport material to the total weight of the protective layer 41.

It is extremely advantageous to use a charge transport polymer in the protective layer 41 to improve the durability of the image bearing member.

Furthermore, known charge transport polymers can be used as the binder resin contained in the protective layer 41. The effects of using such a known charge transport polymer are the improvement on anti-abrasion property and the charge transport at a high speed.

Typical application methods are adopted as a method of forming the protective layer 41. The layer thickness of the protective layer 41 is suitably from 0.1 to 10 μm.

Next, the protective layer 41 having a cross linking structure (hereinafter referred to as cross linking type protective layer 41) as the binder structure thereof is described.

With regard to the formation of cross linking structure, three dimensional mesh structure is formed by conducting cross linking reaction using a reactive monomer having multiple cross linking functional groups in one molecular by using optical and/or thermal energy. A binder resin having this mesh structure can have a high anti-abrasion property.

In addition, it is extremely effective to use a monomer partially or entirely having a charge transport function as the reactive monomer mentioned above. By using such a monomer, charge transport portions are formed in the mesh structure, which makes the protective layer 41 properly function. A reactive monomer having triarylamine structure can be effectively used as the monomer having the charge transport function.

The protective layer 41 having such a mesh structure has a high anti-abrasion property but the volume contraction thereof is also large. Therefore, a protective layer that is too thick may cause cracking inside. To solve this problem, the protective layer 41 can have a layered structure formed of a first protective layer of a low molecular dispersion polymer and a second protective layer having a cross linking structure on the first protective layer.

Among cross linking type protective layers 41, the protective layer 41 having a particular structure is especially effectively used.

The protective layer 41 having a particular structure is a protective layer formed by curing a radical polymeric monomer having at least 3 functional groups which does not have a charge transport structure and a radical polymeric monomer having a functional group which has a charge transport structure.

In the cross-linking type protective layer 41, a three-dimensional mesh structure is developed because the protective layer 41 has a cross-linking structure formed by curing a radical polymeric monomer having at least 3 functional groups. Therefore, the resultant surface layer has an extremely high cross linking density with a high hardness and a high elasticity. Further, the surface is uniform and smooth and obtains a high anti-abrasion property and a high anti-damage property. As described above, it is desired to increase the cross-linking density of the surface, i.e., the number of the cross-linkings per unit area. However, an internal stress increases due to the volume contraction since a number of linkings are formed instantly during curing reaction. This internal stress increases as the layer thickness of the cross-linking type protective layer 41 thickens. Therefore, curing the entire protective layer 41 tends to invite cracking and peeling-off thereof. This phenomenon may not occur initially. But while electrophotography processes, for example, charging, developing, transferring and cleaning are repetitively performed, such cracking and peeling-off tend to occur due to cleaning hazard, thermal fluctuation, etc. over time.

There are the following methods for solving this problem:

(1) introducing a polymeric component in the cross-linking layer and the cross-linking structure, (2) using a radical polymeric monomer having one or two functional groups in a large amount, and (3) using a monomer having multi-functional groups having a plasticity group. The cured resin layer can be flexible by these methods. However, the cross-linking density is thin in either of these methods and the anti-abrasion property is not significantly improved. To the contrary, the image bearing member for use in the present invention has a cross linking type protective layer 41 having a charge transport structure with a high cross linking density provided on the charge transport layer 37. The cross linking type protective layer 41 has a layer thickness of from 1 to 10 μm in which a three-dimensional structure is developed. Thereby, such cracking and peeling-off do not occur to the image bearing member for use in the present invention and further, an extremely high anti-abrasion property is obtained. When the layer thickness of the cross linking type protective layer 41 is from 2 to 8 μm, the margin against the problem mentioned above is wide. In addition, a material having a high cross-linking density can be selected to further improve the anti-abrasion property.

The reason the image bearing member for use in the present invention can restrain the occurrence of cracking and peeling-off is, for example, that the internal stress can be limited because the cross linking type protective layer 41 can be made to be thin. Another reason is that the internal stress in the cross linking type protective layer 41 forming the surface can be relaxed because the photosensitive layer 38 or the charge transport layer 37 is provided under the cross linking type protective layer 41. Thereby, the cross linking type protective layer 41 does not necessarily contain a polymeric material in a large amount, which leads to the reduction of incompatibility of a cured compound produced during the reaction between the polymeric material and a radical polymeric composition (radical polymeric monomer or a radical polymeric compound having a charge transport structure). Therefore, scars and toner filming ascribable to the incompatibility hardly occur. Further, when the protective layer 41 is entirely cured upon application of optical energy, light transmission inside the charge transport layer 37 is limited due to the absorption thereof by the charge transport structure. Thereby, there is a possibility that the curing reaction is not fully and uniformly conducted inside the layer. In the cross linking type protective layer 41 for use in the present invention, the curing reaction uniformly proceeds inside the layer because the layer is thin, i.e., preferably not greater than 10 μm. Therefore, the layer can have a good anti-abrasion property therein as on the surface. Further, the cross linking protective layer 41 is formed of a radical polymeric compound having a functional group in addition to the radical polymeric monomer having three functional groups mentioned above. The radical polymeric compound having a functional group and a charge transport structure is trapped in the cross linking when the radical polymeric monomer having three functional groups is cured. In contrast, when a low molecular weight charge transport material having no functional group is contained in the cross linking surface layer, the low molecular weight charge transport material precipitates or clouding phenomenon occurs due to its low compatibility. Further, the mechanical strength of the surface of the cross-linking layer deteriorates. On the other hand, when a charge transport material having at least two functional groups is mainly used, the charge transport material is trapped in multiple linkages, which leads to improvement on the cross linking density. However, the charge transport structure is extremely bulky, which greatly distorts the structure of the resultant curing resin. This can be a cause of increasing the internal stress in the cross linking type charge transport layer 41.

Further, the image bearing member for use in the present invention has good electric characteristics and therefore has a good stability for repetitive use, which leads to high durability and stability. This is because a radical polymeric compound having a functional group and a charge transport structure is used as a composition material forming the cross linking type protective layer 41 and is fixed between the cross linkings in a pendant manner. As described above, a low molecular weight charge transport material having no functional group precipitates or white turbidity phenomenon occurs, which leads to significant deterioration of the electric characteristics, for example, deterioration of the sensitivity and the rise of the residual voltage, during repetitive use. When a charge transport compound having at least two functional groups is mainly used, the charge transport compound is fixed in the cross linking structure with multiple linkings. Therefore, the structure of the intermediary body (cation radical) during charge transport is not stable, which may lead to deterioration of the sensitivity and the rise of the residual voltage by charge entrapment. The deterioration of the electric characteristics results in the decrease in the image density and an image with thinned lines. Further, the design of a typical image bearing member, which is designed to have a high transportability with less charge entrapment, can be applied to an undercoating layer of the image bearing member for use in the present invention. Therefore, the electric side effects of the cross linking type protective layer 41 having a charge transport structure can be limited to the minimal level.

Further, the cross linking type protective layer 41 for use in the present invention is insoluble in an organic solvent during the formation of the cross linking type protective layer 41. Therefore, the cross linking type protective layer is highly anti-abrasive. The cross linking type protective layer 41 for use in the present invention is formed by curing a radical polymeric monomer having three functional groups without having a charge transport structure and a radical polymeric compound having a functional group and a charge transport structure. A three-dimensional mesh structure is developed in the cross linking type protective layer 41 and therefore the density of the cross-linking structure therein is high. However, depending on the other components (additives, for example, a monomer having one or two functional groups, a polymeric binder, an anti-oxidization agent, a leveling agent and a plasticizer and a dissolved component commingling from the layer disposed under the protective layer 41) other than the polymeric monomers and the compounds mentioned above and the curing conditions, the cross linking density may locally be thin or a collective body of fine cured cross-linked materials having a high density is formed. In this type of cross linking type protective layer, the linkage force among cured materials is weak and soluble in an organic agent. Further, during repetitive use in the electrophotography process, the cross linking type charge transport layer tends to be locally abraded and the cured material is easily detached into minute pieces. As in the present invention, when the cross linking type protective layer 41 is insoluble in an organic solvent, the proper three-dimensional mesh structure is developed with a high density. In addition, since the chain reaction proceeds in a wide area and the cured material grows and has a high molecular weight, the anti-abrasion property is highly improved.

Next, the material composition of the liquid of application for the cross linking type protective layer related to the present invention is described.

The radical polymeric monomer having at least 3 functional groups which does not have a charge transport structure related to the present invention contains at least 3 radical polymeric functional group but does not contain a positive hole structure, for example, triaryl amine, hydrazone, pyrazoline and carbazole nor an electron transport structure, for example, an electron suction aromatic ring having, for example, a condensed polycyclic quinone, a diphenoquinone, cyano group and nitro group. The radical polymeric functional group is any radical polymerizable group having carbon and carbon double linking. Specific examples of the radical polymeric functional groups include 1-substituted ethylene fucntinoal group and 1,1-substituted ethylene functional group as follows:

A specific example of 1-substituted ethylene functional groups is the functional group represented by the following chemical formula 1:

$CH_2{=}CH{-}X_1{-}$ [Chemical formula 1]

wherein $X_1$ represents an arylene group, for example, a substituted or non-substituted phenylene group and naphthylene group, a substituted or non-substituted alkenylene group, —CO—, —COO—, —CON($R_{10}$) ($R_{10}$ represents hydrogen atom, an alkyl group, for example, methyl group and ethyl group, an aralkyl group, for example, benzyl group, naphthyl methyl group, and an aryl group, for example, phenethyl group and naphthyl group), or —S—).

Specific examples of such functional groups include vinyl group, styryl group, 2-methyl-1,3-butadienyl group, vinyl carbonyl group, acryloyloxy group, acryloyl amide group, and vinylthio ether group.

A specific example of 1,1-substituted ethylene functional groups is the functional group represented by the following chemical formula 15?:

$CH_2{=}C(Y){-}(X_2)_d{-}$ Chemical formula 15???, wherein Y represents a substituted or non-substituted alkyl group, a substituted or non-substituted aralkyl group, an aryl group, for example, a substituted or non-substituted phenyl group and naphtyl group, a halogen atom, cyano group, nitro group, an alokoxy group, for example, methoxy group and ethoxy group, —$COOR_{11}$ ($R_{11}$ represents hydrogen atom, an alkyl group, for example, a substituted or non-substituted methyl group or ethyl group, an aralkyl group, for example, a substituted or non-substituted benzyl group and a substituted or non-substituted phenethyl group, an aryl group, for example, a substituted or non-substituted phenyl group and a substituted or non-substituted naphtyl group, or —$CONR_{12}R_{13}$ ($R_{12}$ and $R_{13}$ independently represent a hydrogen atom, an alkyl group, for example, a substituted or non-substituted methyl group or a substituted or non-substituted ethyl group, an aralkyl group, for example, a substituted or non-substituted benzyl group, a substituted or non-substituted naphthyl methyl group, and a substituted or non-substituted phenethyl group, or an aryl group, for example, a substituted or non-substituted phenyl group and a substituted or non-substituted naphtyl group). $X_2$ represents the same substitution group as $X_1$ in the chemical structure ??? or an alkylene group and d represents 0 or 1. At least one of Y and $X_2$ is an oxycarbonyl group, cyano group, an alkenylene group or an aromatic ring.

Specific examples of these functional groups include α-cyanoacryloyloxy group, methacryloyloxy group, α-cyanoethylene group, α-cyanoacryloyloxy group, α-cyanophenylene group and methacryloyl amino group.

Specific examples of the substitution groups further substituted to the substitution groups of $X_1$, $X_2$ and Y include halogen atom, nitro group, cyano group, an alkyl group, for example, methyl group and ethyl group, an alkoxy group, for example, methoxy group and ethoxy group, an aryloxy group, for example, phenoxy group, an aryl group, for example, phenyl group and naphtyl group, and an aralkyl group, for example, benzyl group and phenetyl group.

Among these radical polymeric functional groups, an acryloyloxy group and a methacyloyloxy group are particularly suitable. A compound having at least three acryloyloxy groups can be obtained by performing ester reaction or ester conversion reaction using, for example, a compound having at least three hydroxyl groups therein and an acrylic acid (salt), a halide acrylate and an ester of acrylate. Similarly, a compound having at least three methacryloyloxy groups can be obtained. In addition, the radical polymeric functional groups in a monomer having at least three radical polymeric functional groups can be the same or different from each other.

The radical polymeric monomer having three functional groups without having a charge transport structure are specifically the following compounds but not limited thereto.

Specific examples of the radical polymeric monomer mentioned above for use in the present invention include trimethylol propane triacrylate (TMPTA), trimethylol propane trimethacrylate, trimethylol propane alkylene modified triacrylate, trimethylol propane ethyleneoxy modified (hereinafter referred to as EO modified) triacrylate, trimethylol propane propyleneoxy modified (hereinafter referred to as PO modified) triacrylate, trimethylol propane caprolactone modified triacrylate, trimethylol propane alkylene modified triacrylate, pentaerythritol triacrylate, pentaerythritol tetra acrylate (PETTA), glycerol triacrylate, glycerol epichlorohydrin modified (hereinafter referred to as ECH modified) triacrylate, glycerol EO modified triacrylate, glycerol PO modified triacrylate, tris (acryloxyethyl) isocyanurate, dipenta erythritol hexaacrylate (DPHA), dipenta erythritol caprolactone modified hexaacrylate, dipenta erythritol hydroxyl dipenta acrylate, alkylized dipenta erythritol tetraacrylate, alkylized dipenta erythritol triacrylate, dimethylol propane tetraacrylate (DTMPTA), penta erythritol ethoxy tetraacrylate, phosphoric acid EO modified triacrylate, and 2,2,5,5-tetrahydroxy methyl cyclopentanone tetracrylate. These can be used alone or in combination.

In addition, the radical polymeric monomer having three functional groups without having a charge transport structure for use in the present invention preferably has a ratio (molecular weight/the number of functional groups) of the molecular weight to the number of functional groups in the monomer is not greater than 250 to form a dense cross linking in the cross linking type protective layer 41. Further, when the ratio (molecular weight/the number of functional groups) is too large, the cross linking type protective layer 41 formed of such a monomer is soft and the anti-abrasion property thereof tends to deteriorate in some degree. Therefore, among the monomers mentioned above, it is not preferred to singly use a monomer having an extremely long modified (EO, PO, caprolactone modified) group. In addition, the content ratio of the radical polymeric monomer having three functional groups without having a charge transport structure is from 20 to 80% by weight and preferably from 30 to 70% by weight based on the total weight of the cross linking type protective layer 41 having a charge transport structure. When the monomer content ratio is too small, the density of three-dimensional cross linking in the cross linking type protective layer 41 tends to be small. Therefore, the anti-abrasion property thereof is not drastically improved in comparison with the case in which a typical thermal plastic binder resin is used. When the monomer content ratio is too large, the content of a charge transport compound decreases, which may cause the deterioration of the electric characteristics. Desired electric characteristics and anti-abrasion property vary depending on the process and the layer thickness of the cross linking type protective layer 41 for use in the present invention varies. Therefore, it is difficult to jump to any conclusion but considering the balance, the range of from 30 to 70% by weight is preferred.

The radical polymeric compound having a functional group and a charge transport structure for use in the cross linking type protective layer 41 represents a compound having a radical polymeric functional group and a positive hole structure, for example, triaryl amine, hydrazone, pyrazoline, and carbazole, or an electron transport structure, for example, condensed polycyclic quinone, diphenoquinone and electron absorbing aromatic ring having cyano group, a nitro group, etc. As the radical polymeric functional group, the radical polymeric functional group mentioned in the radical polymeric monomer mentioned above can be suitably used. Especially, acryloyloxy group and methacryloyloxy group are suitable. In addition, a triaryl amine structure is highly effective as the charge transport structure. Among these, when a compound having the structure represented by the following chemical structures 3 and 4 is used, the electric characteristics, for example, the sensitivity and the residual voltage, are preferably maintained.

[Chemical Structure 3]

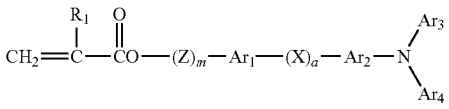

[Chemical Structure 4]

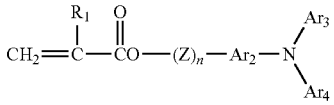

wherein, $R_1$ represents hydrogen atom, a halogen atom, an alkyl group, an aralky group, an aryl group, a cyano group, a nitro group, an alkoxy group, —$COOR_7$, wherein $R_7$ represents hydrogen atom, a substituted or non-substituted alkyl group, a substituted or non-substituted aralkyl group or a substituted or non-substituted aryl group, a halogenated carbonyl group or $CONR_8R_9$, wherein $R_8$ and $R_9$ independently represent hydrogen atom, a halogen atom, a substituted or non-substituted alkyl group, a substituted or non-substituted aralkyl group or a substituted or non-substituted aryl group, $Ar_1$ and $Ar_2$ independently represent a substituted or unsubstituted arylene group, $Ar_3$ and $Ar_4$ independently represent a substituted or unsubstituted aryl group, X represents a single bond, a substituted or non-substituted alkylene group, a substituted or non-substituted cycloalkylene group, a substituted or non-substituted alkylene ether group, oxygen atom, sulfur atom or a vinylene group, Z represents a substituted or non-substituted alkylene group, a substituted or non-substituted alkylene ether divalent group or an alkyleneoxy carbonyl divalent group, and a represents 0 or 1, m and n represent an integer of from 0 to 3.

Specific examples of the structure represented by the chemical structures 3 and 4 are as follows.

In the chemical structures 3 and 4, the alkyl group of $R_1$ is, for example, methyl group, ethyl group, propyl group, and butyl group. The aryl group thereof is, for example, phenyl group and naphtyl group. The aralkyl group thereof is, for example, benzyl group, phenethyl group, and naphtyl methyl group. The alkoxy group thereof is, for example, methoxy group, ethoxy group and propoxy group. These can be substituted by a halogen atom, nitro group, cyano group, an alkyl group, for example, methyl group and ethyl group, an alkoxy group, for example, methoxy group and ethoxy group, an aryloxy group, for example, phenoxy group, an aryl group, for example, phenyl group and naphtyl group, and an aralkyl group, for example, benzyl group and phenethyl group.

Among these substitution groups of $R_1$, hydrogen atom and methyl group are especially preferred.

$Ar_3$ and $Ar_4$ represent a substituted or non-substituted aryl group. Specific examples thereof include condensed polycyclic hydrocarbon groups, non-condensed ring hydrocarbon groups and heterocyclic groups.

The condensed polycyclic hydrocarbon group preferably forms a ring by 18 or less carbon atoms. Specific examples thereof include pentanyl group, indenyl group, naphtyl group, azulenyl group, heptalenyl group, biphenylenyl group, as-indacenyl group, s-indacenyl group, fluorenyl group, acenaphthylenyl group, pleiadenyl group, acenaphthenyl group, phenalenyl group, phenanthryl group, anthryl group, fluorantenyl group, acephenantrirenyl group, aceantrirenyl group, triphenyl group, pyrenyl group, chrysenyl group, and naphthacenyl group.

Specific examples of the non-condensed ring hydrocarbon group include a single-valent group of monocyclic hydrocarbon compounds, for example, benzene, diphenyl ether, polyethylene diphenyl ether, diphenylthio ether and diphenylsulfone, a single-valent group of non-condensed polycyclic hydrocarbon compounds, for example, biphenyl, polyphenyl, diphenyl alkane, diphenyl alkene, diphenyl alkyne, triphenyl methane, distyryl benzene, 1,1-diphenyl cycloalkane, polyphenyl alkane and polyphenyl alkene or a single-valent group of ring aggregated hydrocarbon compounds, for example, 9,9-diphenyl fluorene.

Specific examples of the heterocyclic group include a single-valent group of, for example, carbazol, dibenzofuran, dibenzothiophene, oxadiazole, and thiadiazole.

The substituted or non-substituted aryl groups represented by $Ar_3$ and $Ar_4$ can have the following substitution groups.

(1) a halogen atom, cyano group, and nitro group;

(2) a straight chained or branch chained alkyl group having 1 to 12 carbon atoms, preferably 1 to 8 carbon atoms and more preferably 1 to 4 carbon atoms. These alkyl groups can have fluorine atom, hydroxyl group, cyano group, an alkoxy group having 1 to 4 carbon atoms, phenyl group or a phenyl group substituted by a halogen atom, an alkyl group having 1 to 4 carbon atoms or an alkoxy group having 1 to 4 carbon atoms. Specific examples thereof include methyl group, ethyl group, n-butyl group, i-propyl group, t-butyl group, s-butyl group, n-propyl group, trifluoromethyl group, 2-hydroxy ethyl group, 2-ethoxyethyl group, 2-cyanoethyl group, 2-methoxyethyl group, benzyl group, 4-chlorobenzyl group, 4-methyl benzyl group and 4-phenyl benzyl group;

(3) an alkoxy group (—$OR_2$), wherein $R_2$ represents the alkyl group defined in (2). Specific examples thereof include methoxy group, ethoxy group, n-propoxy group, i-propoxy group, t-butoxy group, n-butoxy group, s-butoxy group, i-butoxy group, 2-hydroxy ethoxy group, benzyl oxy group and trifluoromethoxy group;

(4) an aryloxy group: As an aryl group, for example, phenyl group and naphtyl group can be included. These can contain an alkoxy group having 1 to 4 carbon atoms, an alkyl group having 1 to 4 carbon atoms or a halogen atom as a substitution group. Specific examples thereof include phenoxy group, 1-naphtyloxy group, 2-naphtyloxy group, 4-methoxyphenoxy group, and 4-methylphenoxy group;

(5) an alkyl mercapto group or an aryl mercapto group: Specific examples thereof include methylthio group, ethylthio group, phenylthio group, and p-methylphenylthio group;

(6) Chemical Structure 6

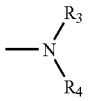

In the chemical structure, $R_3$ and $R_4$ independently represent hydrogen atom, the alkyl group defined in (2), or an aryl group. Specific examples of the aryl group include phenyl group, biphenyl group, or naphtyl group. These can contain an alkoxy group having 1 to 4 carbon atoms, an alkyl group having 1 to 4 carbon atoms or a halogen group. $R_3$ and $R_4$ can form a ring together. Specific examples thereof include amino group, diethyl amino group, N-methyl-N-phenyl amino group, N,N-diphenyl amino group, N,N-di(tolyl)amino group, dibenzyl amino group, piperidino group, morpholino group, and pyrrolidino group;

(7) an alkylene dioxy group or an alkylene dithio group, for example, methylene dioxy group and methylene dithio group; and (8) a substituted or non-substituted styryl group, a substituted or non-substituted β-phenyl styryl group, diphenyl aminophenyl group, ditolyl aminophenyl group, etc.

The Arylene Group Represented by $Ar_1$ and $Ar_2$ are Divalent Groups Derived from the Aryl Group Represented by $Ar_3$ and $Ar_4$.

X represents a substituted or non-substituted alkylene group, a substituted or non-substituted cycloalkylene group, a substituted or non-substituted alkylene ether group, oxygen atom, sulfur atom or vinylene group.

Specific examples of the substituted or non-substituted alkylene group include a straight chained or branch chained alkylene group having 1 to 12 carbon atoms, preferably 1 to 8 carbon atoms and more preferably from 1 to 4 carbon atoms. These alkylene groups can further have fluorine atom, hydroxyl group, cyano group, an alkoxy group having 1 to 4 carbon atoms, phenyl group or a phenyl group substituted by a halogen atom, an alkyl group having 1 to 4 carbon atoms or an alkoxy group having 1 to 4 carbon atoms. Specific examples thereof include methylene group, ethylene group, n-butylene group, i-propylene group, t-butylene group, s-butylene group, n-propylene group, trifluoromethylene group, 2-hydroxy ethylene group, 2-ethoxyethylene group, 2-cyanoethylene group, 2-methoxyethylene group, benzylidene group, phenyl ethylene group, 4-chlorophenyl ethylene group, 4-methylphenyl ethylene group, and 4-biphenyl ethylene group.

Specific examples of the substituted or non-substituted cycloalkylene groups include cyclic alkylene group having 5 to 7 carbon atoms. These cyclic alkylene groups can have fluorin atom, a hydroxyl group, an alkyl group having 1 to 4 carbon atoms, and an alkoxy group having 1 to 4 carbon atoms. Specific examples thereof include cyclohexylidene group, cyclohexylene group, and 3,3-dimethyl cyclohexylidene group.

Specific examples of the substituted or non-substituted alkylene ether group include ethyleneoxy group, propyleneoxy group, ethylene glycol, propylene glycol, diethylene glycol, tetraethylene glycol, tripropylene glycol, etc. Alkylene groups of the alkylene ether groups can have a substitution group, for example, hydroxyl group, methyl group, and ethyl group.

The vinylene groups represented by X are, for example, substitution groups represented by the following chemical structures 7 and 8:

[Chemical Structure 7]

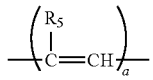

[Chemical Structure 8]

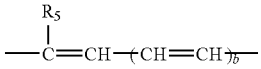

In the chemical structures, $R_5$ independently represent hydrogen atom, an alkyl group (the same as the alkyl groups defined in (2)), an aryl group (the same as the aryl groups of $Ar_3$ and $Ar_4$ mentioned above), a represents 1 or 2 and b represents an integer of from 1 to 3.

Z represents a substituted or non-substituted alkylene group, a substituted or non-substituted divalent alkylene ether group or a divalent alkyleneoxy carbonyl group.

Specific examples of the substituted or non-substituted alkylene group include the same as the alkylene group described for X.

Specific examples of the substituted or non-substituted divalent alkylene ether group include the same as the alkylene ether group described for X.

A specific example of the divalent alkyleneoxy carbonyl group includes a divalent caprolactone modified group.

In the present invention, the radical polymeric compound having a functional group with a charge transport structure is more preferably the compound represented by the following chemical structure (3).

[Chemical Structure 5]

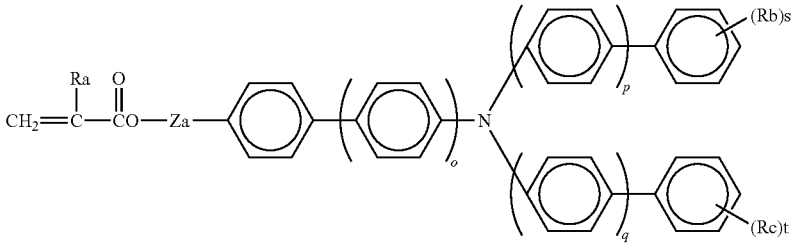

In the chemical structure (???), d, r, p, q independently represent 0 or 1. s and t independently represent an integer of from 0 to 3. Ra represents hydrogen atom or methyl group. Each of Rb and Rc independently represent an alkyl group having 1 to 6 carbon atoms. Za represents methylene group, ethylene group, —$CH_2CH_2O$—, —$CHCH_3CH_2O$—, or —$C_6H_5CH_2CH_2$—.

Among the compounds represented by Chemical structure illustrated above, the compounds having a methyl group or an ethyl group as a substitution group of each of Rb and Rc are preferred.

The radical polymeric compound for use in the present invention having a functional group with a charge transport structure represented by the chemical structures (1), (2) and especially (3) is polymerized in such a manner that the double linkage of C and C is open to both ends. Therefore, the radical polymeric compound is not present at the end but in the chained polymer. In a polymer in which a cross linking chain is formed with a radical polymeric monomer having at least 3 functional groups, the radical polymeric compound is present in the main chains of the polymer and in a cross linking chain. There are two kinds of cross linking chains. One is referred to as inter-molecule cross linking, in which the cross linking chain is formed between a polymer and another polymer. The other is referred to as internal cross linking, in which the cross linking chain is formed between a portion in the main chain present in a polymer formed in a folded state and another portion deriving from the monomer which is polymerized at a position remote from that portion in the main chain. Whether the radical polymeric monomer having at least 3 functional groups is present in a main chain or in a cross linking chain, the triaryl amine structure suspending from the chain portion has at least three aryl groups disposed in the radial directions from the nitrogen atom therein. Such a triaryl amine structure is bulky and does not directly bind with the chain portion but suspends from the chain portion via a carbonyl group, etc. That is, the triaryl amine structure is stereoscopically fixed in the polymer in a flexible state. Therefore, these triaryl amine structures can be adjacent to each other with a moderate space in a polymer. Therefore, the structural distortion in a molecule is slight. In addition, when the structure is used in the surface layer of an image bearing member, it can be deduced that the internal molecular structure can have a structure in which there are relatively few disconnections in the charge transport route.

Below are specific examples of the radical polymeric compound for use in the present invention having a functional group with a charge transport structure. But the radical polymeric compounds are not limited thereto.

No. 1

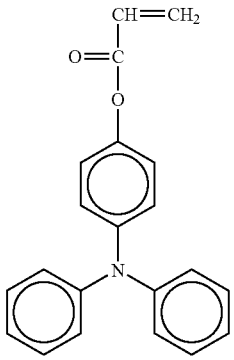

-continued

No. 2

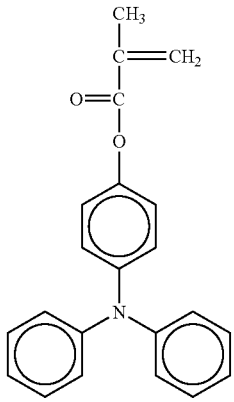

No. 3

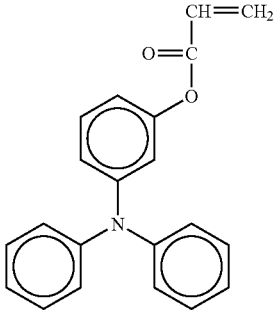

No. 4

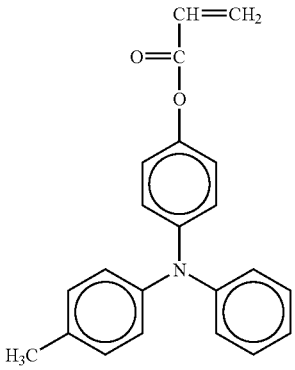

No. 5

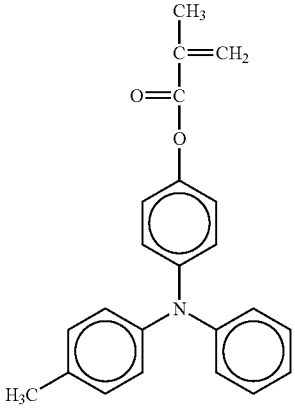

-continued
No. 6
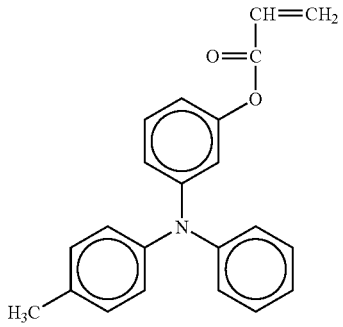
No. 7
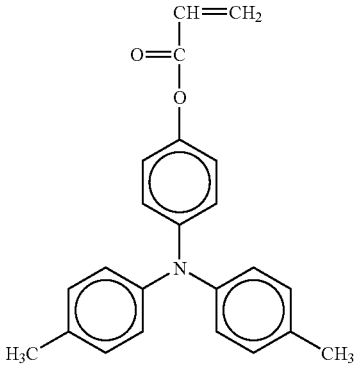
No. 8
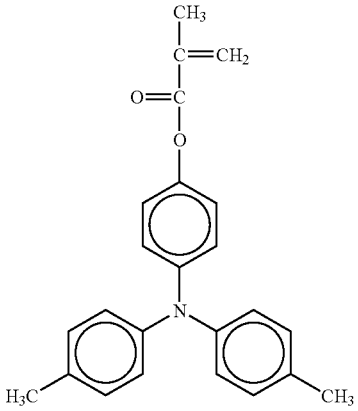
No. 9
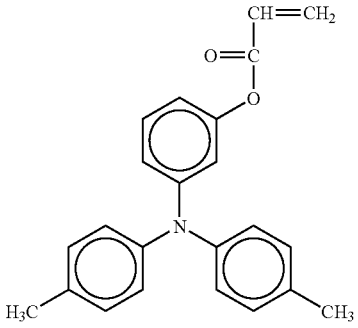
-continued
No. 10
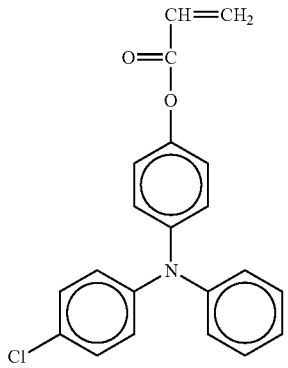
No. 11
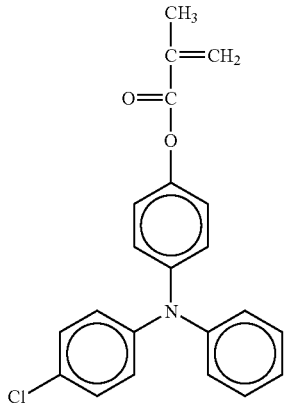
No. 12
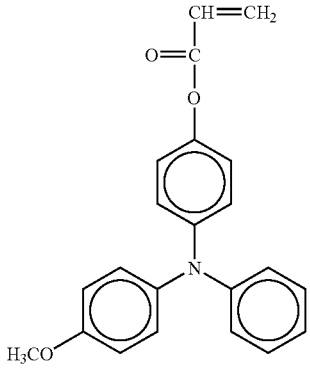
No. 13
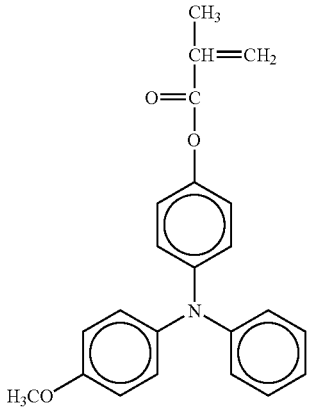

-continued
No. 14
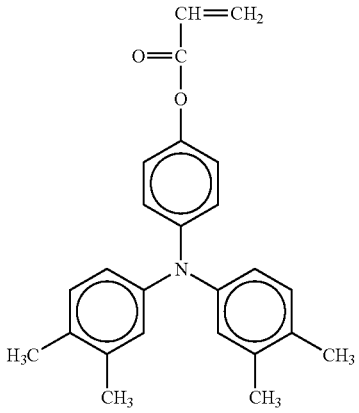
No. 15
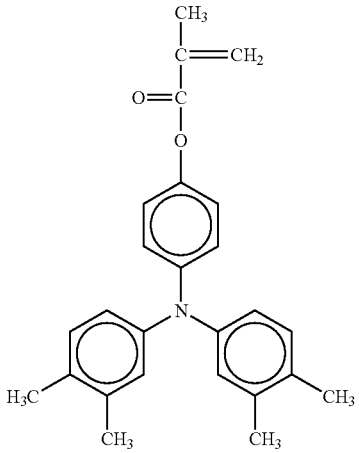
No. 16
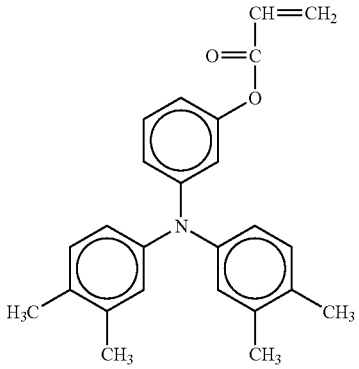
No. 17
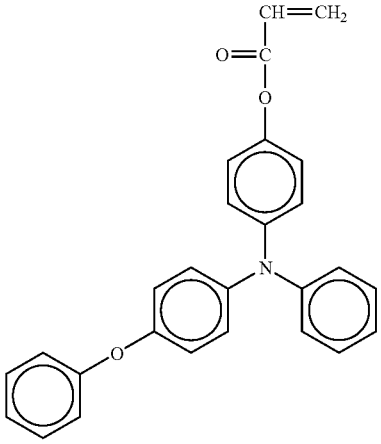
-continued
No. 18
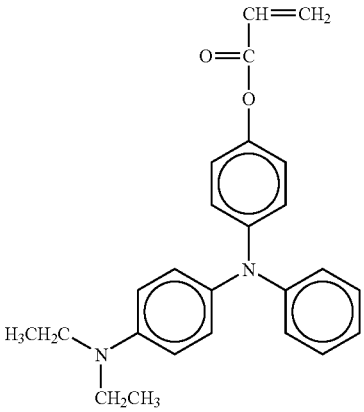
No. 19
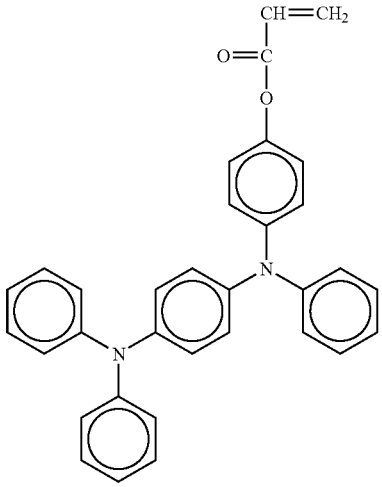
No. 20
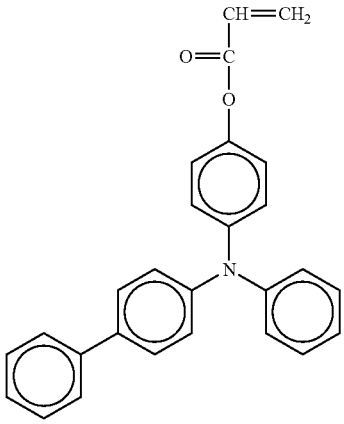

-continued
No. 21
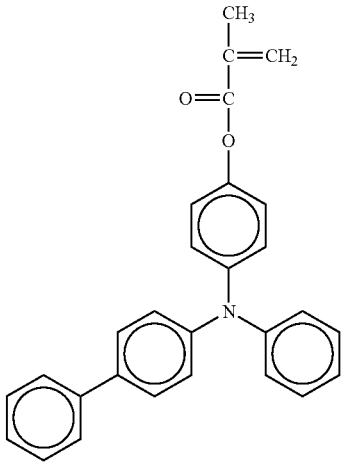
No. 22
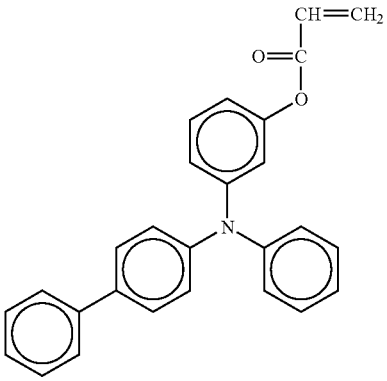
No.23
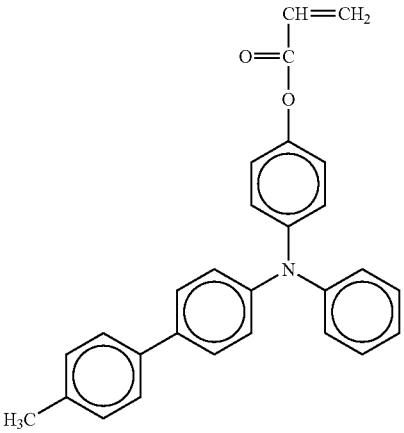
-continued
No. 24
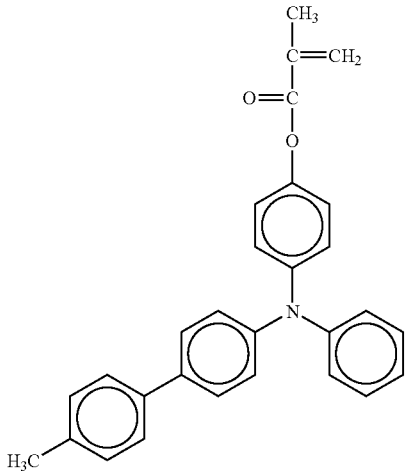
No. 25
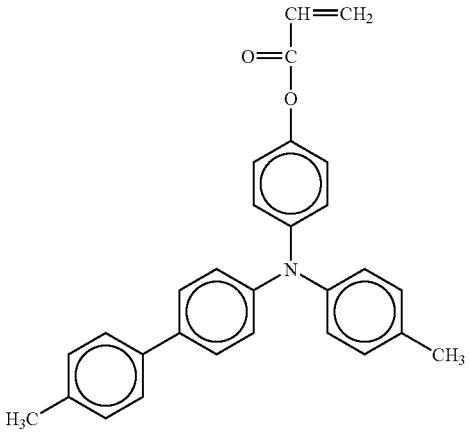
No. 26
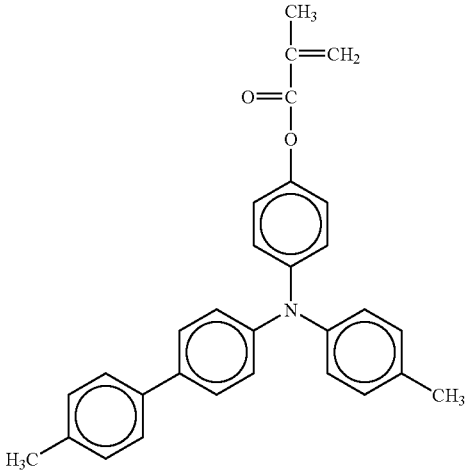

-continued
No. 27
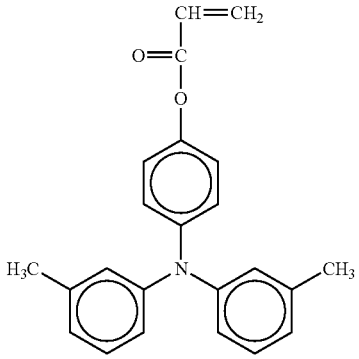
No. 28
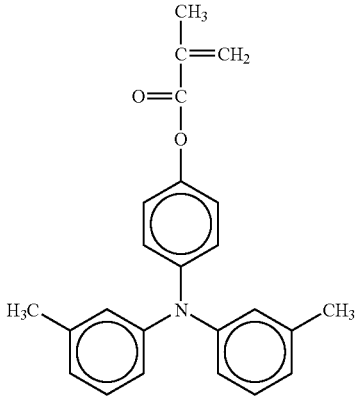
No. 29
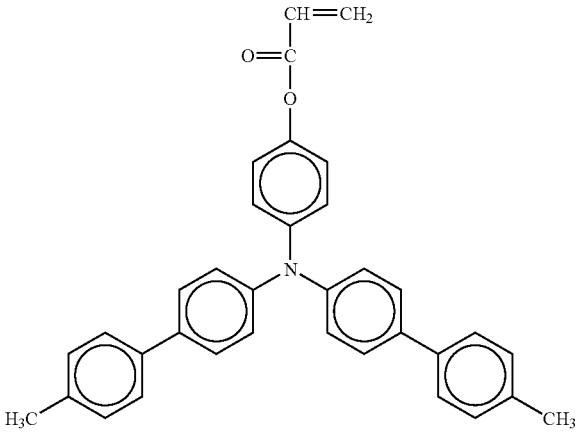
-continued
No. 30
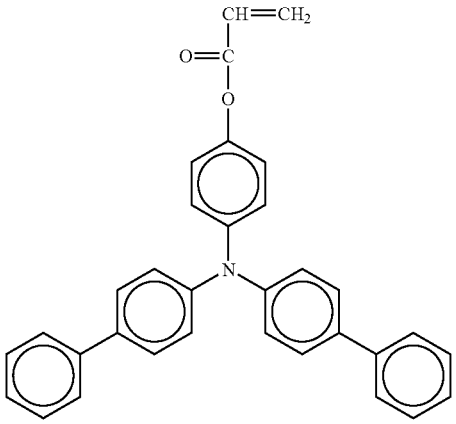
No.31
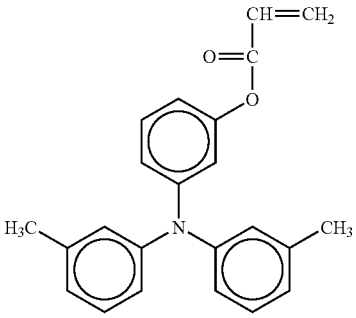
No. 32
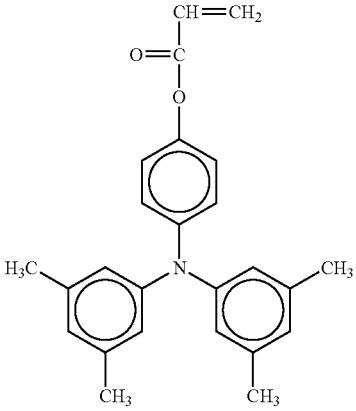
No. 33
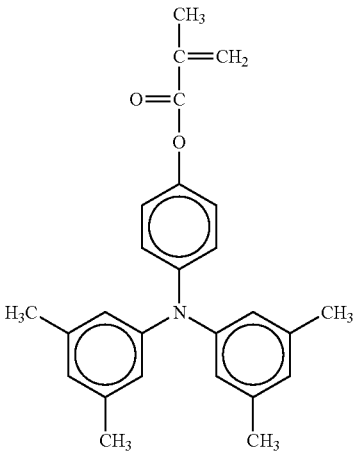

-continued
No. 34
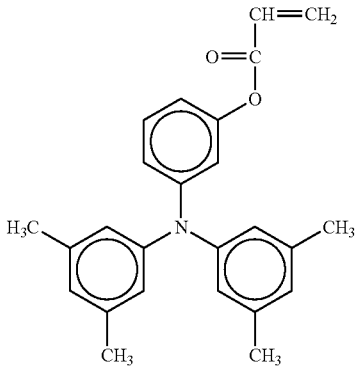
No. 35
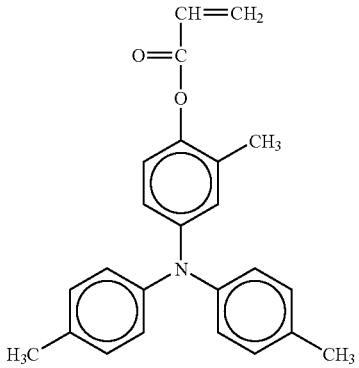
No. 36
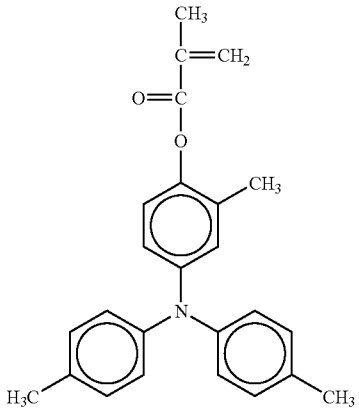
No. 37
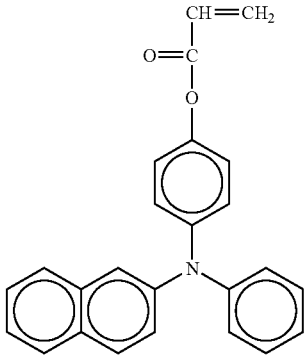
-continued
No. 38
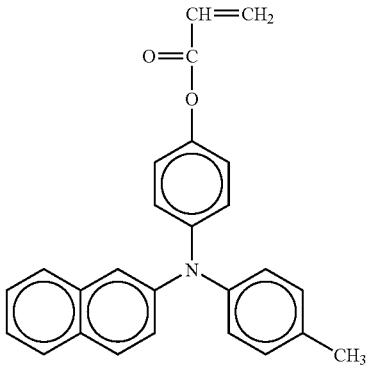
No. 39
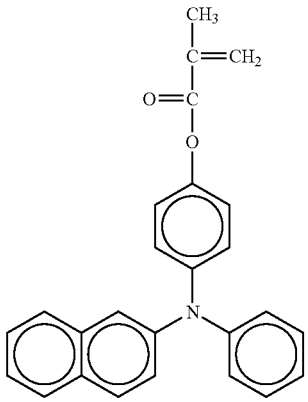
No. 40
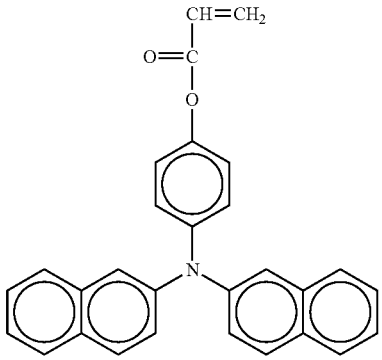
No. 41
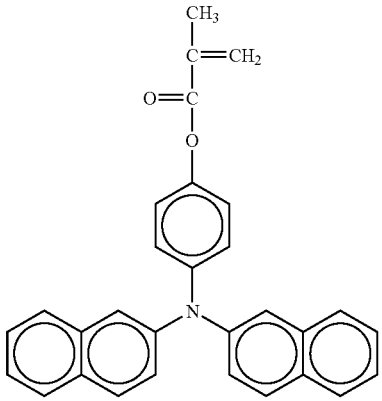

-continued
No. 42
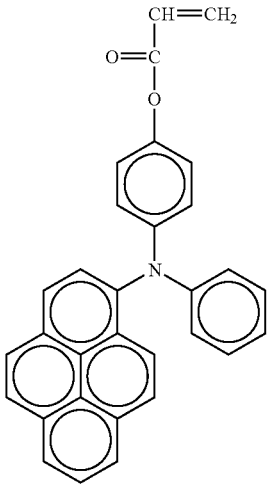
No. 43
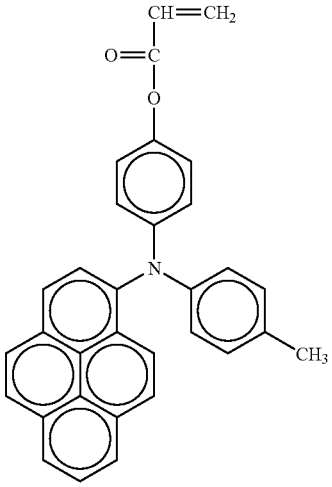
No. 44
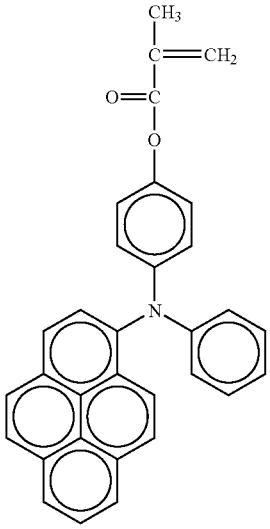
-continued
No. 45
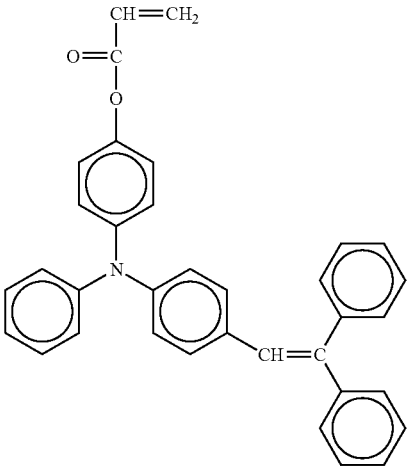
No. 46
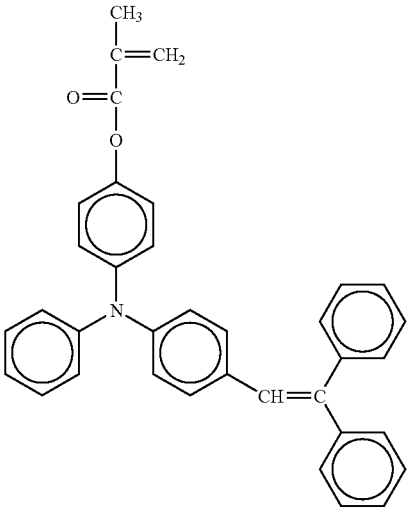
No. 47
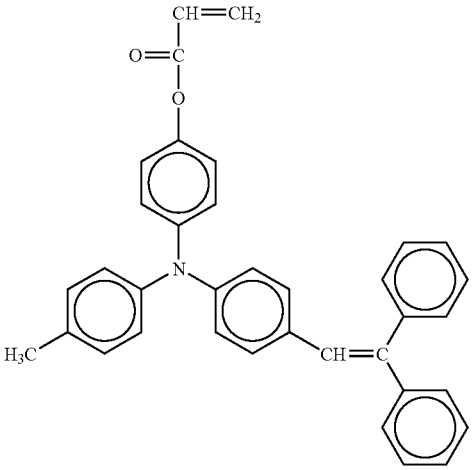

-continued
No. 48
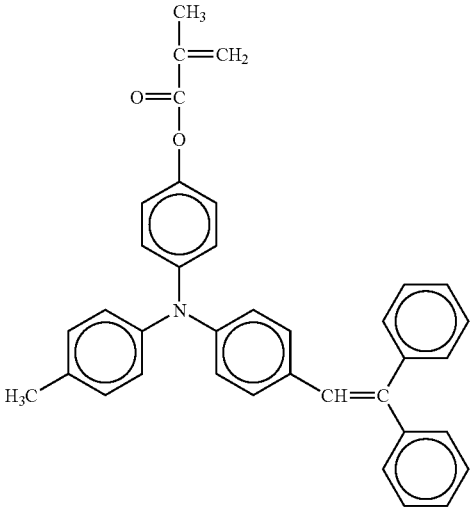
No. 49
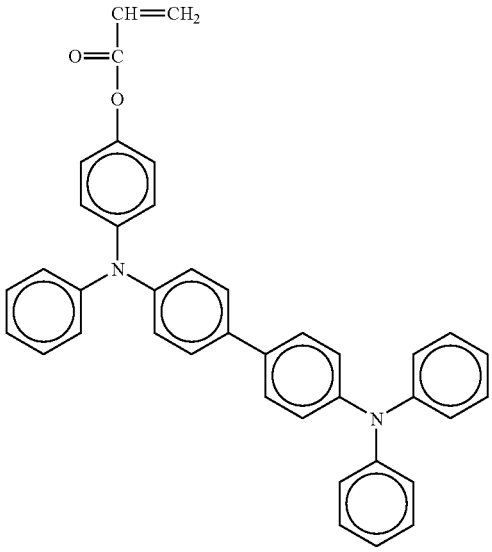
No. 50
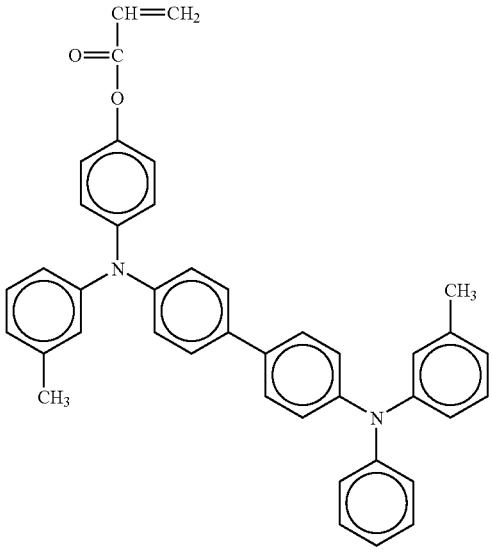
-continued
No. 51
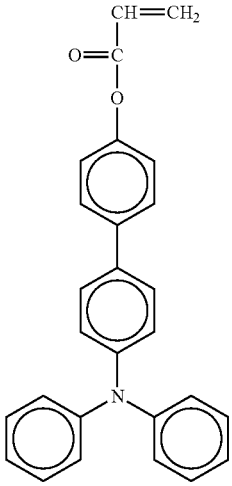
No. 52
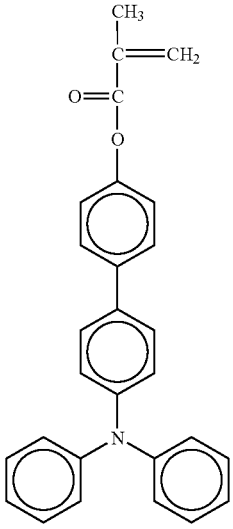
No. 53
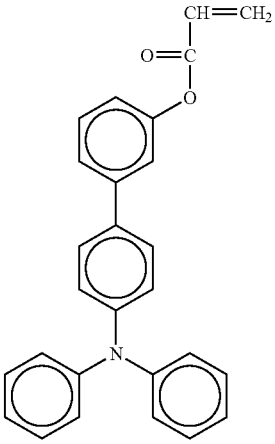

-continued
No. 54
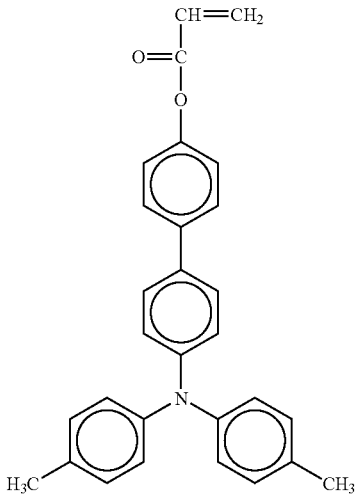
No. 55
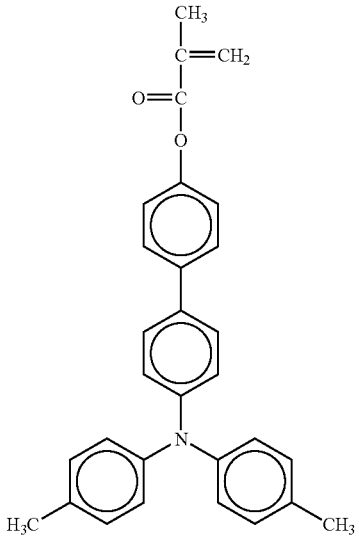
No. 56
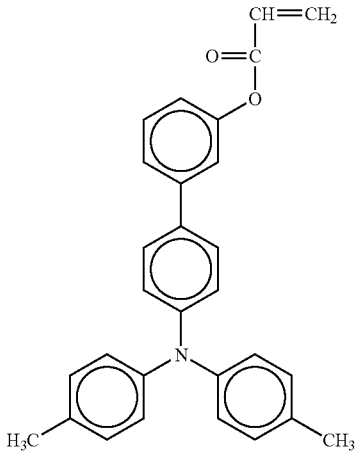
-continued
No. 57
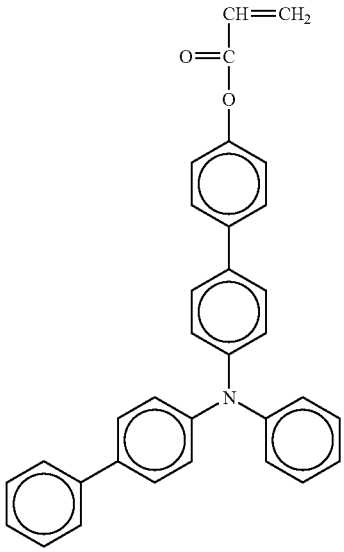
No. 58
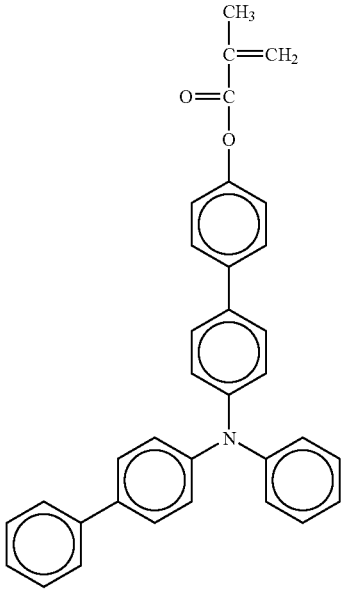

-continued
No. 59
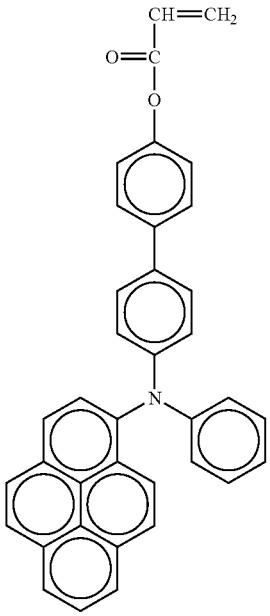
No. 60
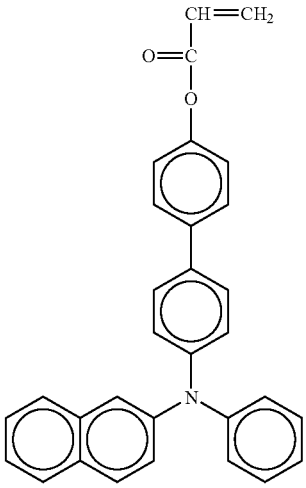
No. 61
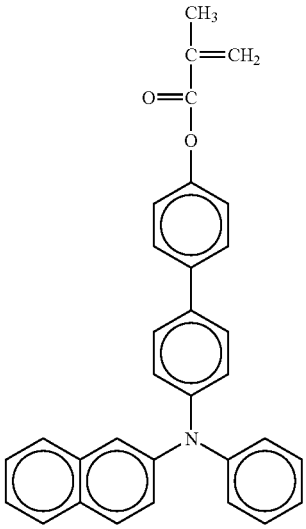
-continued
No. 62
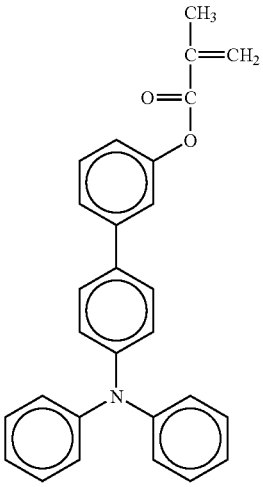
No. 63
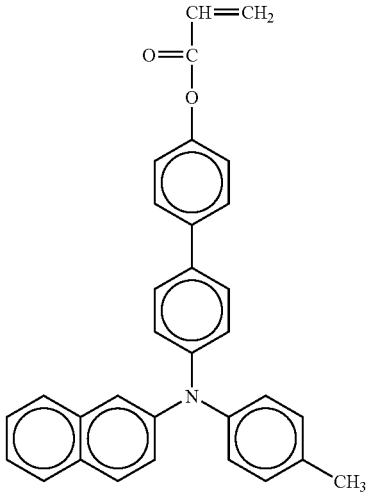
No. 64
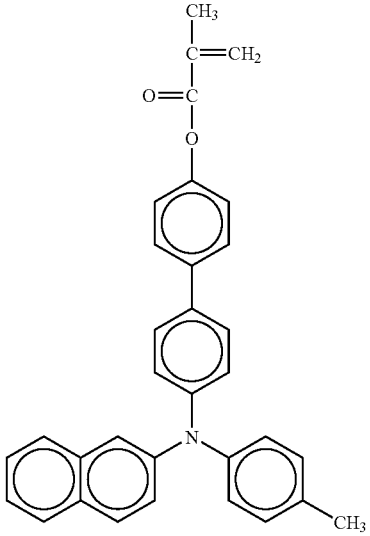

-continued
No. 65
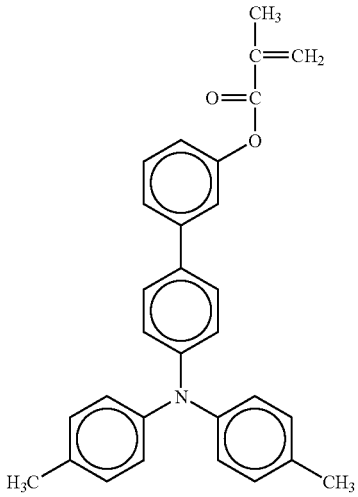
No. 66
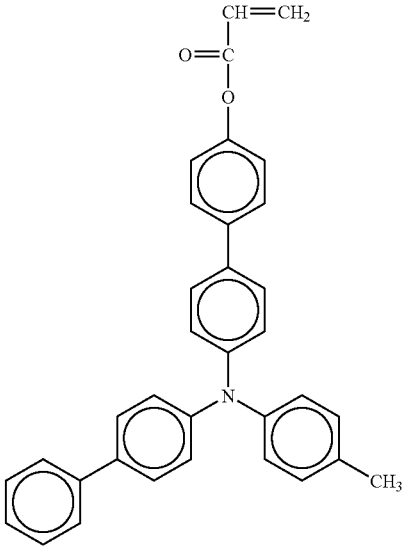
No. 67
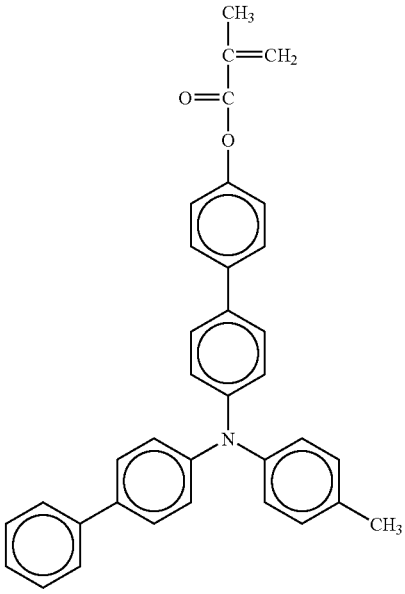
-continued
No. 68
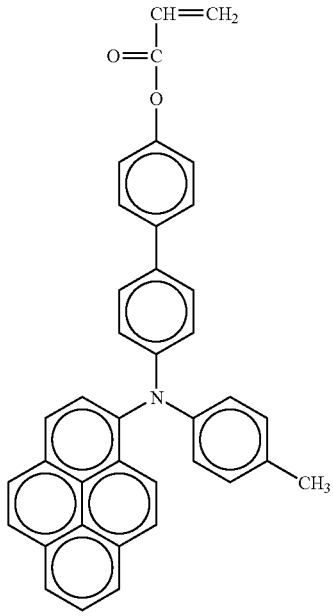
No. 69
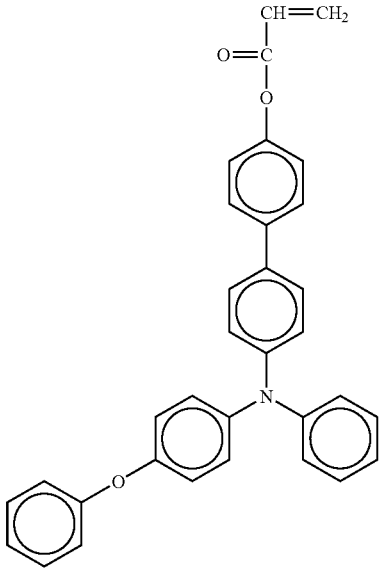

-continued
No. 70
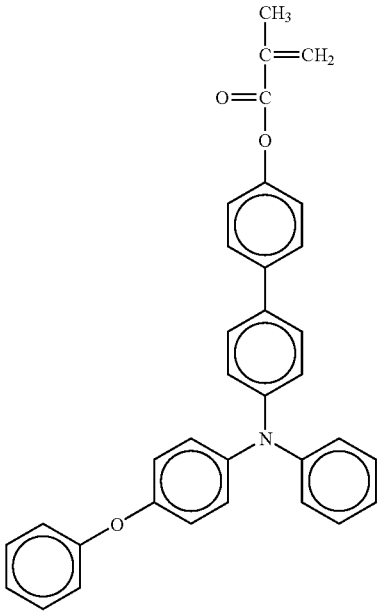
No. 71
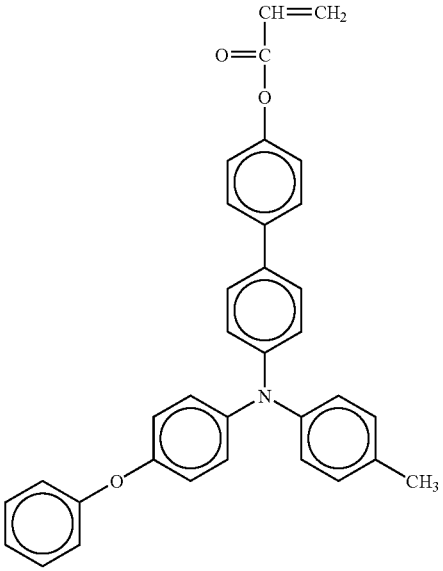
No. 72
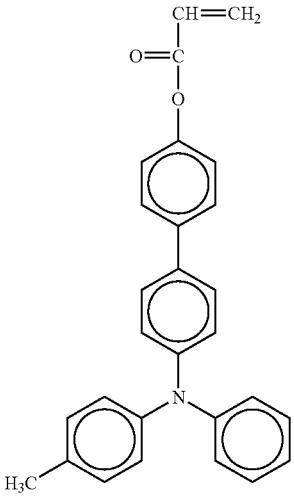
-continued
No. 73
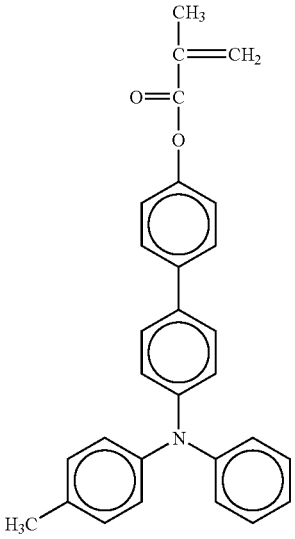
No. 74
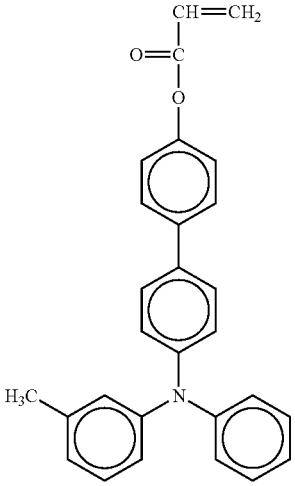
No. 75
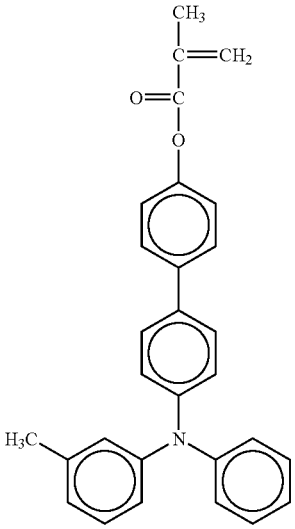

-continued
No. 76
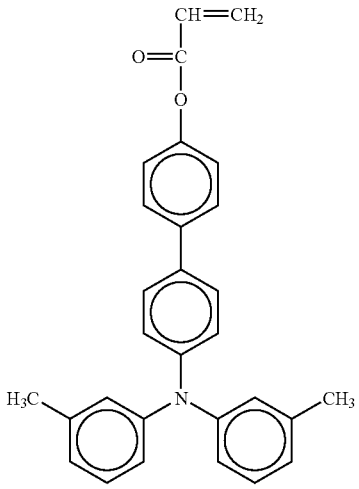
No. 77
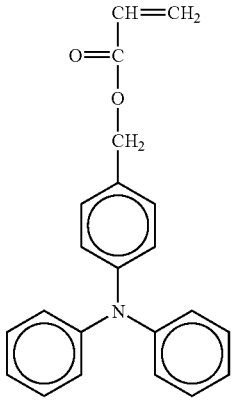
No. 78
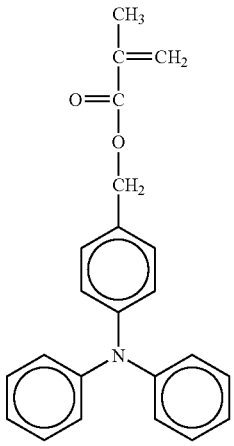
-continued
No. 79
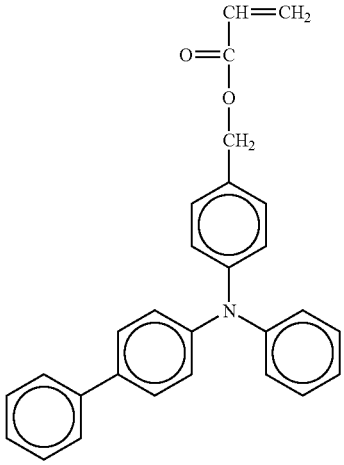
No. 80
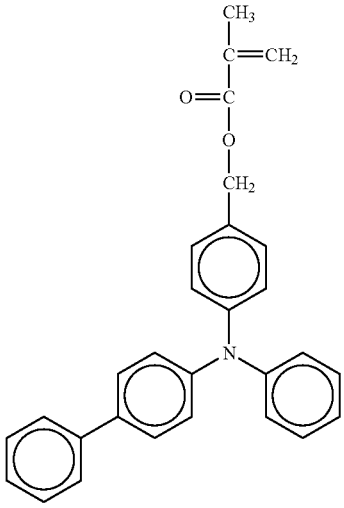
No. 81
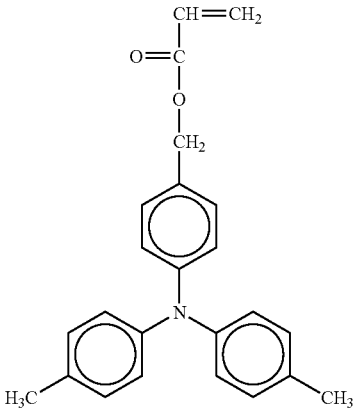

-continued
No. 82
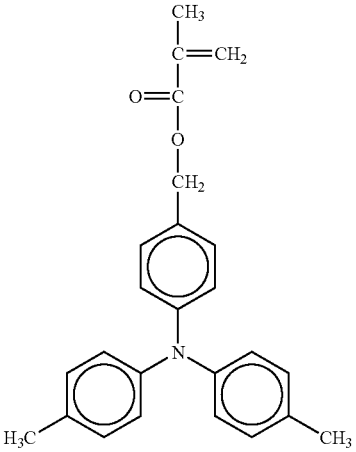
No. 83
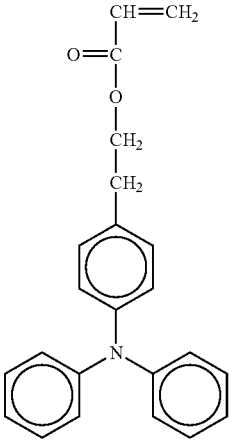
No. 84
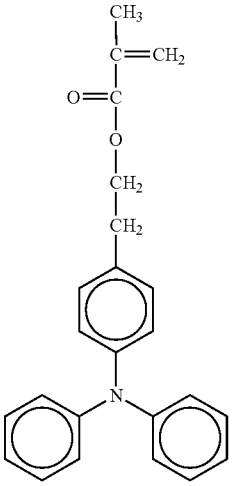
-continued
No. 85
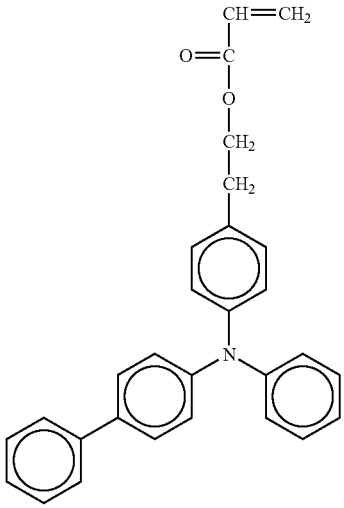
No. 86
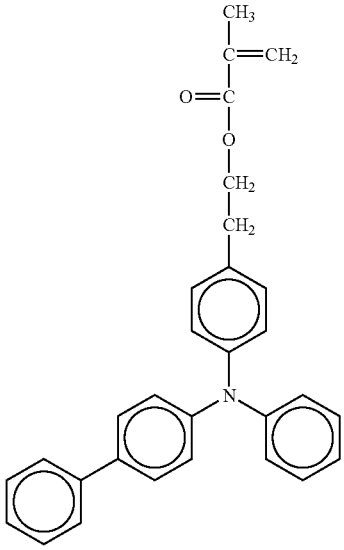
No. 87
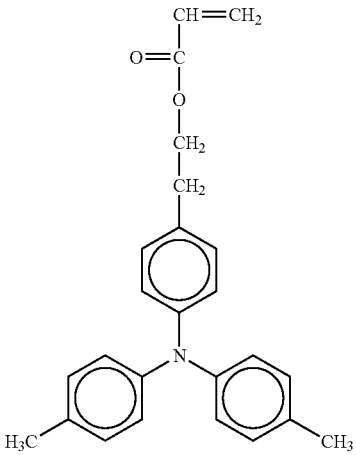

-continued
No. 88
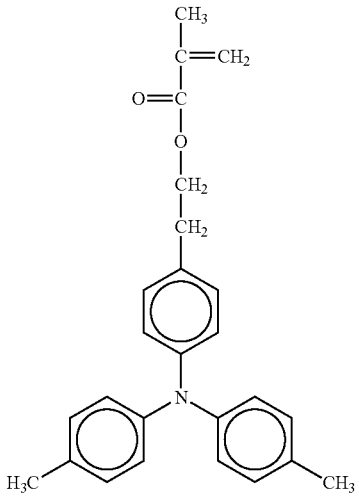
No. 89
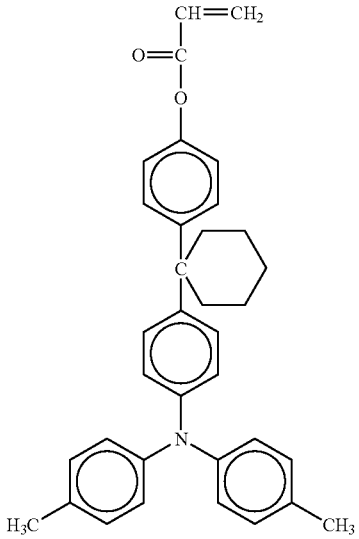
No. 90
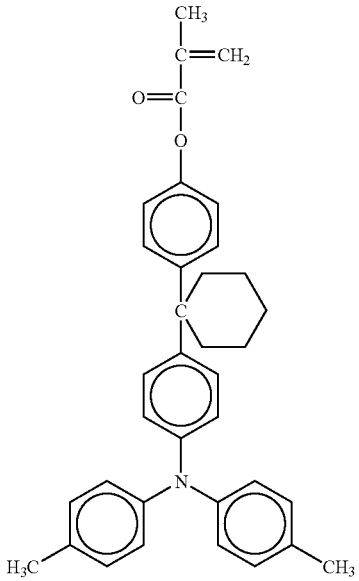
-continued
No. 91
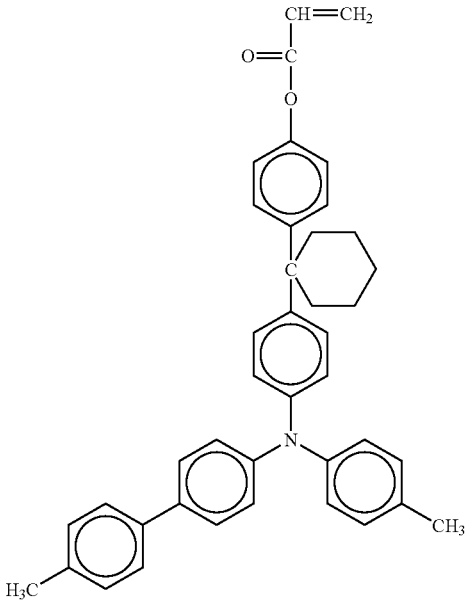
No. 92
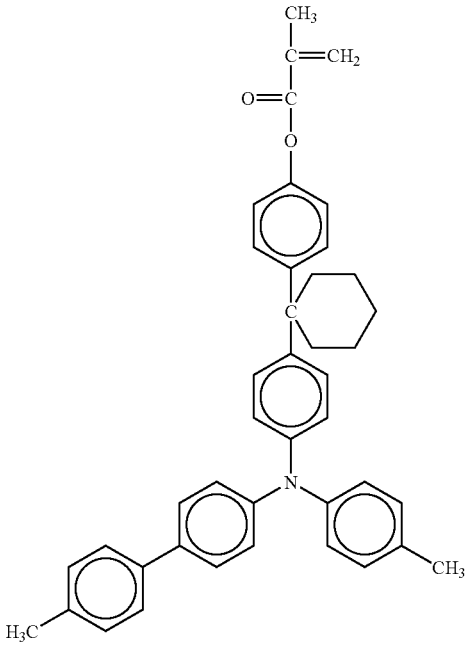

-continued
No. 93
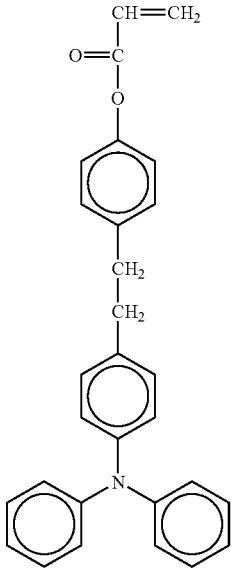
No. 94
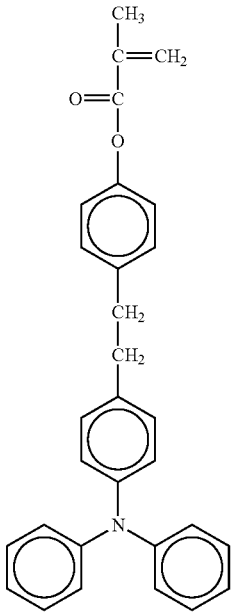
-continued
No. 95
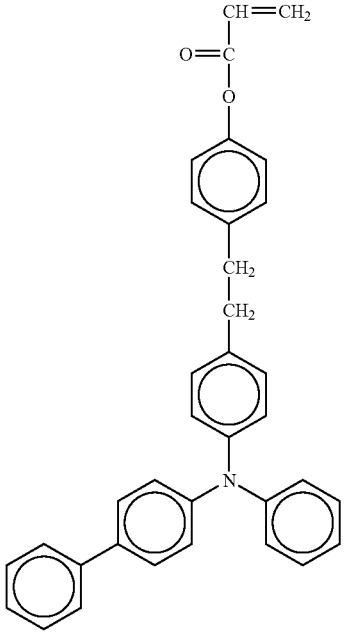
No. 96
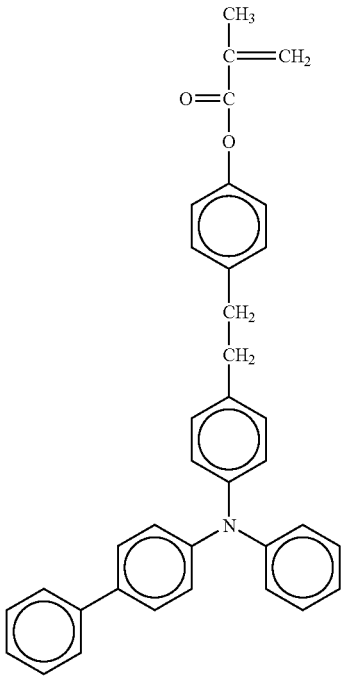

-continued
No. 97
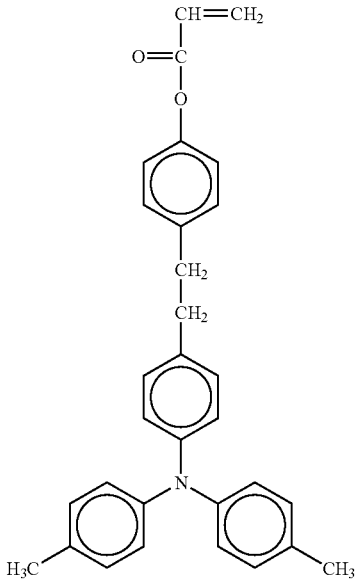
No. 98
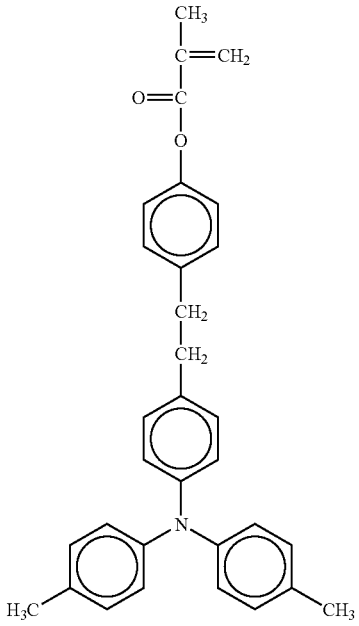
-continued
No. 99
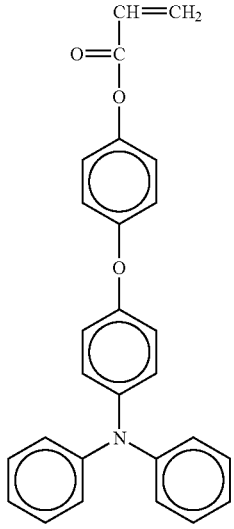
No. 100
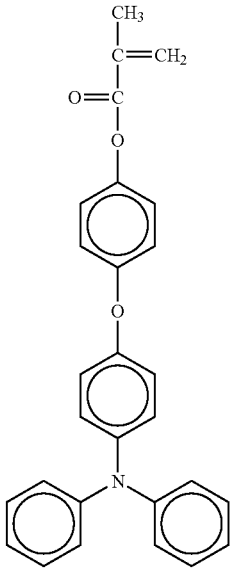

-continued
No. 101
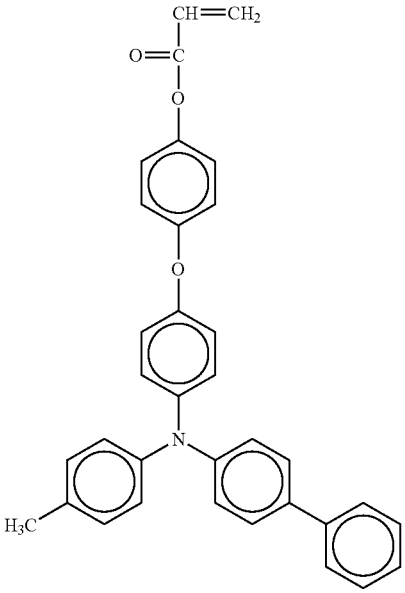
No. 102
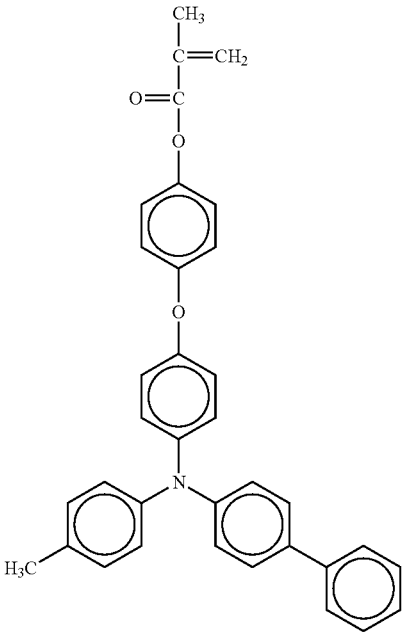
-continued
No. 103
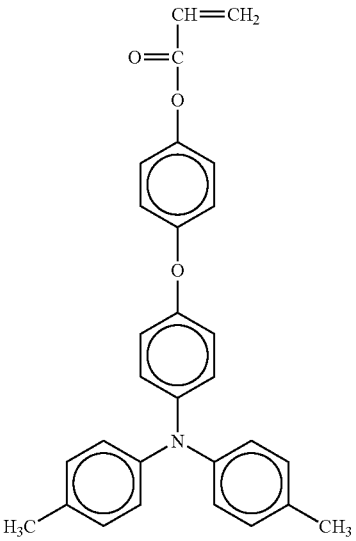
No. 104
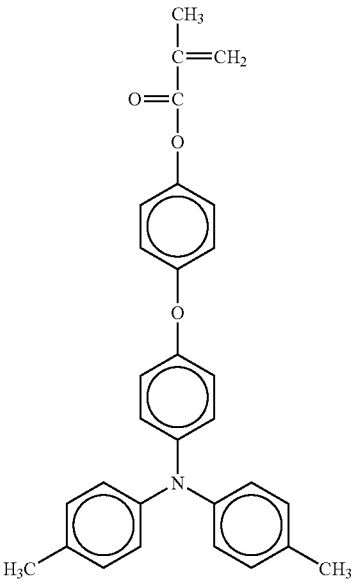

-continued
No. 105
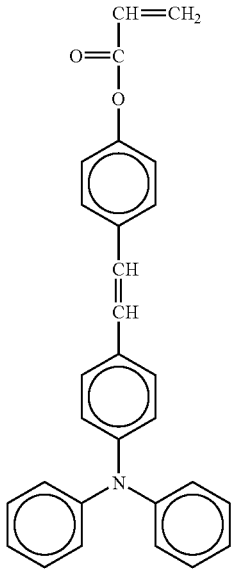
No. 106
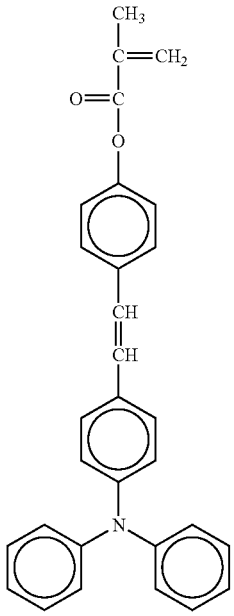
-continued
No. 107
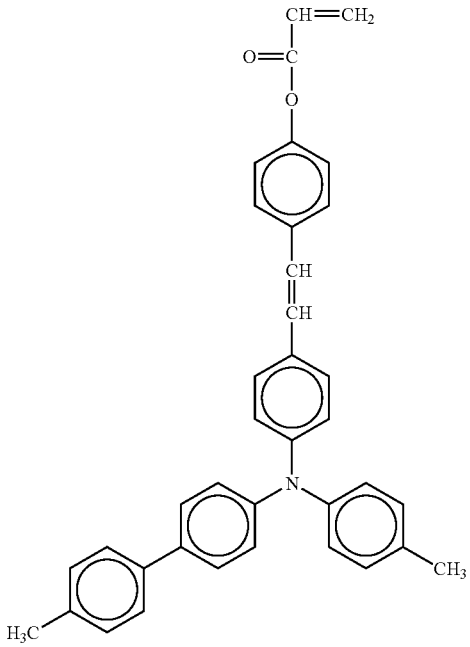
No. 108
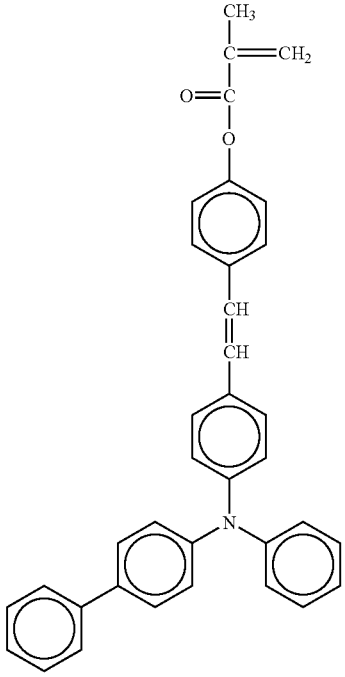

-continued
No. 109
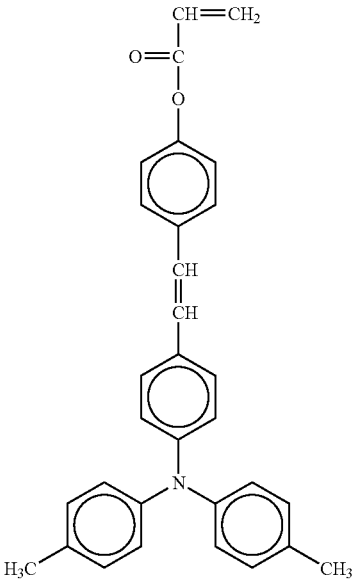
No. 110
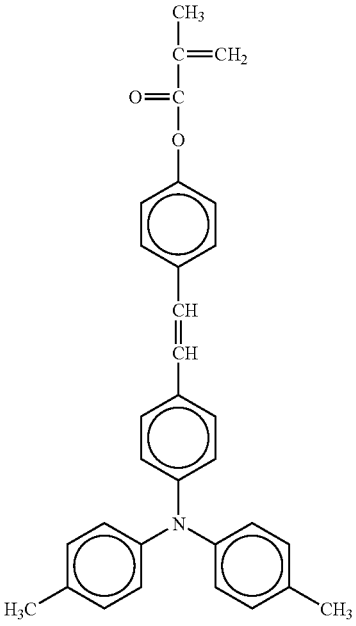
-continued
No. 111
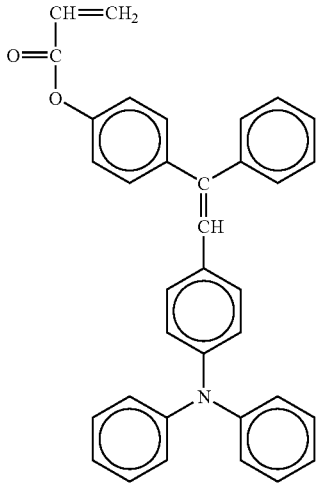
No. 112
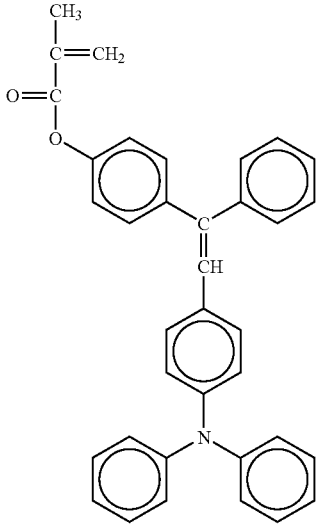
No. 113
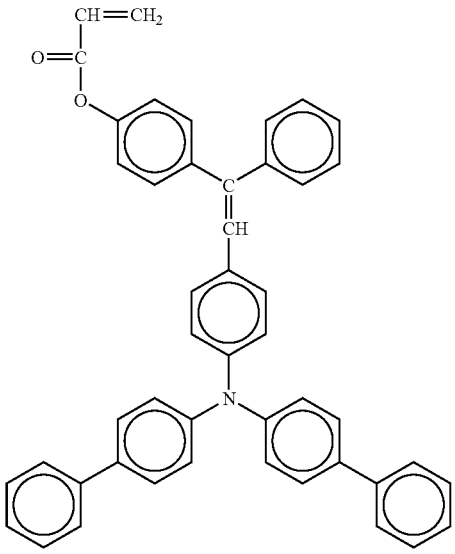

-continued
No. 114
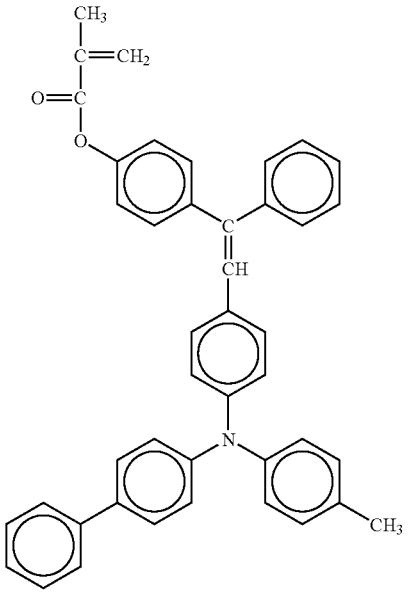
No. 115
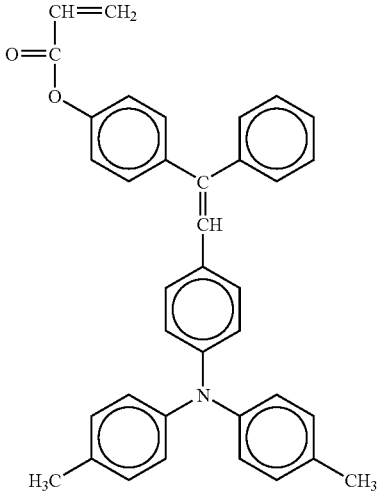
No. 116
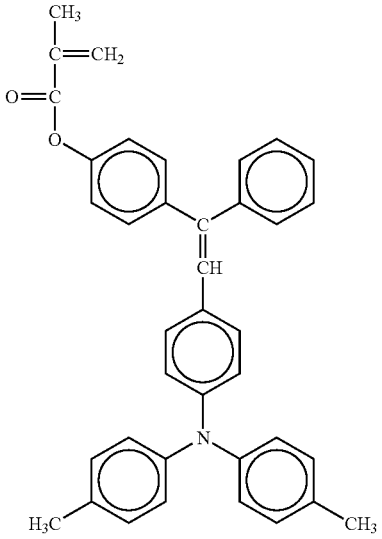
-continued
No.117
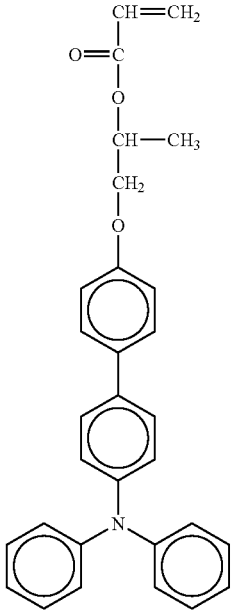
No. 118
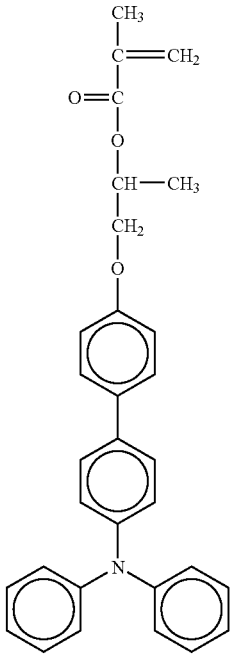

-continued
No. 119
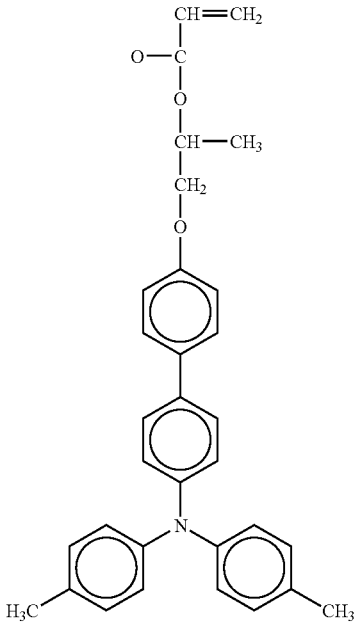
No. 120
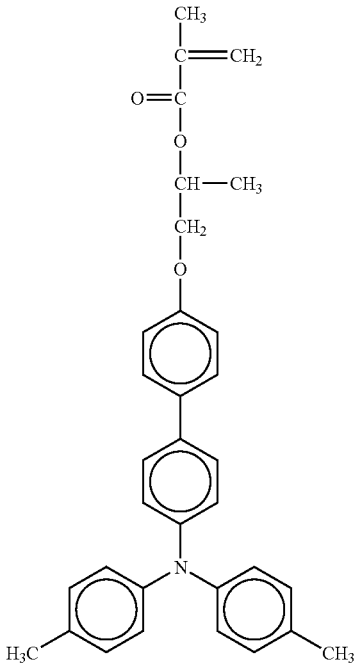
-continued
No. 121
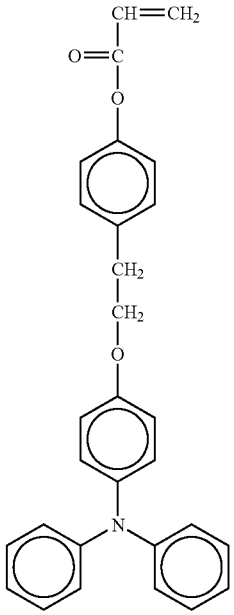
No. 122
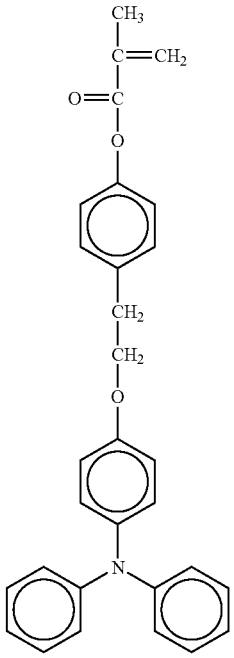

-continued
No. 123
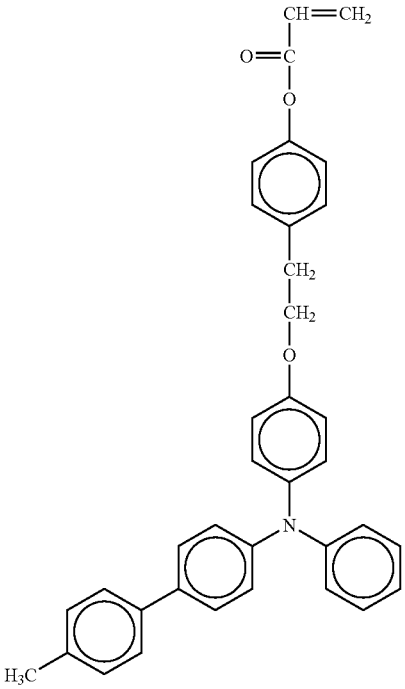
No. 124
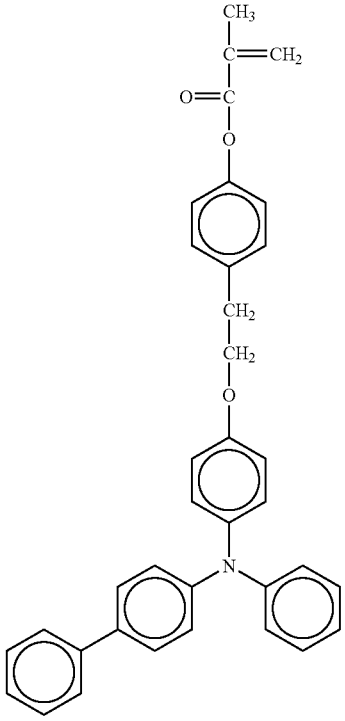
-continued
No. 125
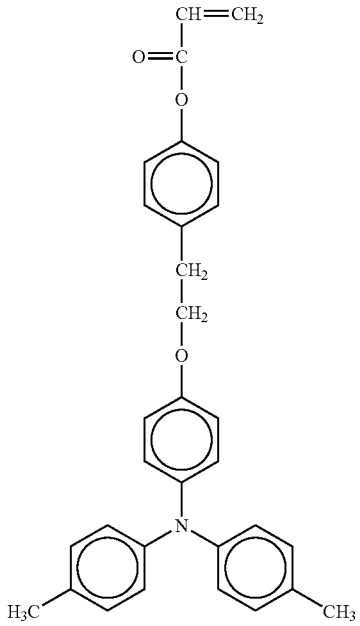
No. 126
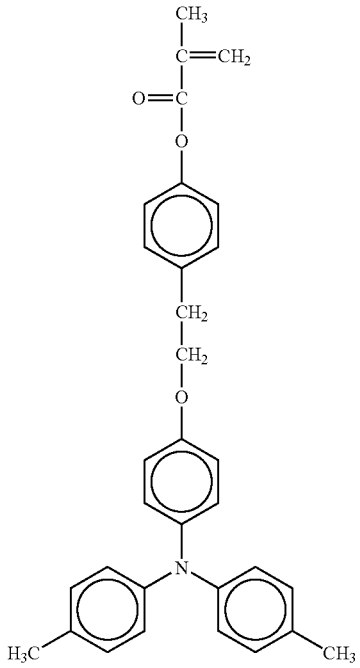

-continued
No. 127
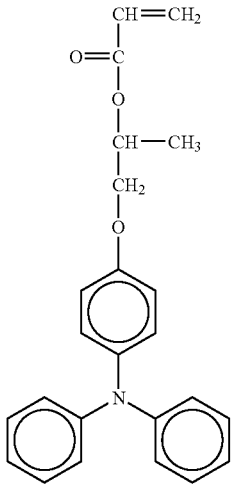
No.128
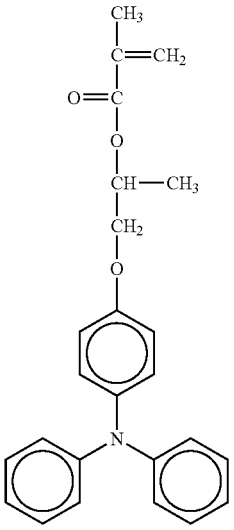
No. 129
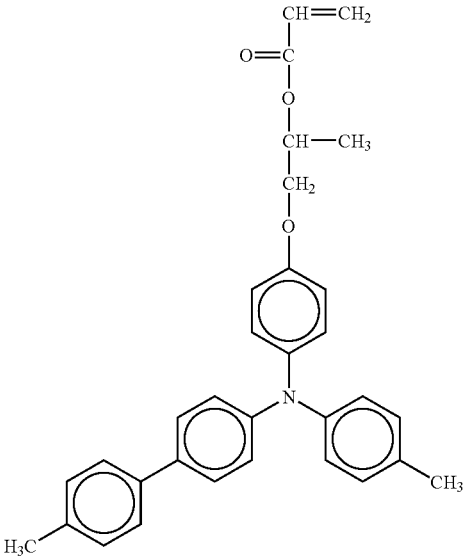
-continued
No. 130
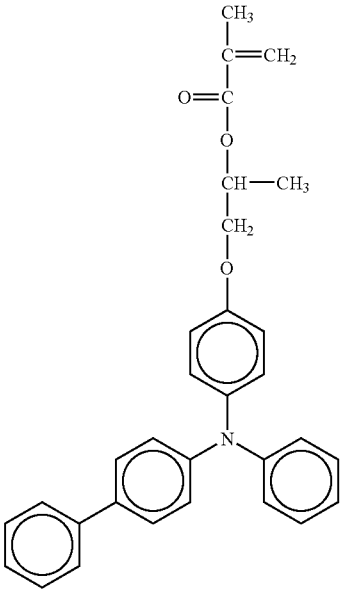
No. 131
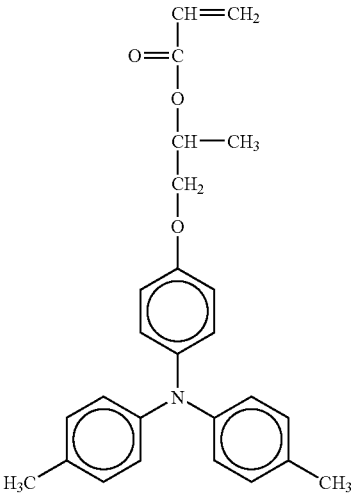
No. 132
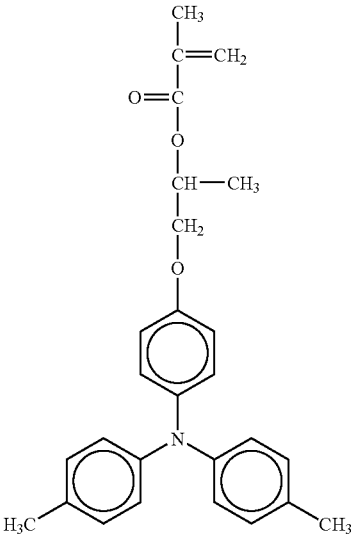

-continued
No. 133
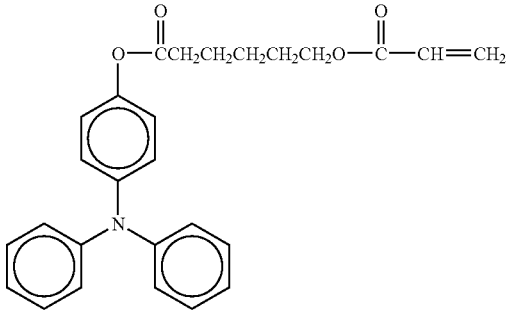
No. 134
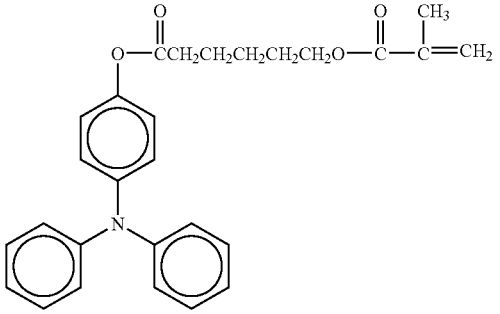
No. 135
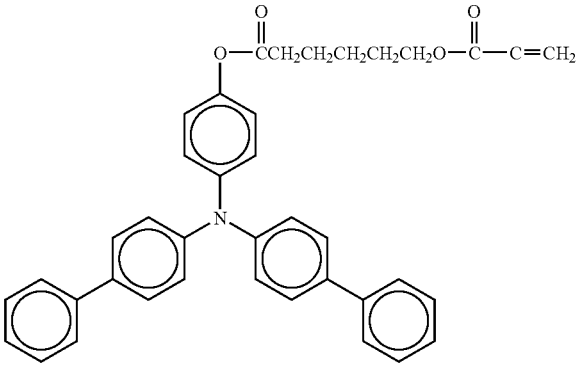
No. 136
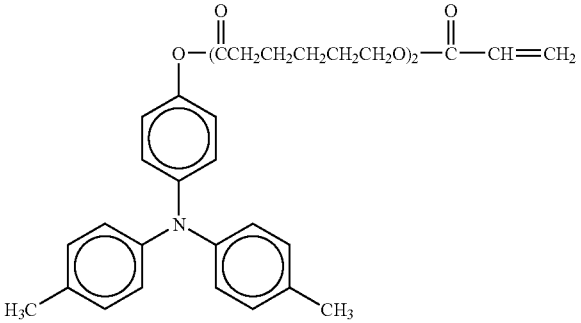
-continued
No. 137
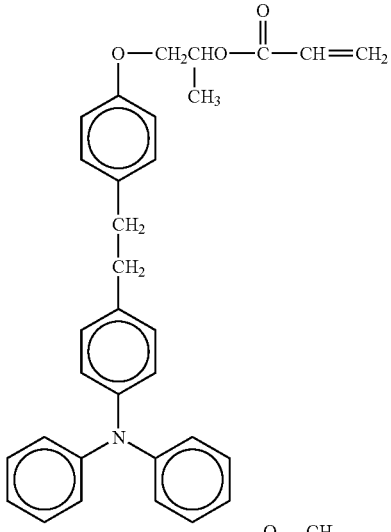
No. 138
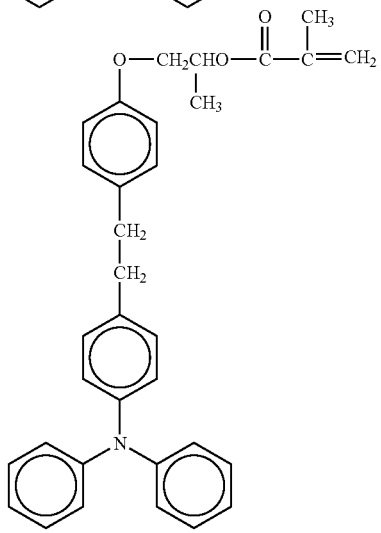
No. 139
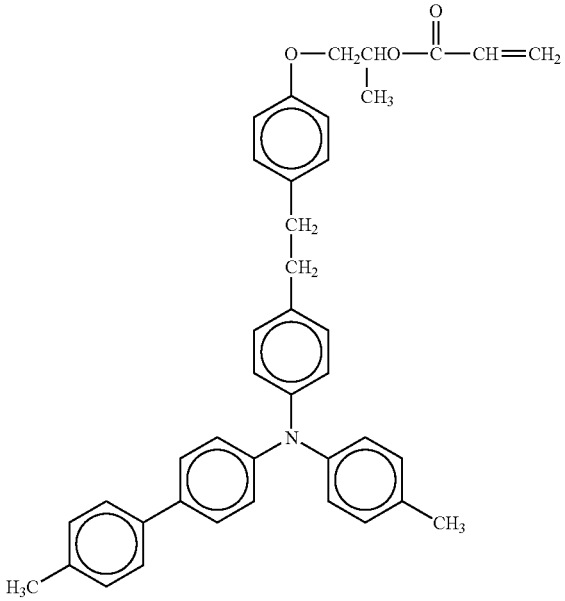

-continued
No. 140
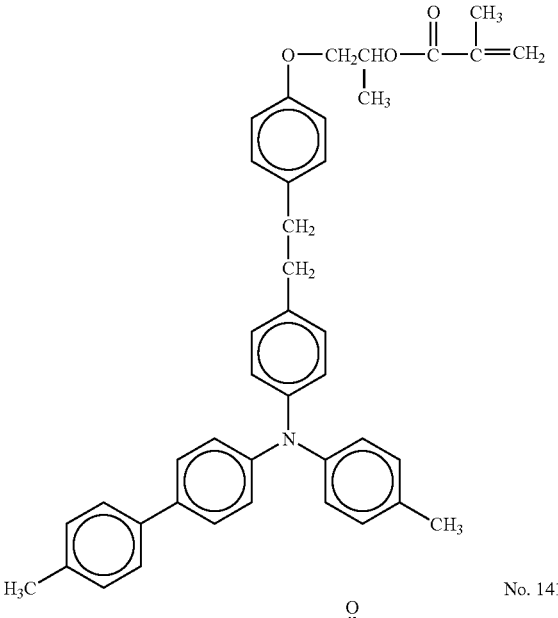
No. 141
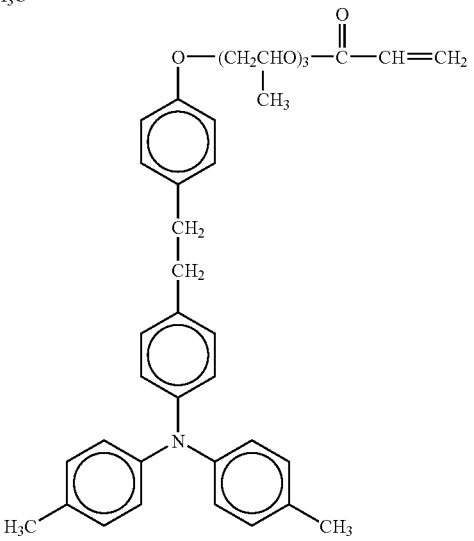
No. 142
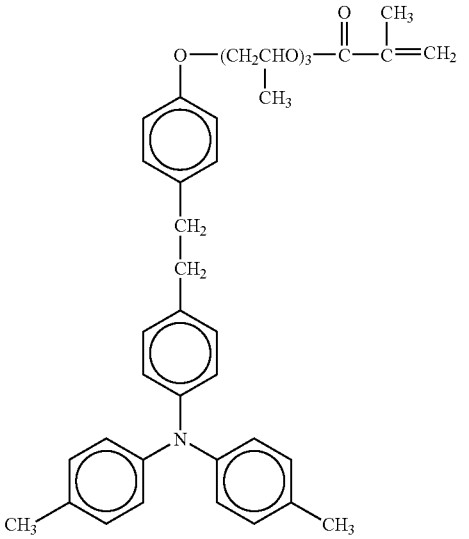
-continued
No. 143
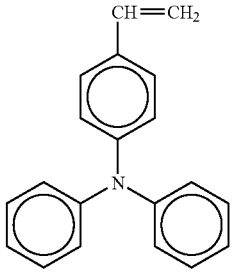
No. 144
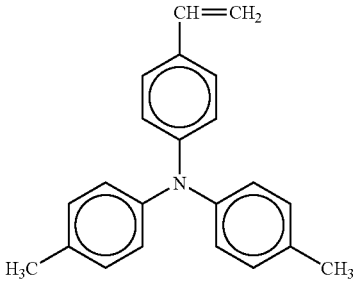
No. 145
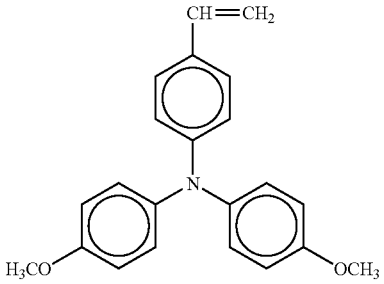
No. 146
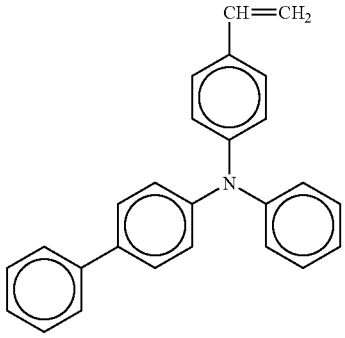
No. 147
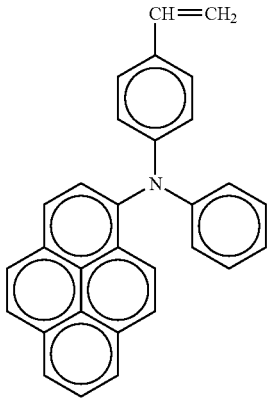

-continued
No. 148
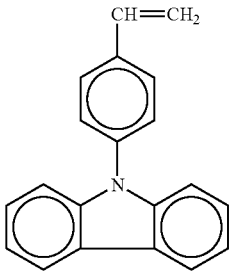
No. 149
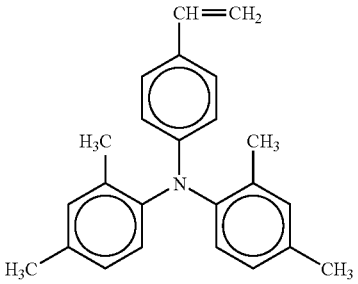
No. 150
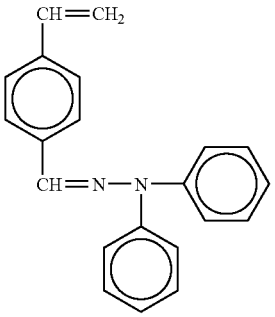
No. 151
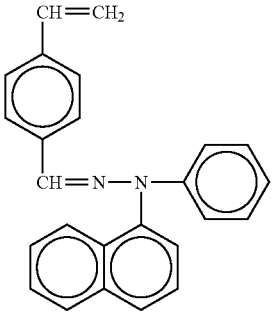
No. 152
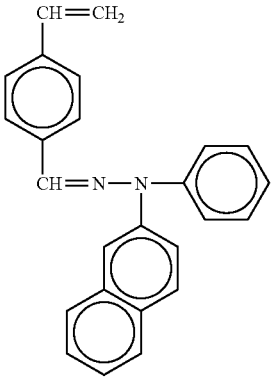
-continued
No. 153
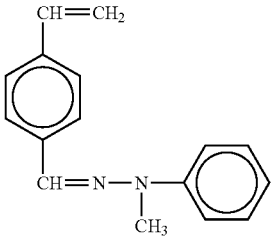
No. 154
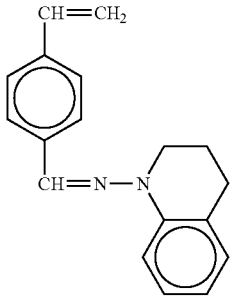
No. 155
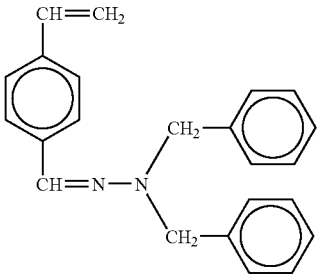
No. 156
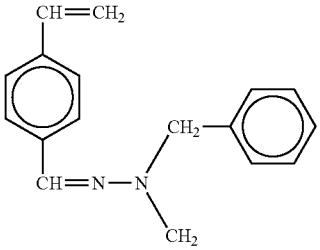
No. 157
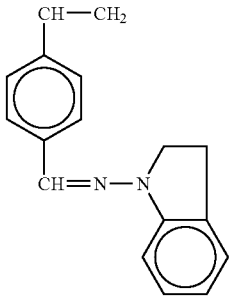
No. 158
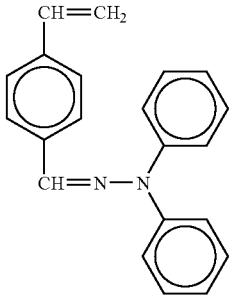

-continued

No. 159

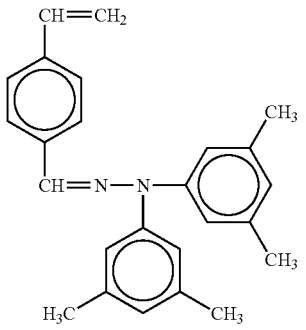

No. 160

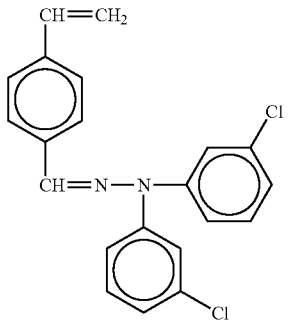

The radical polymeric compound for use in the present invention having a functional group with a charge transport structure imparts a charge transport function to the cross linking type protective layer 41. The content of the cross linking type protective layer 41 is from 20 to 80% by weight, and preferably from 30 to 70% by weight. When the content is too small, the charge transport function of the cross linking type protective layer 41 is not maintained, which may lead to the deterioration of the electric characteristics, for example, the decrease in the sensitivity and the rise in the residual voltage, during repetitive use. When the content is too large, the content of the radical polymeric monomer having at least three functional groups without a charge transport structure decreases. That is, the cross linking density decreases, resulting in the shortage of the anti-abrasion property. Desired electric characteristics and anti-abrasion property vary depending on the process, which affects the layer thickness of the cross linking type protective layer 41 of the image bearing member. Therefore, it is difficult to jump to any conclusion but considering the balance of both characteristics and property, the addition amount is most preferable from 30 to 70% by weight.

The cross linking type protective layer 41 forming the image bearing member for use in the present invention is formed by curing at least a radical polymeric monomer having at least three functional groups which does not have a charge transport structure and a radical polymeric compound having one functional group which has a charge transport structure. In addition to this, a radical polymeric monomer having one or two functional groups, functional monomers, and a radical polymeric oligomer can be used to provide functions, for example, adjusting the viscosity upon coating, relaxing the stress in the cross linking type protective layer 41, decreasing the surface energy, and reducing the friction index, etc. Any known radical polymeric monomers and oligomers can be used.

Specific examples of the radical polymeric monomer having one functional group include monomers of 2-ethylhexyl acrylate, 2-hydroxyethyl acrylate, 2-hydroxypropylacrylate, tetrahydrofurfuryl acrylate, 2-ethylhexyl carbitol acrylate, 3-methoxybutyl acrylate, benzyl acrylate, cyclohexyl acrylate, isoamyl acrylate, isobutyl acrylate, methoxy triethylene glycol acrylate, phenoxy tetraethylene glycol acrylate, cetyl acrylate, isostearylacrylate, stearylacrylate, and styrene.

Specific examples of the radical polymeric monomer having two functional groups include 1,3-butandiol diacrylate, 1,4-butane diol diacrylate, 1,4-butane diol dimethacrylate, 1,6-hexane diol diacrylate, 1,6-hexane diol dimethacrylate, diethylene glycol diacrylate, neopenthyl glycol diacrylate, bisphenol A-EO modified diacrylate, bisphenol F-EO modified diacrylate and neopenthyl glycol diacrylate.

Specific examples of the functional monomer include monomers in which a fluorine atom of, for example, octafluoro penthyl acrylate, 2-perfluorooctyl ethyl acrylate, 2-perfluorooctyl ethyl methacrylate and 2-perfluoroisononyl ethyl acrylate is substituted, and vinyl monomers, acrylates and methacrylates having polysiloxane groups, for example, acryloyl polydimethyl siloxane ethyl, methacryloyl polydimethyl siloxane ethyl, acryloyl polydimethyl siloxane propyl, acryloyl polydimethyl siloxane butyl and diacryloyl polydimethyl siloxane diethyl having 20 to 70 siloxane repeating units set forth in JPPs H05-60503 and H06-45770.

Specific examples of the radical polymeric oligomer include epoxyacrylate based, urethane acrylate based, and polyester acrylate based oligomers.

When a radical polymeric monomer and/or a radical polymeric oligomer having one or two functional groups are contained in a large amount, the three dimensional cross linking density of the cross linking type protective layer 41 substantially decreases, which invites the deterioration of the anti-abrasion property. Therefore, the content of these monomers and oligomers is not greater than 50 parts by weight and preferably not greater than 30 parts by weight based on 100 parts by weight of the radical polymeric monomer having at least three functional groups.

The cross linking type protective layer 41 for use in the present invention is formed by curing at least a radical polymeric monomer having at least three functional groups which does not have a charge transport structure and a radical polymeric compound having one functional group which has a charge transport structure. A polymerization initiator can be added, if desired, in a liquid of application for the cross linking type protective layer 41 to effectively conduct the curing reaction.

Specific examples of thermal polymerization initiator include peroxide-based initiators, for example, 2,5-dimethylhexane-2,5-dihydroperoxide, dicumyl peroxide, benzoyl peroxide, t-butyl cumyl peroxide, 2,5-dimethyl-2,5-di(peroxybenzoyl)hexyne-3,di-t-butyl peroxide, t-butylhydroperoxide, cumene hydroperoxide, lauroyl peroxide and 2,2-bis(4,4-di-t-butyl peroxy cyclohexy)propane, and azo based initiators, for example, azobis isobutylnitrile, azobiscyclohexane carbonitrile, azobis methyl isobutyric acid, azobis isobutyl amidine hydrochloride salts, and 4,4'-azobis-4-cyano valeric acid.

Specific examples of photo polymerization initiators include acetophenone based or ketal based photo polymerization initiators, for example, diethoxy acetopenone, 2,2-dimethoxy-1,2-diphenylethane-1-one, 1-hydroxy cyclohexyl phenylketone, 4-(2-hydroxyethoxy)phenyl-(2-hydroxy-2-propyl)ketone, 2-benzyl-2-dimethylamino-1-(4-morpholinophenyl)butanone-1,2-hydroxy-2-methyl-1-phenylpropane-1-one, 2-methyl-2-morpholino(4-methylthiophenyl) propane-1-one, and 1-phenyl-1,2-propane dione-2-(o-ethoxycarbonyl)oxime; benzoin ether based photo polymerization initiators, for example, benzoine, benzoine methyl ether, benzoin ethyl ether, benzoine isobutyl ether and benzoine isopropyl ether; benzophenone based photo polymerization initiators, for example, benzophenone, 4-hydroxy benzophenone, o-benzoyl benzoic acid methyl, 2-benzoyl naphthalene, 4-benzoyl biphenyl, 4-benzoyl phenyl ether, acrylated benzophenone and 1,4-benzoyl benzene; and thioxanthone based photo polymerization initiators, for example, 2-isopropyl thioxanthone, 2-chloro thioxanthone, 2,4-dimethyl thioxanthone, 2,4-diethyl thioxanthone, and 2,4-dichloro thioxanthone.

Other photo polymerization initiators are, for example, ethylanthraquinone, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxy benzoyl)-2,4,4-trimethyl pentyl phosphine oxide, methylphenyl glyoxy esters, 9,10-phenanthrene, acridine based compounds, triadine based compounds, and imidazole based compounds. In addition, compounds having photo polymerization promotion effect can be used alone or in combination with the photo polymerization initiators mentioned above. Specific examples thereof include triethanol amine, methyldiethanol amine, 4-dimethylamino ethyl benzoate, 4-dimethylamino isoamile benzoate, benzoic acid (2-dimethylamino)ethyl, and 4,4'-dimethylamino benzophenone.

These polymerization initiators can be used alone or in combination. The addition amount of the polymerization initiator is from 0.5 to 40 parts by weight and preferably from 1 to 20 parts by weight based on 100 parts by weight of the total weight of the radical polymeric compound.

Furthermore, a liquid of application for the cross linking type protective layer 41 can contain additives, for example, various kinds of a plasticizing agent (to relax stress and improve adhesibility), a leveling agent, and a low molecular weight charge transport material which is not radical polymeric, if desired. Known additives can be used. Specific examples of the plasticizing agent include compounds, for example, dibutyl phthalate and dioctyl phthalate, which are used for typical resins. The addition amount of the plasticizing agent is not greater than 20% by weight and more preferably not greater than 10% by weight based on all the solid portion of the liquid of application. Specific examples of the leveling agent include silicone oils, for example, dimethyl silicone oil, and methylphenyl silicone oil, and polymers or oligomers having a perfluoroalkyl group in its branch chain. The addition amount of the leveling agent is not greater than 3% by weight based on all the solid portion of the liquid of application.

The cross-linking type protective layer 41 for use in the present invention is formed by coating and curing on the charge transport layer 37 a radical polymeric monomer having three functional groups without having a charge transport structure and a radical polymeric compound having a functional group and a charge transport structure. When a radical polymeric monomer contained in a liquid of application is liquid, it is possible to coat the liquid of application in which other components are dissolved. In addition, a liquid of application can be diluted in a suitable solvent before coating, if desired. Specific examples of such solvents include an alcohol based solvent, for example, methanol, ethanol, propanol and butanol; a ketone based solvent, for example, acetone, methyl ethyl ketone, methyl isobutyl ketone, and cycle hexanone; an ester based solvent, for example, ethyl acetate and butyl acetate; an ether based solution, for example, tetrahydrofuran dioxane and propyl ether; a halogen based solvent, for example, dichloromethane, dichloroethane, trichloroethane and chlorobenzene; an aromatic series based solvent, for example, benzene, toluene and xylene; and a cellosolve based solvent, for example, methyl cellosolve, ethyl cellosolve and cellosolve acetate. These solvents can be used alone or in combination. The dilution ratio by these solvents depends on the solubility and the coating method of a composition, and a desired layer thickness. A dip coating method, a spray coating method, a beat coating method, a ring coating method, etc., can be used for application.

In the present invention, subsequent to the application of a liquid of application, the cross-linking type protective layer 41 is cured upon application of external energy, for example, heat, light and radiation ray. A method of applying heat energy can be used in which the cross-linking type protective layer 41 is heated from the application surface side or the substrate side using a gas, for example, air and nitrogen, vapor, or various kinds of heat media, infra-red radiation and electromagnetic wave. The heating temperature is not lower than 100° C. and preferably not higher than 170° C. When the heating temperature is too low, the reaction speed tends to be slow so that the curing reaction may not be complete. When the heating temperature is too high, the curing reaction is not uniformly conducted. Thereby, the protective layer 41 is significantly distorted inside, non-reaction groups may remain therein and three-dimensional mesh structure is not developed completely. To uniformly conduct the curing reaction, it is effective to heat the cross-linking type protective layer 41 at a relatively low temperature, for example lower than 100° C., followed by heating at a relatively high temperature, for example, higher than 100° C. to complete the curing reaction. As light energy, a UV irradiation light source, for example, a high pressure mercury lamp or a metal halide lamp having an emission wavelength mainly in the ultraviolet area can be used. A visible light source can be selected according to the absorption wavelength of a radical polymeric compound and a photopolymerization initiator. The irradiation light amount is preferably from 50 mW/cm$^2$ to 1,000 mW/cm$^2$. When the irradiation light amount is too small, it takes a long time to complete the curing reaction. When the irradiation light amount is too large, the reaction is not uniformly conducted, resulting in the occurrence of wrinkle on the surface of the protective layer 41 and a significant amount of non-reacted groups and polymerization terminated ends. In addition, the internal stress in the protective layer 41 increases due to such rapid cross-linking, which causes cracking and peeling thereof. As radiation ray energy, electron beam can be used. Among these forms of energies, thermal or light energy is suitably used in terms of easiness of reaction speed control and simplicity of a device.

The layer thickness of the cross-linking protective layer of the present invention is preferably from 1 to 10 μm, and more preferably from 2 to 8 μm. When the layer thickness is too thick, cracking and peeling easily occur as described above. When the layer thickness is in the preferred range, the safety margin is improved so that the density of cross-linking can be increased. Further, it is possible to select a material and set a curing condition for a high anti-abrasion property. On the other hand, the radical polymerization reaction is vulnerable to oxygen inhibition. That is, on the surface, which contacts air, cross-linking tends to not proceed at all or uniformly due to the radical trap caused by oxygen. This radical trap has a significant effect on the portion having a depth not greater than 1 μm from the surface. Therefore, in the cross-linking type protective layer 41 having a thickness not greater than 1 μm, the anti-abrasion property may deteriorate and non-uniform abrasion may occur. In addition, when the layer thickness of the cross-linking type protective layer 41 is too thin, contaminants may diffuse in the entire layer, which leads to the inhibition of the curing reaction and the decrease of the density of cross-linking. Considering these, the cross-linking type protective layer 41 having a layer thickness not less than 1 μm has a good anti-abrasion property and anti-damage property. But when the cross-linking type protective layer 41 is locally ground to the charge transport layer 37 provided under the protective layer 41 during repetitive use, the ground portion is further abraded, resulting in the production of a half tone image with uneven density due to the fluctuation of chargeability and sensitivity. Therefore, to obtain a durable image bearing member and improve the image quality, the layer thickness of the cross-linking type protective layer 41 is preferably at least 2 μm.

In the structure of the image bearing member for use in the present invention in which the charge blocking layer 43, the moiré prevention layer 45, the photosensitive layer 38 (the charge generating layer 35 and the charge transport layer 37) and the cross-linking type protective layer 41 are accumulated on the substrate 31 in this order, when the cross-linking type protective layer 41 provided uppermost is insoluble in an organic solvent, the anti-abrasion property and the anti-damaging property can be significantly improved. A method of testing the solubility in an organic solvent is as follows: drop on the surface of an image bearing member a droplet of an organic solvent, for example, tetrahydrofuran and dichloromethane having a high solubility for a polymer; and subsequent to natural dry, observe the change in the form of the surface of the image bearing member with a microscope. In the case of an image bearing member having a high solubility therein, the following phenomenon can be observed: the center portion on the image bearing member where the droplet has been dropped is dented and the portion therearound rises; the charge transport layer 37 precipitates, causing white turbidity or clouding due to the crystallization thereof; and wrinkled portion is observed as a result of swelling of the surface and contraction thereafter. To the contrary, an image bearing member insoluble in the organic solvent does not change at all and these phenomena are not observed.

In the structure of the present invention, to make the cross linking type protective layer 41 insoluble in an organic solvent, the following measures can be taken: (1) controlling the compositions and their content ratio of the liquid of application for the cross-linking type protective layer 41; (2) controlling the diluting solvent and the density of the solid portion of the cross linking type protective layer 41; (3) selecting the method of coating the cross linking type protective layer 41; (4) controlling the curing conditions of the cross linking type protective layer 41; and (5) making the charge transport layer 37 hardly soluble in an organic solvent. Each factor has an impact and desired to be used in combination.

When a binder resin having no radical polymeric functional group and an additive such as an anti-oxidization agent and a plasticizer in a large amount are contained in a large amount in the composition of the cross linking type protective layer 41 in addition to the radical polymeric monomer having at least three functional groups without having a charge transport structure and the radical polymeric compound having a functional group and a charge transport structure mentioned above, the density of cross linking decreases, and the phase separation occurs between the cured material obtained as the result of the reaction and the additives. Consequently, the composition may be soluble in an organic solvent. Specifically, it is desired to restrain the content of the additives within not greater than 20% by weight based on the total solid portion of the liquid of application. In addition, not to reduce the cross linking density, it is also desired to restrain the total content of a radical polymeric monomer having one or two monomers, a reactive oligomer, and a reactive polymer within not greater than 20% by weight based on the radical polymeric monomer having three functional groups. Further, when a radical polymeric compound having a charge transport structure having at least two functional groups is contained in a large amount, bulky structural bodies are fixed in multiple bondings in the cross linking structure, which may cause distortion. Therefore, such a structure tends to become an agglomeration of minute cured materials, which may make the cross linking type protective layer 41 soluble in an organic solvent. Although it depends on structures; it is preferred to restrain the content of a radical polymeric compound having a charge transport structure having at least two functional groups within not greater than 10% by weight based on the radical polymeric compound having a charge transport structure and a functional group.

With regard to the dilution solvent for a liquid of application for the cross linking type protective layer 41, when a solvent having a slow evaporation speed is used, the remaining solvent may inhibit the curing reaction or increase the content of contaminants from the layer provided under the cross linking type protective layer 41, which causes non-uniform curing and the decrease in the curing density. Therefore, the protective layer 41 tends to be soluble in an organic solvent. Suitable specific examples of the dilution solvents include tetrahydrofuran, a mixture solvent of tetrahydrofuran and methanol, ethyl acetate, methylethyl ketone and ethylcellosolve. These are selected in combination with a coating method. When the density of solid portion in a liquid of application is too low, the cross linking type protective layer 41 formed thereof tends to be dissolved in an organic solvent due to the same reason as described above. In contrast, on account of the restraint on the layer thickness and the viscosity of a liquid of application, the density has an upper limit. Specifically, the density is preferred to be from 10 to 50% by weight. As a method of coating a liquid of application for the cross linking type protective layer, as described above, a method is preferred in which the content of the solvent during coating is small and the contact time of the solvent is short. To be specific, a spray coating method or a ring coating method in which the amount of a liquid of application is regulated is preferred. In addition, to restrain the amount of the components infused from the layer provided under the protective layer 41, it is effective to use a charge transport polymer for the charge transport layer 37 and provide the intermediate layer 39 insoluble in a liquid of application for the cross linking type protective layer 41 between the photosensitive layer 38 (or the charge transport layer 37) and the cross linking type protective layer 41.

With regard to the curing conditions of the cross linking type protective layer 41, when the heating energy or light irradiation energy is too low, the curing reaction is not conducted completely. Thereby, the solubility thereof in an organic solvent increases. To the contrary, extremely high energy causes non-uniform curing reaction, which leads to the increase of non-cross linked portions and radical terminated portions and formation of an agglomeration of cured materials. The cross linking type protective layer 41 tends to be dissolved in an organic solvent. To make the cross linking type protective layer 41 insoluble in an organic solvent, heat curing is preferably performed at a temperature from 100 to 170° C. and for 10 minutes to 3 hours. UV irradiation curing is preferably performed at a range of from 50 to 1,000 $mW/cm^2$ for 5 seconds to 5 minutes while restraining the rise of the temperature within 50° C. Thereby, non-uniform curing reaction can be prevented.

Below are example methods of making the cross linking type protective layer 41 forming the image bearing member for use in the present invention insoluble in an organic solvent. For example, when an acrylate monomer having three acryloyloxy groups and a triaryl amine compound having an acryloyloxy group are used as a liquid of application, the content ratio of the acrylate monomer to the triaryl amine is 3/7 to 7/3 and an polymerization initiator is added in an amount of 3 to 20% by weight based on the total amount of the acrylate compound followed by an addition of a solvent to prepare the liquid of application. When a triaryl amine based doner and polycarbonate as a binder resin are used in the charge transport layer 37 provided under the cross linking type protective layer 41 and the surface thereof is formed by a spray coating method, it is preferred to use tetrahydrofuran, 2-butanone or ethyl acetate as the solvent mentioned above for the liquid of application, the content of which is 3 to 10 times as much as the total weight of the acrylate compound.

Next, for example, the liquid of application prepared as described above is applied with, for example, a spray, on an image bearing member in which the intermediate layer 39, the charge generating layer 35 and the charge transport layer 37 are accumulated on the substrate 31, for example, an aluminum cylinder. Subsequent to natural drying or drying at a relatively low temperature (25 to 80° C.) for a short time (1 to 10 minutes), the liquid of application is cured by UV ray irradiation or heat. In the case of UV ray irradiation, a metal halide lamp, etc., is used for preferably about 5 seconds to about 5 minutes while the drum temperature is controlled not to be high than 50° C. In the case of heat curing, the heating temperature is preferably from 100 to 170° C. An air supply oven is used as a heating device and when the heating temperature is set at 150° C., the liquid of application is heated for 20 minutes to 3 hours. After the curing reaction is complete, to reduce the amount of the remaining solvent, the liquid of application is heated at 100 to 150° C. for 10 to 30 minutes and thus the image bearing member of the present invention is obtained.

In addition to a filler for use in forming the protective layer 41 or the cross linking type protective layer 41, it is also possible to use known materials, for example, a-C and a-SiC formed by a method of forming vacuum thin layer to form the protective layer 41.

As described above, when the protective layer 41 is formed on the photosensitive layer 38, it is preferred to select a suitable protective layer to make discharging light reach the photosensitive layer 38 in a sufficient amount to obtain the discharging function. In addition, the protective layer 41 tends to deteriorate while the protective layer 41 repetitively absorbs discharging light, which leads to the rise of the residual voltage. In each case of the protective layers 41 described above, the transmission factor of the protective layer 41 for discharging light is not less than 30%, preferably not less than 50% and more preferably not less than 85%.

The transmission factor of the protective layer 41 can be measured by the same method as for the charge transport layer 37. Spectral absorption of a protective layer which is singly formed for use in an image bearing member is measured by a spectral photometer available in the market. The transmission factor of light having a wavelength of discharging light for use in an image forming apparatus can be obtained from the spectrum.

In addition, when an image bearing member having the protective layer 41 on the photosensitive layer 38 having the charge generating layer 35 and the charge transport layer 37 thereon is irradiated with discharging light from the surface of the image bearing member, the charge generating layer 35 is irradiated with the discharging light which has transmitted through the protective layer 41 and the charge transport layer 37. Therefore, the transmission factors of the charge transport layer 37 and the protective layer 41 are of significant importance. The transmission factor of the discharging light for the charge transport layer 37 and the protective layer 41 in total is not less than 30%, preferably not less than 50% and more preferably not less than 85%.

As described above, by providing the protective layer 41 on the surface of an image bearing member, the durability (anti-abrasion property) of the image bearing member is improved and a new effect which is not produced for a monochrome image forming apparatus can be provided for a tandem type full color image forming apparatus, which is described later.

In the present invention, to improve the environmental durability, especially to prevent the deterioration of the sensitivity and the rise in the residual voltage, an anti-oxidization agent can be suitably added in each layer of the protective layer 41, the charge transport layer 37, the charge generating layer 35, the charge blocking layer 43, the moiré prevention layer 45, etc. Specific examples of such anti-oxidization agents include the following: phenol based compounds, for example, 2,6-t-butyl-p-cresol, butylated hydroxyl anisole, 2,6-di-t-butyl-4-ethylphenol, stearyl-β-(3,5-di-t-butyl-4-hydroxyphenyl) propionate, 2,2'-methylene-bis(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroroxy-5-t-butylphenyl)butane, 1,3,5-trimethyl-2,4,6-tris (3,5-di-t-butyl-4-hydroxybenzyl)benzene, tetrakis-[methylene-3-(3',5'-di-t-butyl-4'-hydroxyphenyl) propionate]methane, bis[3,3'-bis(4'-hydroxy-3'-t-butylphenyl)butylic acid]glycol ester and tocopherols;

Paraphenylene diamines, for example, N-phenyl-N'-isopropyl-p-phenylene diamine, N,N'-di-sec-butyl-p-phenylene diamine, N-phenyl-N-sec-butyl-p-phenylene diamine, N,N'-di-isopropyl-p-phenylene diamine, and N,N'-dimethyl-N,N'-di-t-butyl-p-phenylene diamine;

Hydroquinones, for example, 2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone, 2-(2-octadecenyl)-5-methyl hydroquinone;

Organic sulfur compounds, for example, dilauryl-3,3-thiodipropionate, distearyl-3,3'-thiodipropionate, and ditetradecyle-3,3'-thiodipropionate; and organic phosphorus compounds, for example, triphenyl phosphine, tri(nonylphenyl) phosphine, tri(dinonylphenyl)phosphine, tricresyl phosphine and tri(2,4-dibutylphenoxy)phosphine.

These compounds are known as anti-oxidization agents for rubber, plastic, and oil and marketed products thereof can easily be obtained. The addition amount of the anti-oxidization agent in the present invention is from 0.01 to 10% by weight based on the total amount of the layer to which the anti-oxidization agent is added.

In the case of a full color image, various kinds of images including regular images are input. Proof marks in Japanese documents are one of such regular images. Images, for example, proof marks, are typically disposed at an edge of an image area and the usable color therefor is limited. In a state in which a random image is constantly written, writing, developing and transferring an image are averagely performed on and around the image bearing member in the image formation elements. However, when images are repeatedly written on a specific area many times or when only a specific image element is repeatedly used, the durability at the areas and of the image forming elements is thrown off balance. When an image bearing member having a surface the durability of which is physically, chemically and mechanically weak is used in such a state, the imbalance becomes significant among the elements, which leads to an image problem. To the contrary, when an image bearing member having a high durability is used, the local variation is small. Thereby, an abnormal image is hardly produced. Therefore, such an image bearing member has a high durability and the stability thereof is improved so that the image bearing member is extremely effective.

Image Forming Device

The image formation mentioned above is performed by, for example, uniformly charging the surface of the image bearing member and thereafter irradiating the surface imagewise by the image forming device.

The image forming device includes, for example, a charging device for uniformly charging the surface of the image bearing member and an irradiating device for irradiating the surface of the image bearing member imagewise.

There is no specific limit to the selection of the charging device. For example, there can be used a known contact type charging device having an electroconductive or semi-electroconductive roll, brush, film, and/or rubber blade and a known non-contact type charging device including a non-contact and vinicity type charging device having a space not greater than 100 μm between the surface of an image bearing member and a charging device, for example, corotron and scorotorn, using corona discharging. The electric field intensity applied to the image bearing member by the charging device is preferably from 20 to 60 V/μm and more preferably from 30 to 50 μm. The stronger the electric field intensity applied to the image bearing member is, the better the dot representation is. An electric field intensity that is too high may cause problems, for example, the insulation breakdown of an image bearing member and carrier attachment during development.

The electric field intensity is represented by the following relationship (1)

$$\text{Electric field intensity (V/μm)} = SV/G.$$

In the relationship (1), SV represents the absolute voltage (V) of the surface voltage at unirradiated portions on the image bearing member at the current position. G represents the layer thickness (μm) of the photosensitive layer 38, i.e., at least the total thickness of the charge generating layer 35 and the charge transport layer 37.

The irradiation mentioned above can be performed by irradiating the surface of the image bearing member using the irradiating device. There is no specific limit to the selectin of the irradiating device. There are various kinds of irradiating devices using, for example, a photocopying optical system, a rod lens array system, a laser optical system, and a liquid crystal shutter optical system. In the present invention, it is possible to adopt the bottom side irradiation by which an image bearing member is irradiated imagewise from the bottom side.

As the light source for the irradiating device mentioned above, a light source securing a high brilliance, for example, a luminous diode (LED), a semi-conductor laser (LD), and an electroluminescence (EL), can be used.

According to the definition of a light source for writing light, the definition of a formed latent electrostatic image, resultantly a toner image, is determined. The higher the definition is, the more clear the image is. However, it takes a long time for wiring with high definition so that when there is only one light source in an image forming apparatus, the writing is the rate controlling factor of the drum linear velocity (i.e., processing speed). Therefore, about 2,400 dpi is the upper limit of the definition when there is one light source for writing. When there are multiple light sources for writing, each thereof can irradiate just each corresponding writing area. Therefore, the upper limit of the definition is regulated by (2,400 dpi)×(the number of light sources for writing). Among these light sources mentioned above, a luminous diode and a semi-conductor laser have a high irradiation energy and can be effectively used.

In addition, by using a light source emitting light having a wavelength shorter than 450 nm as the light source wavelength of an irradiating device, a fine latent electrostatic image can be formed. The technology of laser oscillation for regulating the wavelength in this range is, for example, a technology in which the wavelength of a laser beam is halved by generation of the second high harmonic wave (SHG) and a technology using a wide gap semiconductor. In recent years, an LD oscillating a laser beam having a wavelength of from 400 to 410 nm and an optical system using this LD have been developed. This can be applied to the present invention. Although the current lower limit of the wavelength of writing light depends on the materials for use in the charge transport layer 37 and protective layer 41, the limit is about 350 nm. This lower limit can be lowered by the development of a new material and a laser technology.

Developing Device

Development can be performed by developing a latent electrostatic image with a toner to form a visualized image. A toner having the same polarity as the charging polarity of an image bearing member is used and the latent electrostatic image is developed using the reverse development (negative-positive development). There are two development systems. One is a single component development system using only a toner and the other is a two component development system using a toner and a carrier. Both can be suitably applied.

Transfer Device

The visualized image is transferred by a transfer device. There are two kinds of transfer methods. One is a method in which the visualized image is directly transferred from the surface of an image bearing member to a recording medium. The other is a method in which the visualized image is primarily transferred to an intermediate transfer body and then secondarily transferred to a recording medium. Both methods are applicable but when the transfer has an adverse impact on the improvement of the quality of images, the former method (direct transfer method) is preferred.

Transferring the visualized image can be performed by, for example, charging an image bearing member with a transfer charging device and with the transfer device mentioned above. There is no specific limit to the transfer device and any known device can be suitably used. For example, a transfer conveyor belt, which can simultaneously transfer a recording medium, can be suitably used.

The transfer device (a primary transfer device and a secondary transfer device) preferably has a transfer charging device by which the visualized image formed on an image bearing member is charged and detached to a recording medium. The transfer device can be plural. There can be used a corona transfer device using corona discharging, a transfer belt, a transfer roller, a pressure transfer roller and an adhesive transfer device as the transfer charging device. The recording medium has no specific limit to its selection and can be selected from any known recording medium (paper).

In addition, a transfer belt and a transfer roller can be used as the transfer charging device but it is preferred to use a contact type transfer belt and a contact type transfer roller which less produce ozone. It is possible to use either of a constant voltage system and a constant electric current system as the voltage/electric current applying system during transfer. The constant electric current system is preferred because the constant electric current system can constantly hold the amount of transfer charges and is more stabilized than the other. Known transfer devices can be used as long as the structure can satisfy the present invention.

As described above, the amount of charges passing through an image bearing member per image formation cycle greatly varies depending on the surface voltage (surface voltage when entering into the discharging portion) of the image bearing member after transfer. A large surface voltage has a significant influence on the electrostatic fatigue of an image bearing member during repetitive use.

The amount of charges passing through an image bearing member corresponds to the amount of charge trespassing along the layer thickness direction of the image bearing member. An image bearing member is charged (negatively charged in most cases) at a preferred charging voltage by a main charging device and optical writing is performed based on the input signals according to an original. Photocarriers are generated at the optically written portions and the surface charges are neutralized (potentially decayed). The charges flow in the layer thickness of the image bearing member depending on the amount of the generation of photocarriers. On the other hand, the non-optically written portion advances to the discharging portion after the developing process and the transfer process (and optionally a cleaning process). When the surface voltage of the image bearing member is close to the voltage charged by the main charging device (excluding the darkness decayed amount), the charges having almost the same amount as that corresponding to the optically written portions flow in the layer thickness of the image bearing member. In general, the writing ratio in an original is so low that almost all of the amount of charges passing through the image bearing member in this system is generated in the discharging process. For example, 90% of the total electric current flows in the discharging process when the writing ratio is 10%.

The charges passing through the image bearing member has a great adverse impact on the characteristics of the image bearing member, for example, causing the deterioration of the materials for use in the image bearing member. As a result, especially the residual voltage of the image bearing member rises depending on the amount of the charges passing through the image bearing member. When the residual voltage of the image bearing member rises, the image density decreases in the negative or positive development for use in the present invention, which is a large problem. Therefore, to achieve a long life (high durability) of an image bearing member for use in an image forming apparatus, how to make the charges passing through an image bearing member small is of significant importance.

To the contrary, an idea of not performing optical discharging is thinkable. But a main charging device is preferred to have a large charging ability to secure the charging, otherwise a problem, for example, residual images, may occur. Passing of charges through an image bearing member of charges is the transfer of the photocarriers generated by the electric field caused by the voltage charged at the surface of the image bearing member and optical irradiation. Therefore, when the surface voltage can be decayed by a means other than light, the amount of charges passing through an image bearing member per one rotation of the image bearing member (i.e., one cycle of image formation) is reduced.

The amount of charges can be effectively adjusted by adjusting the transfer bias in the transfer process. An image bearing member is charged by a main charging device and non-written portions thereon sustain a voltage (excluding the amount caused by darkness decay) close to the charging voltage and enters into the transfer process. When the absolute value on the polarity of charges charged by the main charging device is reduced to not greater than 100 V, the photocarriers and charges passing through the image bearing member are hardly generated when the image bearing member enters into the following discharging process. This absolute value is more preferred when the value is closer to zero.

Furthermore, when a transfer bias is applied to an image bearing member through adjustment of the transfer bias such that the surface voltage thereof has a polarity reverse to the polarity imparted by the main charging, the photocarrier is never produced, which is more preferred. However, under the condition such that the surface voltage of an image bearing member has the reverse polarity, transfer debris may be produced in a large amount and the main charging in the next image formation cycle may not be performed in time. This may cause a problem of producing residual images. Therefore, the absolute value of the surface voltage of an image bearing member by a transfer bias is preferred to be not greater than 100 V.

The adjustment mentioned above makes the effect of the present invention clear and is preferably used.

Fixing Device

The visualized image transferred to a recording medium is fixed by a fixing device. Fixing can be performed when each color toner is transferred to the recording medium or after each color toner is accumulated on the recording medium.

There is no specific limit to the fixing device and a known heating and pressing fixing device is suitably used. A combination of a heating roller and a pressing roller and a combination of a heating roller, a pressing roller and an endless belt can be used. The temperature of a heating and pressing fixing device is preferably from 80 to 200° C. In the present invention, for example, a known optical fixing device can be used in place of such fixing devices.

Discharging Device

Any known discharging device can be suitably selected as long as the discharging device can emit light having a wavelength shorter than 500 nm (i.e., wavelength of light which can be absorbed by the metal oxide contained in the intermediate layer 39 of the image bearing member) to discharge the image bearing member. For example, a semi-conductor laser (LD) and an electroluminescence (EL) can be used.

As the light source for a semiconductor laser (LD), electroluminescence (EL), etc., for example, there can be used a semiconductor laser or an electroluminescence (EL) which can oscillate light having a wavelength shorter than 500 nm and a combination of a fluorescent lamp, a tungusten lamp, a halogen lamp, a mercury lamp, a sodium lamp or a xenon lamp with an optical filter which can restrain the luminescence in the range of a wavelength shorter than 500 nm. As the optical filter, various kinds of filters, for example, a sharp cut filter, a band-pass filter, a near infrared filter, a dichroic filter, a coherent filter and a color conversion filter, can be used for irradiation of light having a wavelength in a preferred range (i.e., shorter than 500 nm).

There are several technologies by which the oscillation of a laser is regulated in this range. JOPs H09-275242, H09-189930 and H05-313033 describe a technology in which the wavelength of a laser beam is halved by generation of the second high harmonic wave (SHG). Since this system can use a GaAs based LD or a YAG laser, which is a technology established as the primary light source for outputting a high energy, the elongation of life and high power output are possible. In another technology, a wide gap semiconductor is used and the size can be reduced in comparison with the device using SHG. JOPs H07-321409 and H06-334272 describe an LD technology using ZnSe based semiconductors and JOPs H08-88441 and H07-335975 describe another LD technology using GaN based semiconductors. These technologies using LDs have been greatly studied in terms of its high luminescence efficiency. Furthermore, as the relatively leading edge technology, LDs (oscillation of 405 nm) using a GaN based semiconductor are marketed by Nichia Corporation. This technology contributes to the development of a highly advanced writing system in comparison with the other technologies described above and can be effectively used in the present invention. In addition, LED lamps using the materials mentioned above are marketed and also can be effectively used.

On the other hand, the lower limit is regulated by the following issue. That is, a charge transport material is used as a component forming an image bearing member, i.e., the charge transport layer 37 and the protective layer 41 existing on the writing light side. However, there is practically no charge transport material which not only has a high transport speed but also is sufficiently transparent to light having a wavelength less than about 350 nm. This is ascribable to the fact that most of the developed charge transport materials have a triaryl amine structure and the absorption end thereof on the long wavelength side is about from 300 to 350 nm. Therefore, when the wavelength of discharging light emitted by a light source can be shortened and the transparency (light absorption on the short wavelength side) of a charge transport material is improved, the oscillation of the light source for use in the present invention can advance to the short wavelength side.

Others

There is no specific limit to the cleaning device. Any known cleaning device can be used as long as the toner remaining on an image bearing member can be removed. For example, a magnetic brush cleaner, an electrostatic brush cleaner, a magnetic roller cleaner, a blade cleaner, a brush cleaner and a web cleaner can be suitably used.

The recycling process is a process of returning the toner removed by the cleaning device to the developing device for recycle use. Any known transport system can be used as the recycling system.

The controlling process is a process of controlling each process mentioned above by a controlling device. There is no specific limit to the selection of the controlling device and any known controlling device can be suitably selected as long as the controlling device can control the behavior of each device. For example, devices, for example, a sequencer and a computer, can be used.

An embodiment of the image forming apparatus of the present invention is described with reference to FIG. 8.

Figure 8:
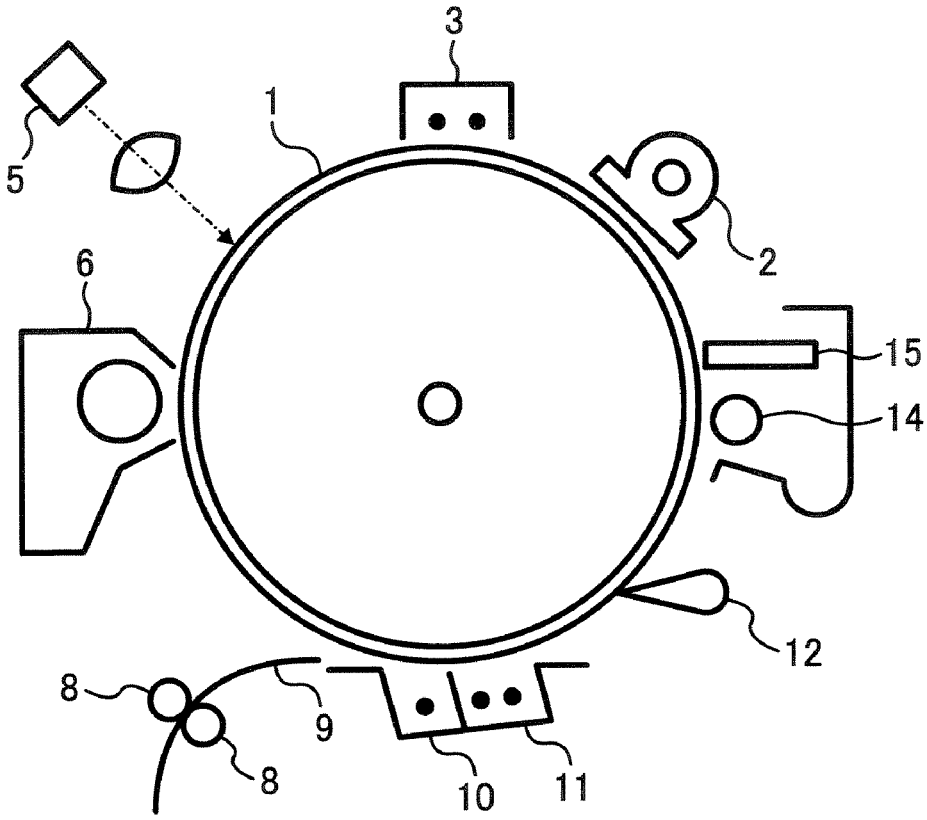
FIG. 8 is a schematic diagram illustrating an example of the electrophotographic process and the image forming apparatus of the present invention.

FIG. 8 is a schematic diagram illustrating the image forming apparatus of the present invention. The variations described later are with in the scope of the present invention.

In FIG. 8, an image bearing member 1 has an intermediate layer containing a metal oxide and a layered photosensitive layer including a charge generating layer containing an organic charge generating material and a charge transport layer containing a charge transport material on a substrate. The image bearing member 1 has a drum form but a sheet form or an endless form is also allowed.

A charging device having a wire system or a roller form is used as a charging device 3. When a high speed charging is desired, a charging device of a scorotron system is preferably used. In an image forming apparatus of a compact size or of a tandem type using plurality of the image bearing members described later, a charging device having a roller form which can restrain the production of acidic gasses (e.g., NOx and Sox) and ozone is effectively used. The charging device 3 charges the image bearing member 1. Since the dot representation is improved as the electric field intensity applied to the image bearing member 1 increases, the electric field intensity is preferably not less than 20 V/μm. However, this may cause problems, for example, the insulation breakdown of the image bearing member 1 and carrier attachment thereto during development. Therefore, the upper limit of the electric field intensity is about 60 V/μm and preferably 50 V/μm.

A light source, for example, a luminous diode (LD), a semi-conductor (LD) and an electroluminescence (EL), which can secure high brightness and can write with high definition, for example, not less than 600 dpi, is used in an image irradiation portion 5. The definition of a formed latent electrostatic image, resultantly a toner image, is determined by the definition of a light source for writing light. The higher the definition is, the more clear the image is. However, it takes a long time for writing with high definition so that when there is only one light source in an image forming apparatus, the writing is the rate controlling factor of the drum linear velocity (i.e., processing speed). Therefore, about 2,400 dpi is the upper limit of the definition when there is one light source for writing. When there are multiple light sources for writing, each thereof can irradiate just each corresponding writing area. Therefore, the upper limit of the definition is regulated by (2,400 dpi)×(the number of light source for writing). Among these light sources mentioned above, a luminous diode and a semi-conductor laser have a high irradiation energy and can be effectively used. As described above, it is effective to use a laser beam the oscillation wavelength of which is shorter than 450 nm.

A developing unit 6 functioning as a developing device has at least one developing sleeve.

In the developing unit 6, a toner having the same polarity as that of the image bearing member 1 and a latent electrostatic image is developed by the reverse development (negative and positive development). Although it depends on the light source for use in the image irradiation portion 5, to elongate the life of the light source, the reverse development system in which toner development is performed for written portions is advantageous in the case of a digital light source which have been recently used in reflection of the low image area ratio in general.

There are two development systems. One is a single component development system using only a toner and the other is a two component development system using a toner and a carrier. Both can be suitably applied.

A transfer belt and a transfer roller can be used as a transfer charging device 10, but it is preferred to use a contact type transfer belt and a contact type transfer roller which less produce ozone. It is possible to use either of a constant voltage system and a constant electric current system as the voltage/electric current applying system during transfer. The constant electric current system is preferred because the constant electric current system can constantly hold the amount of transfer charges and is more stabilized than the other. Especially, a method is preferred in which the electric current to the image bearing member 1 is controlled by subtracting the electric current which does not flow in the image bearing member 1 but in portions related to transfer members from the electric current output from a high voltage power supply for providing charges to the transfer members.

The transfer electric current is an electric current by which toner electrostatically attached to the image bearing member 1 is detached and transferred to a transfer body (e.g., transfer medium 9 or an intermediate transfer body). To avoid poor transfer performance, for example, remaining transfer, it is desired to have a large transfer electric current. However, in the case of the reverse development (negative or positive development), the charges having a polarity reverse to the charging polarity of the image bearing member 1 are provided so that the image bearing member 1 is electrostatically fatigued significantly. It is true that a large transfer electric current is advantageous to provide an amount of charges having a stronger force than the electrostatic attachment force between the image bearing member 1 and the toner. However, a transfer electric current that is larger than a threshold causes discharging between the transfer members and the image bearing member 1, resulting in scattering of a finely developed toner image. The threshold is a value below which the discharging does not occur and varies depending on the distance (space) between the transfer members and the image bearing member 1 and the materials forming the transfer members and the image bearing member 1. The discharging can be avoided below about 200 μA so that the upper limit of the transfer electric current is about 200 μA.

In addition, there are two methods for transferring the toner image formed on the image bearing member 1 to the transfer medium (paper) 9. One is the direct transfer in which a toner image developed on the image bearing member 1 is directly transferred as in FIG. 8. The other is a method in which a toner image developed on the image bearing member 1 is transferred to the transfer medium 9 via an intermediate body. Both methods can be suitably used in the present invention. Any known transfer member can be used as long as the transfer member satisfies the structure of the present invention.

When the surface voltage at non-irradiated portions by the writing light of the image bearing member 1 after transfer is reduced by controlling the transfer electric current as described above, the amount of charges passing through the image bearing member 1 per cycle of image formation can be reduced. This can be effectively used in the present invention.

There is no specific limit to the selection of the light source for use in a discharging lamp 2 as long as the light source can emit light having a wavelength shorter than 500 nm (which can be absorbed by a metal oxide contained in the intermediate layer of the image bearing member 1) and discharge the image bearing member 1. Any known discharging device can be selected. For example, a semiconductor laser (LD) and electroluminescence (EL) are suitably selected.

As the light source for a semiconductor laser (LD), electroluminescence (EL), etc., for example, there can be used a semiconductor laser or an electroluminescence (EL) which can oscillate light having a wavelength shorter than 500 nm and a combination of a fluorescent lamp, a tungusten lamp, a halogen lamp, a mercury lamp, a sodium lamp or a xenon lamp with an optical filter which can restrain the luminescence in the range of a wavelength shorter than 500 nm. As the optical filter, various kinds of filters, for example, a sharp cut filter, a band-pass filter, a near infrared filter, a dichroic filter, a coherent filter and a color conversion filter, can be used for the irradiation of light having a wavelength in a preferred range (i.e., shorter than 500 nm).

The lower limit of the wavelength depends on the transmission factor of the charge transport layer and the protective layer for use in the image bearing member 1 and is about from 300 to 350 nm.

In FIG. 8, 8 represents a pair of registration rollers, 11 represents a separation charging device, and 12 represents a separation claw.

In addition, the toner developed on the image bearing member 1 by the developing unit 6 is transferred to the transfer medium 9. Toner remaining on the image bearing member 1 is removed by a fur brush 14 and a cleaning blade 15. The cleaning can be performed only by a cleaning brush. Known cleaning brushes, for example, a fur brush and a magfur brush, can be used as the cleaning brush 14.

Figure 9:
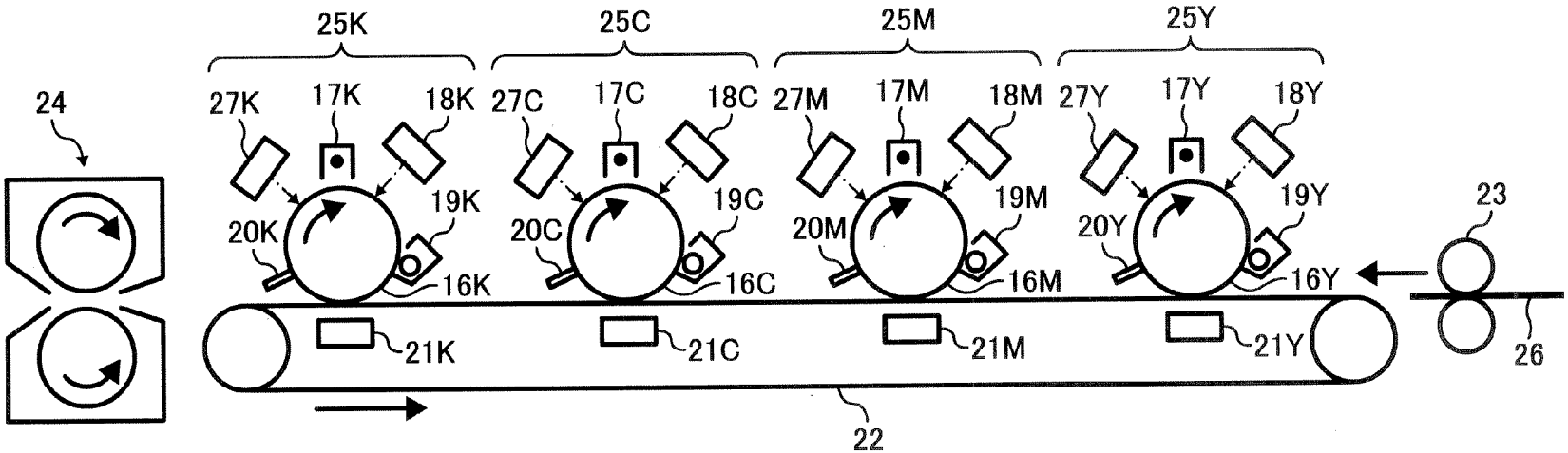
FIG. 9 is a schematic diagram illustrating an example of the tandem type full color image forming apparatus of the present invention.

FIG. 9 is a schematic diagram illustrating an example of the tandem type full color image forming apparatus of the present invention. The variations described later are also with in the scope other present invention.

In FIG. 9, each of 16Y, 16M, 16C and 16K represent a drum image bearing member. Each image bearing member has an intermediate layer containing a metal oxide and a layered photosensitive layer including a charge generating layer containing an organic charge generating material and a charge transport layer containing a charge transport material on a substrate.

These image bearing members 16Y, 16M, 16C and 16K can rotate in the direction indicated by the arrows in FIG. 9. Around the image bearing members 16Y, 16M, 16C and 16K, charging devices 17Y, 17M, 17C and 17K, developing devices 19Y, 19M, 19C and 19K having a developing sleeve, cleaning devices 20Y, 20M, 20C and 20K, and discharging devices 27Y, 27M, 27C and 27K emitting light having a wavelength shorter than 410 nm are arranged along the rotation direction of the image bearing members 16Y, 16M, 16C and 16K. The charging devices 17Y, 17M, 17C and 17K, are charging devices for uniformly charging the surface of the image bearing members 16Y, 16M, 16C and 16K. Irradiating devices 18Y, 18M, 18C and 18K irradiate the surface of the image bearing members 16Y, 16M, 16C and 16K with laser beam from between the charging devices 17Y, 17M, 17C and 17K and the developing devices 19Y, 19M, 19C and 19K to form latent electrostatic images on the image bearing members 16Y, 16M, 16C and 16K. Four image forming elements 25Y, 25M, 25C and 25K having the image bearing members 16Y, 16M, 16C and 16K as main components are arranged along a transfer belt 22. The transfer belt 22 are brought into contact with the image bearing members 16Y, 16M, 16C and 16K between the developing devices 19Y, 19M, 19C and 19K and cleaning devices 20Y, 20M, 20C and 20K. Transfer brushes 21Y, 21M, 21C and 21K for applying a transfer bias are arranged on the opposite side of the transfer belt 22 relative to the image bearing members 16Y, 16M, 16C and 16K. Each of the image forming elements 25Y, 25M, 25C and 25K have the same structure except for the color of the toner contained therein.

The image formation is performed in the full color image forming apparatus having the structure illustrated in FIG. 9 as follows.

First, latent electrostatic images are formed on the image bearing members 16Y, 16M, 16C and 16K in each of the image forming elements 25Y, 25M, 25C and 25K. Then the image bearing members 16Y, 16M, 16C and 16K rotate and are charged by the charging devices 17Y, 17M, 17C and 17K. To form a fine latent electrostatic image, the electric field intensity of the image bearing members 16Y, 16M, 16C and 16K is from 20 to 60 V/μm and preferably to 50 V/μm.

Next, the irradiating devices 18Y, 18M, 18C and 18K arranged outside the image bearing members 16Y, 16M, 16C and 16K perform writing with a laser beam with a definition not less than 1,200 dpi, preferably not less than 2,400 dpi to form latent electrostatic images corresponding to each color formed image. As described above, any light source suitable for the image bearing members 16Y, 16M, 16C and 16K can be used as the light source for writing light. The upper limit of the definition of a light source for writing light is about 2,400 dpi. As described above, it is effective to use a laser beam the oscillation wavelength of which is shorter than 450 nm.

Next, the developing devices 19Y, 19M, 19C and 19K develop latent electrostatic images and form corresponding toner images. The developing devices 19Y, 19M, 19C and 19K are developing devices developing latent images with toners of Y (Yellow), M (Magenta), C (Cyan) and K (Black) and respective color toner images formed on four image bearing members 16Y, 16M, 16C and 16K are overlapped on a transfer medium 26. The transfer medium 26 is sent out from a tray by paper feeding rollers (not shown), temporarily held at a pair of registration rollers 23 and transferred to the transfer belt 22 synchronously with a timing of image formation on the image bearing members 16Y, 16M, 16C and 16K. The transfer medium 26 held on the transfer belt 22 is transferred and each color toner image is transferred thereto at the contact point (transfer point) of the transfer medium 26 and the image bearing members 16Y, 16M, 16C and 16K.

The toner images on the image bearing members 16Y, 16M, 16C and 16K are transferred to the transfer medium 26 by the potential between the transfer bias applied to the transfer brushes 21Y, 21M, 21C and 21K and the image bearing members 16Y, 16M, 16C and 16K. The transfer medium 26 on which four color toner images are overlapped while passing through the four transfer points is transferred to a fixing device 24, where the toner is fixed, and output to a medium discharging portion (not shown).

In addition, the toner which has not been transferred at the transfer points and remains on the image bearing members 16Y, 16M, 16C and 16K is retrieved by the cleaning devices 20Y, 20M, 20C and 20K.

Next, the extra residual charges on the image bearing members 16Y, 16M, 16C and 16K are removed by the discharging devices 27Y, 27M, 27C and 27K emitting light having a wavelength shorter than 410 nm. Thereafter, the image bearing members 16Y, 16M, 16C and 16K are again charged by the charging devices 17Y, 17M, 17C and 17K to start the next image formation.

In addition, in the example illustrated in FIG. 9, the image forming elements 25Y, 25M, 25C and 25K are arranged in this order from the upstream to the downstream of the transfer belt 22 relative to the transfer direction of the transfer medium 26 but can be arranged in any order. It is especially effective to provide a mechanism by which the image forming elements 25Y, 25M and 25C forming color images other than black images are suspended when a black color image is formed.

In addition, as described above, the surface of the image bearing members 16Y, 16M, 16C and 16K after transfer is preferably charged to have a voltage not greater than 100 V with the same polarity as that of the image bearing members 16Y, 16M, 16C and 16K charged by the charging devices 17Y, 17M, 17C and 17K, more preferably with the polarity reverse thereto and especially preferably a voltage not greater than 100 V with the reverse polarity. Thereby, the rise of the residual voltage of the image bearing members 16Y, 16M, 16C and 16K during repetitive use can be reduced.

Figure 10:
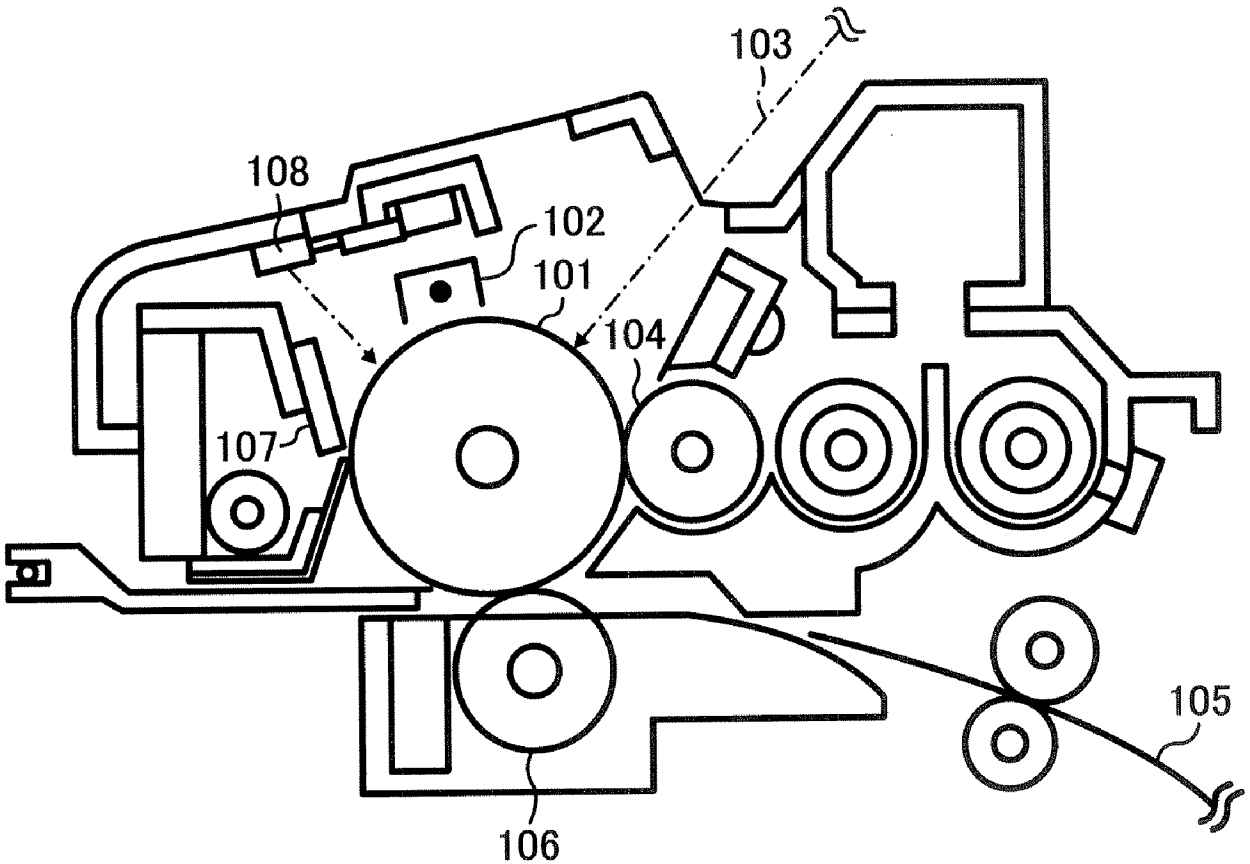
FIG. 10 is a diagram illustrating an example of the process cartridge for use in the present invention.

The devices mentioned above relating to the image formation can be fixedly incorporated in a photocopier, a facsimile machine or a printer or take a form of a process cartridge, which is corporate therein as a whole. The process cartridge is a device (part) including an image bearing member and at least one of the devices, for example, an image forming device, a developing device, a transfer device, a cleaning device and a discharging device. The process cartridge can be freely designed. A general example thereof is as illustrated in FIG. 10. An image bearing member 101 includes a substrate on which an intermediate layer containing a metal oxide and a layered photosensitive layer including a charge generating layer containing an organic charge generating material and a charge transport layer containing a charge transport material.

An image irradiating portion 103 preferably uses a light source by which writing can be performed with a definition not less than 600 dpi. Any charging device can be used as a charging device 102. In FIG. 10, 104 represents a developing device including a developing sleeve, 105 represents a transfer body, 106 represents a transfer device, and 107 represents a cleaning device and 108 represents a discharging device having a light source emitting light having a wavelength shorter than 500 nm.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Below are the detailed descriptions of the present invention with reference to Examples but the present invention is not limited thereto.

First, the methods of synthesizing azo pigments and titanyl phthalocyanine having a crystal form for use in the present invention are described.

The azo pigment for use in Examples is manufactured in accordance with the methods described in examined published Japanese patent application No. (hereinafter referred to as JPP) S60-29109 and JP 3026645. The titanyl phthalocyanine having a crystal form is manufactured in accordance with the methods described in JOPs 2001-19871 and 2004-82859.

Syntesis of Titanyl Phthalocyanine Having Crystal Form

Synthesis Example 1

A titanyl phthalocyanine having a crystal form is manufactured in accordance with Synthesis Example 1 in JOP 2001-19871. That is: Mix 29.2 g of 1,3-diaminoisoindoline and 200 ml of sulforan and drop 20.4 g of titanium tetrabuthoxide to the resultant liquid in nitrogen atmosphere; Subsequent to the drop, gradually heat the resultant liquid to 180° C. followed by 5 hour stirring while keeping the reaction temperature between 170 to 180° C.; After standing to cool, filter the precipitated material and wash the resultant powder with chloroform until the color thereof shows blue; Wash the resultant with methanol several times and thereafter with hot water of 80° C. several times; Subsequent to drying, coarse titanyl phthalocyanine is obtained; Dissolve the coarse titanyl phthalocyanine in concentrated sulfuric acid having an amount 20 times as much as the amount of the coarse titanyl phthalocyanine and drop the resultant to iced water in an amount 100 times as much as that of the resultant while stirring; Filter the precipitated crystal and repetitively wash the crystal with deionized water (pH: 7.0 and specific conductivity: 1.0 μS/cm) until the washing water shows neutral (pH: 6.8 and specific conductivity: 2.6 μS/cm) and wet cake (water paste) of titanyl phthalocyanine pigment is thus obtained; and place 40 g of the wet cake in 200 g of tetrahydrofuran followed by 4 hour stirring, filtering and drying and thereby powder of titanyl phthalocyanine is obtained as Pigment No.

The density of the solid portion of the wet cake is 15% by weight. The amount of the crystal conversion solvent is 33 times in weight ratio based on the amount of the wet cake. The raw material of Synthesis Example 1 does not contain a halogen containing compound.

The obtained titanyl phthalocyanine powder has a CuKα X ray diffraction spectrum having a wavelength of 1.542 Å such that a maximum diffraction peak is observed at a Bragg (2θ) angle of 27.2±0.2°, main peaks at a Bragg (2θ) angle of 9.4±0.2°, 9.6±0.2°, and 24.0±0.2°, and a peak at a Bragg (2θ) angle of 7.3±0.2° as the lowest angle diffraction peak, and having no peak between the peak of 9.4°±0.2° peak and the peak of 7.3°±0.2° and no peak at 26.3° when measured under the following conditions:

X ray diffraction spectrum measuring conditions

X ray tube: Cu

Voltage: 50 kV

Current: 30 mA

Scanning speed: 2°/min

Scanning area: 3 to 40°

Time constant: 2 seconds

Figure 11:
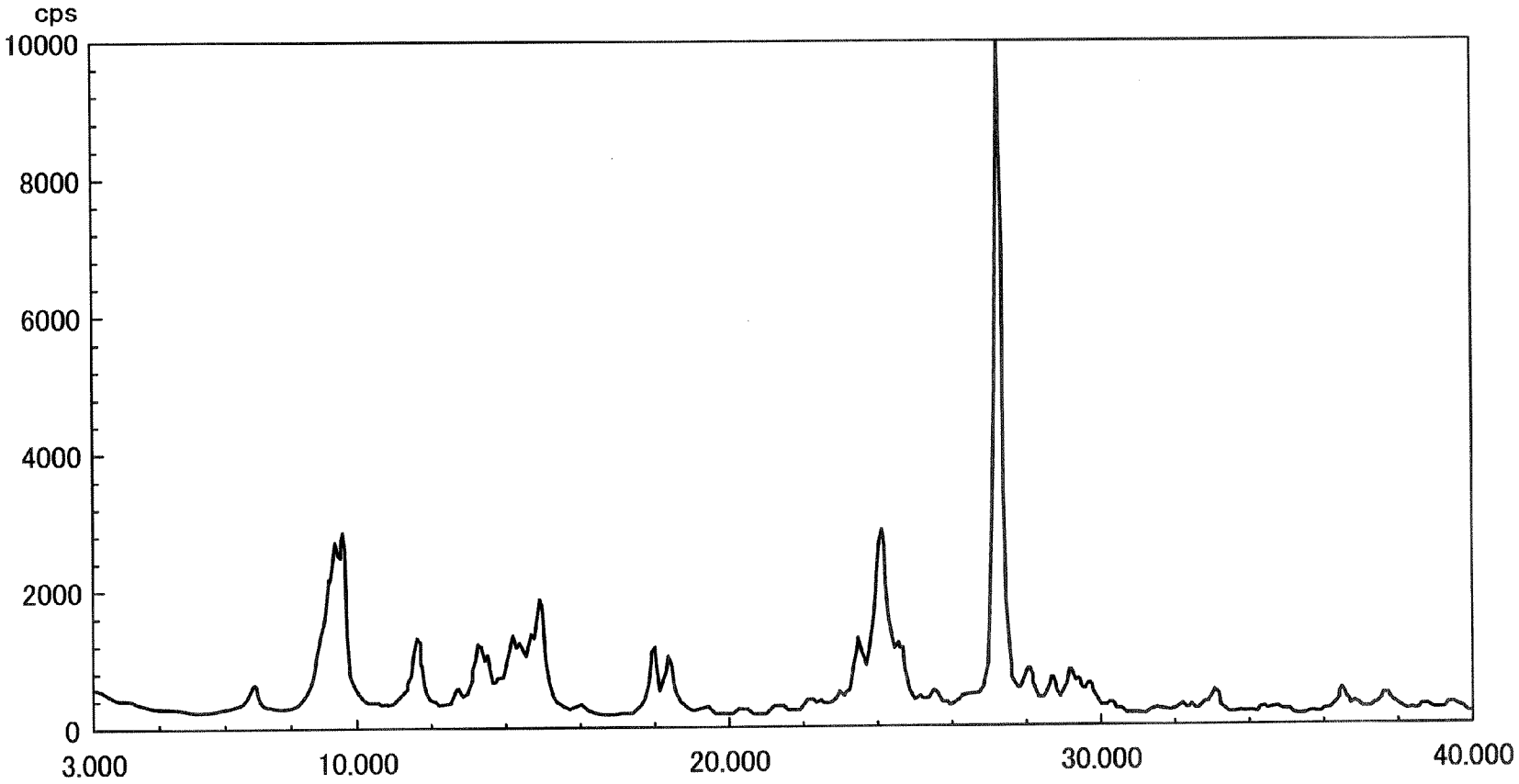
FIG. 11 is a graph illustrating an XD spectrum of the titanyl phthalocyanine of water paste synthesized in Synthesis Example 1, which is described later.

The result is shown in FIG. 11.

Figure 12:
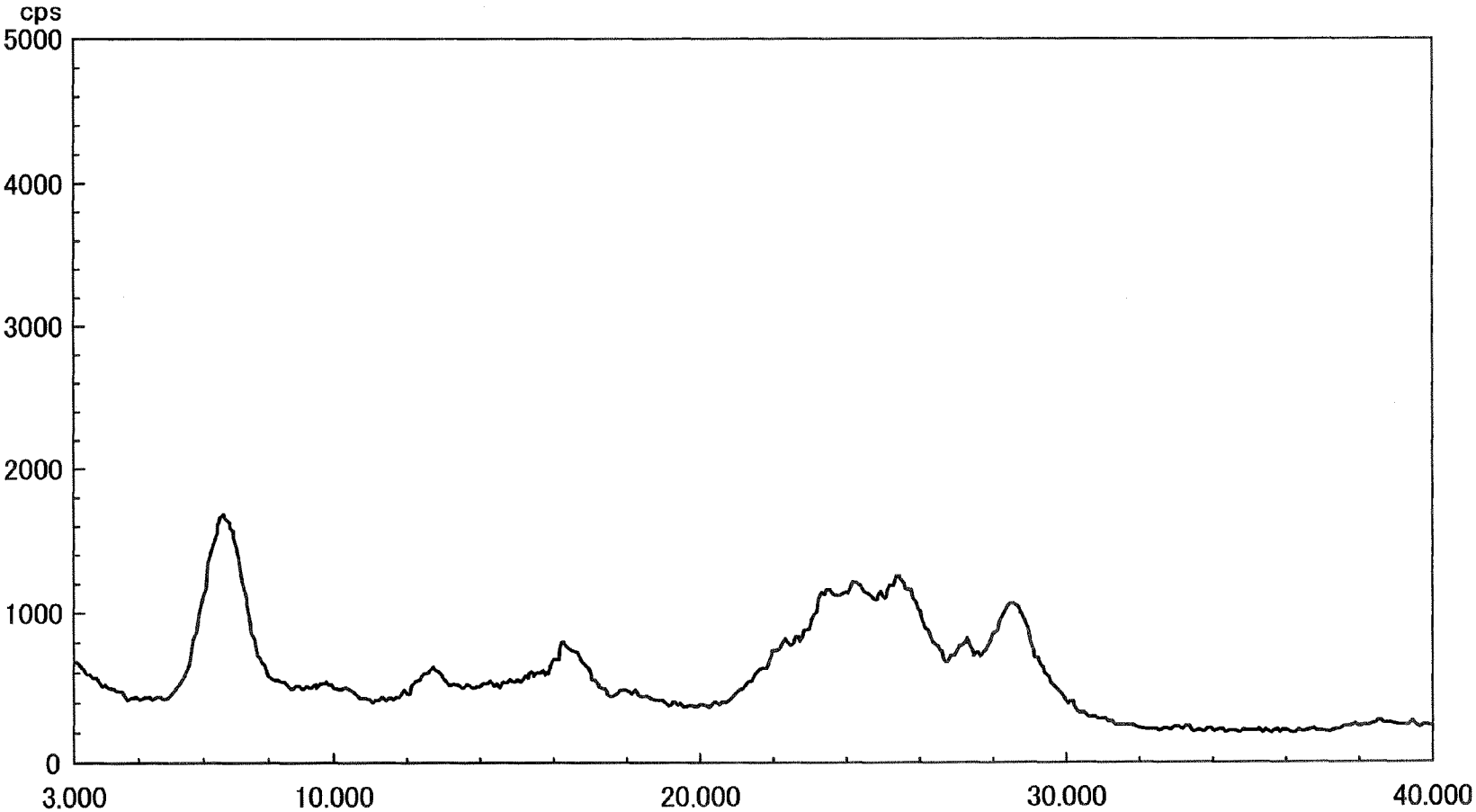
FIG. 12 is a graph illustrating an XD spectrum of dried powder of water paste (wet cake)

In addition, part of the water paste obtained in Synthesis Example 1 is dried for 2 days with a reduced pressure of 5 mm Hg at 80° C. to obtain titanyl phthalocyanine powder having a low crystalline property. X ray diffraction spectrum of the dried powder of the water paste is shown in FIG. 12.

Synthesis Example 2

Synthesis of Titanyl Phthalocyanine Having Crystal Form

A water paste of titanyl phthalocyanine pigment is synthesized in accordance with the method of Synthesis Example 1 of JOP 2004-83859 and crystal converted as follows to obtain titanyl phthalocyanine crystal having a primary particle diameter smaller than that of Synthesis Example 1:

Add 400 parts by weight of tetrahydrofuran to 60 parts of the water paste before crystal conversion obtained in Synthesis Example 1 and violently stir the resultant with HOMOMIXER (Mark 11f Model, manufactured by Kenis, Ltd.) at 2,000 rpm at room temperature; When the color of the paste changes from indigo to light blue (after about 20 minutes stirring), stop the stirring and immediately filter the resultant with a reduced pressure; Wash the crystal obtained on the filtering device with tetrahydrofuran to obtain a wet cake of the pigment; and dry the wet cake for 2 days at 70° C. with a reduced pressure of 5 mmHg to obtain 8.5 parts by weight of titanyl phthalocyanine crystal, which is Pigment No. 2. The raw material of Synthesis Example 2 does not contain a halogen containing compound. The density of the solid portion of the wet cake is 15% by weight. The amount of the crystal conversion solvent is 44 times in weight ratio based on the amount of the wet cake.

Dilute part of the titanyl phthalocyanine (water paste) before crystal conversion manufactured in Synthesis Example 1 with deionized water to obtain a 1% by weight solution; Scrape the solution with a copper net the surface of which is electric conductively treated; and observe the particle diameter of titanyl phthalocyanine with a transmission electron microscope (TEM) (H-9000NAR, manufactured by Hitachi Ltd.) with a magnifying power of 75,000. The average particle diameter is obtained as follows:

The TEM image as observed above is photographed as a TEM photograph. 30 titanyl phthalocyanine particles, which have a form similar to a needle, are arbitrarily selected in the TEM photograph and the major axis of each particle is measured. The arithmetical mean of the major axes of the 30 particles are calculated and determined as the average particle diameter. The average particle diameter of the water paste (wet cake) of Synthesis Example 1 as measured above is 0.06 μm.

In addition, titanyl phthalocyanine crystal just before filtration in Synthesis Example 1 and 2 is diluted with tetrahydrofuran to obtain a 1% by weight solution and observed by the same method as mentioned above. The average particle diameters obtained as described above are shown in Table 1. Titanyl phthalocyanine crystals manufactured in Synthesis Example 1 and 2 do not necessarily have the same crystal form. For example, there are forms similar to a triangle and a square. The longest diagonal of the crystal is measured as the major axis for calculation.

TABLE 1

| | Average particle size (μm) | Memo |
|---|---|---|
| Synthesis Example 1 (Pigment No. 1) | 0.31 | Contains particles having a large particle diameter of about 0.3 to about 0.4 μm |

TABLE 1-continued

| | Average particle size (μm) | Memo |
|---|---|---|
| Synthesis Example 2 (Pigment No. 2) | 0.12 | Sizes of crystal are almost uniform |

The Xray diffraction spectrum of Pigment No. 2 manufactured in Synthesis Example 2 is measured in the same method as mentioned above. As a result, the Xray diffraction spectrum thereof matches the spectrum of Pigment No. 1 manufactured in Synthesis Example 1.

Liquid Dispersion Manufacturing Example 1

A liquid dispersion 1 is prepared by using Pigment No. 1 manufactured in Synthesis Example 1 with the following composition under the following condition as a liquid of application for a charge generating layer.

| | |
|---|---|
| Titanyl phthalocyaninne pigment (Pigment No. 1) | 15 parts |
| Polyvinylbutyral (BX-1, manufactured by Sekisui Chemical Co., Ltd.) | 10 parts |
| 2-butanon | 280 parts |

The liquid dispersion 1 is prepared by: placing all of 2-butanon in which polyvinyl butyral is dissolved and Pigment No. 1 in a marketed bead mill diespering device with PSZ balls having a particle diameter of 0.5 mm; and dispersing the solution for 30 minutes with a rotation speed of at 1,200 rpm of the rotor.

Liquid Dispersion Manufacturing Example 2

A liquid dispersion 2 is prepared in the same manner as described in preparation of Liquid Dispersion Manufacturing Example 1 except that Pigment No. 1 for use in Liquid Dispersion Manufacturing Example 1 is replaced with Pigment No. 2 prepared in Synthesis Example 2.

Liquid Dispersion Manufacturing Example 3

A liquid dispersion 3 is prepared by filtering the liquid dispersion 1 prepared in Liquid Dispersion Manufacturing Example 1 with a cotton wind cartridge filer (TCW-1-CS, manufactured by Advantec Co., Ltd.) having an effective hole diameter of 1 μm. The filtration is performed using a pump with an increased pressure.

Liquid Dispersion Manufacturing Example 4

A liquid dispersion 4 is prepared in the same manner as described in preparation of Liquid Dispersion Manufacturing Example 3 except that the filter used therein is replaced with a cotton wind cartridge filter (TCW-3-CS, manufactured by Advantec Co., Ltd.) having an effective hole diameter of 3 μm.

Liquid Dispersion Manufacturing Example 5

A liquid dispersion 5 is prepared by using the following recipe under the following condition as liquid of application for a charge generating layer.

| | |
|---|---|
| Azo pigment represented by the following chemical structure: | 2 parts |

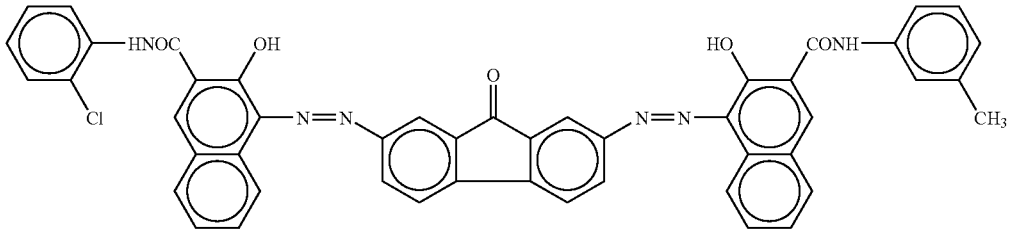

| | |
|---|---|
| Polyviny butyral (BX-1, manufactured by Sekisui Chemical Co., Ltd.) | |
| Cyclohexane | 250 parts |
| 2-butanone | 100 parts |

The liquid dispersions 5 is prepared by: placing all of the solvent in which polyvinyl butyral is dissolved and the azo pigments in a bead mill diespering device with PSZ balls having a particle diameter of 10 mm; and dispersing the solution for 7 days with a rotation speed of 85 rpm of the rotor.

Liquid Dispersion Manufacturing Example 6

A liquid dispersion 6 is prepared in the same manner as described in preparation of Liquid Dispersion Manufacturing Example 5 except that the azo pigment used in Liquid Dispersion Manufacturing Example 5 is changed to the azo pigment represented by the following chemical structure:

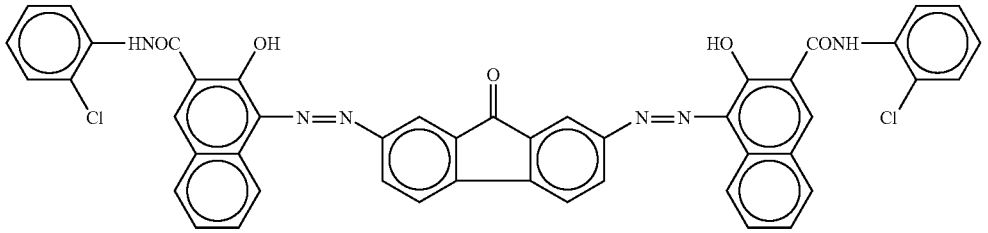

The particle size distributions of the pigment particles in liquid dispersions prepared as described above are manufactured by (CAPA-700, manufactured by Horiba Ltd.). The results are shown in Table 2.

TABLE 2

| | Average particle diameter (μm) | Standard deviation (μm) |
|---|---|---|
| Liquid dispersion 1 | 0.29 | 0.18 |
| Liquid dispersion 2 | 0.19 | 0.13 |
| Liquid dispersion 3 | 0.22 | 0.16 |
| Liquid dispersion 4 | 0.24 | 0.17 |
| Liquid dispersion 5 | 0.26 | 0.18 |
| Liquid dispersion 6 | 0.27 | 0.17 |

Image Bearing Member Manufacturing Example 1

A liquid of application for an intermediate layer having the following composition, a liquid of application for a charge generating layer and a liquid of application for a charge transport layer are applied to an aluminum drum (JIS 1050) having a diameter of 30 mm. Subsequent to drying, Image bearing member 1 (a layered image bearing member) having an intermediate layer having a thickness of 3.5 μm, a charge generating layer and a charge transport layer having a thickness of 25 μm.

The layer thickness of the charge generating layer is adjusted as follows: apply a liquid for a charge generating layer to a substrate having an aluminum drum substrate prepared beforehand around which a polyethylene terephthalate film is wound in the same manner as described for preparing Image bearing member 1. The transmission factor of the charge generating layer for light having a wavelength of 380 nm is measured by a marketed spectral photometer (UV-3100, manufactured by Shimazu Corporation) while comparing with polyethylene terephthalate on which a liquid for charge generating layer is not coated. The result of the transmission factor is 20%.

The transmission factor of the charge transport layer is measured in the same manner. The result for the charge transport layer having a thickness of 380 nm having the following composition is 83%.

Liquid of Application for Intermediate Layer

| | |
|---|---|
| Non-surface treated rutile type titanium oxide having an average particle diameter of 0.25 μm (CR-EL, manufactured by Ishihara Industry Co., Ltd.) | 112 parts |
| Alkyd resin (BECKOLITE M6401-50-S, manufactured by Dainippon Ink and Chemicals Incorporated, solid portion: 50%) | 33.6 parts |
| Melamine resin (SUPERBECAKMINE L121-60, manufactured by Dainippon Ink and Chemicals Incorporated, solid portion: 60%) | 18.7 parts |
| 2-butanone | 260 parts |

Liquid of Application for Charging Generating Layer

The liquid dispersion 1 is used.

| | |
|---|---|
| Liquid of Application for Charge Transport Layer Polycarbonate (TS2050, manufactured by Teijin Chemicals Ltd.) | 10 parts |
| Charge transport material represented by the following chemical structure: | 7 parts |

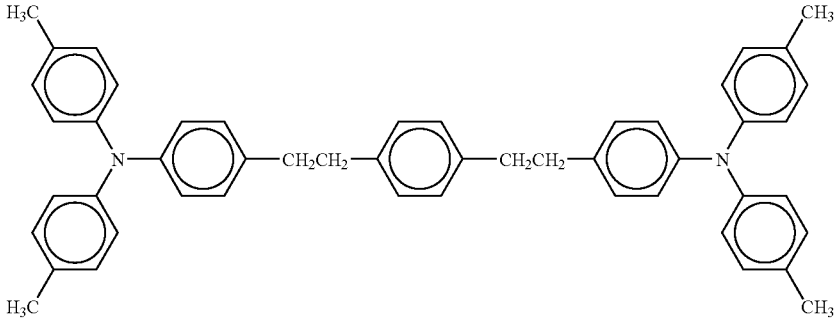

| | |
|---|---|
| Methylene chloride | 80 parts |

An intermediate layer is formed using the liquid of application mentioned above for intermediate layer on an aluminum board having a thickness of 1 mm in the same manner as described in manufacturing of the Image bearing member 1 using the liquid of application for intermediate layer. The spectroscopic reflection spectrum of the intermediate layer is measured by a marketed spectral photometer (UV-3100, manufactured by Shimazu Corporation). The absorption end (the upper limit of the wavelength of light which can be absorbed therein) of the intermediate layer is obtained from the spectroscopic reflection spectrum. The result of the absorption end of the titanium oxide mentioned above is about 410 nm.

Image Bearing Member Manufacturing Example 2

Image bearing member 2 is manufactured in the same manner as in Image Bearing Member Manufacturing Example 1 except that the liquid of application for intermediate layer used in Image Bearing Member Manufacturing Example 1 is changed to the following component.

| Liquid of Application for Intermediate Layer | |
|---|---|
| Surface treated rutile type titanium oxide | 112 parts |
| Alkyd resin (BECKOLITE M6401-50-S, manufactured by Dainippon Ink and Chemicals Incorporated, solid portion: 50%) | 33.6 parts |
| Melamine resin (SUPERBECAKMINE L-121-60, manufactured by Dainippon Ink and Chemicals Incorporated, solid portion: 60%) | 18.7 parts |
| 2-butanone | 260 parts |

The surface treated rutile type titanium oxide is obtained by surface-treating the non-surface treated rutile type titanium oxide used in Image Bearing Member Manufacturing Example 1 with siloxane having 2 weight % based on the weight of the non-surface treated rutile type titanium oxide.

An intermediate layer is formed using the liquid of application mentioned above for intermediate layer on an aluminum board having a thickness of 1 mm in the same manner as described in manufacturing of the image bearing member 2. The spectroscopic reflection spectrum of the intermediate layer is measured by a marketed spectral photometer (UV-3100, manufactured by Shimazu Corporation). The absorption end (the upper limit of the wavelength of light which can be absorbed therein) of the intermediate layer is obtained from the spectroscopic reflection spectrum. The result of the absorption end of the titanium oxide mentioned above is about 410 nm.

Image Bearing Member Manufacturing Example 3

Image bearing member 3 is manufactured in the same manner as in Image Bearing Member Manufacturing Example 1 except that the liquid of application for intermediate layer used in Image Bearing Member Manufacturing Example 1 is changed to the following component.

Liquid of Application for Intermediate Layer

| Liquid of Application for Intermediate Layer | |
|---|---|
| Non-surface treated zinc oxide (SAZEX #2000, manufactured by Sakai Chemical Industry Co., Ltd.) | 112 parts |
| Alkyd resin (BECKOLITE M6401-50-S, manufactured by Dainippon Ink and Chemicals Incorporated, solid portion: 50%) | 33.6 parts |
| Melamine resin (SUPERBECAKMINE L-121-60, manufactured by Dainippon Ink and Chemicals Incorporated, solid portion: 60%) | 18.7 parts |
| 2-butanone | 260 parts |

An inter mediate layer is formed using the liquid of application mentioned above for intermediate layer on an aluminum board having a thickness of 1 mm in the same manner as described in manufacturing of the image bearing member 3 using the liquid of application for intermediate layer. The spectroscopic reflection spectrum of the intermediate layer is measured by a marketed spectral photometer (UV-3100, manufactured by Shimazu Corporation). The absorption end (the upper limit of the wavelength of light which can be absorbed therein) of the intermediate layer is obtained from the spectroscopic reflection spectrum. The result of the absorption end of the titanium oxide mentioned above is about 388 nm.

Image Bearing Member Manufacturing Example 4

Image bearing member 4 is manufactured in the same manner as in Image Bearing Member Manufacturing Example 1 except that the layer thickness of the charge generating layer in Image Bearing Member Manufacturing Example 1 is changed such that the transmission factor is 12% for light having a wavelength of 380 nm.

Image Bearing Member Manufacturing Example 5

Image bearing member 5 is manufactured in the same manner as in Image Bearing Member Manufacturing Example 1 except that the layer thickness of the charge generating layer in Image Bearing Member Manufacturing Example 1 is changed such that the transmission factor is 8% for light having a wavelength of 380 nm.

Image Bearing Member Manufacturing Example 6

Image bearing member 6 is manufactured in the same manner as in Image Bearing Member Manufacturing Example 2 except that the layer thickness of the charge generating layer in Image Bearing Member Manufacturing Example 2 is changed such that the transmission factor is 12% for light having a wavelength of 380 nm.

Image Bearing Member Manufacturing Example 7

Image bearing member 7 is manufactured in the same manner as in Image Bearing Member Manufacturing Example 2 except that the layer thickness of the charge generating layer in Image Bearing Member Manufacturing Example 2 is changed such that the transmission factor is 8% for light having a wavelength of 380 nm.

Image Bearing Member Manufacturing Example 8

Image bearing member 8 is manufactured in the same manner as in Image Bearing Member Manufacturing Example 1 except that the charge transport material in Image Bearing Member Manufacturing Example 1 is changed to the material represented by the following chemical structure:

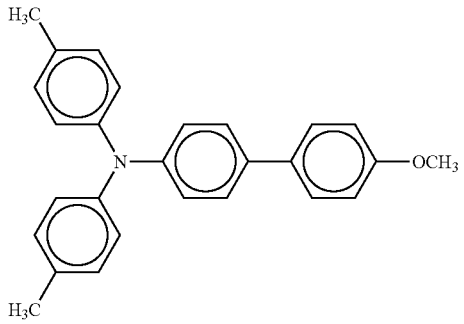

The transmission factor of the charge transport layer in Image Bearing Member Manufacturing Example 8 is 3% when measured and evaluated in the same manner as described above.

Image Bearing Member Manufacturing Example 9

Image bearing member 9 is manufactured in the same manner as in Image Bearing Member Manufacturing Example 2 except that the charge transport material in Image Bearing Member Manufacturing Example 2 is changed to the material represented by the following chemical structure:

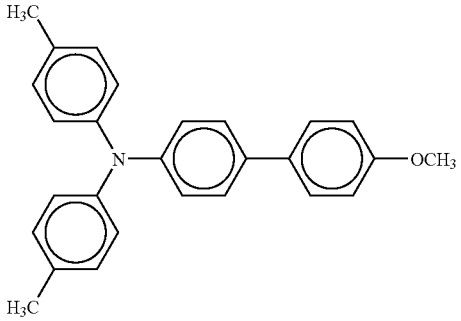

Image Bearing Member Manufacturing Example 10

Image bearing member 10 is manufactured in the same manner as in Image Bearing Member Manufacturing Example 3 except that the layer thickness of the charge generating layer in Image Bearing Member Manufacturing Example 3 is changed such that the transmission factor is 12% for light having a wavelength of 380 nm.

Image Bearing Member Manufacturing Example 11

Image bearing member 11 is manufactured in the same manner as in Image Bearing Member Manufacturing Example 3 except that the layer thickness of the charge generating layer in Image Bearing Member Manufacturing Example 3 is changed such that the transmission factor is 8% for light having a wavelength of 380 nm.

Image Bearing Member Manufacturing Example 12

Image bearing member 12 is manufactured in the same manner as in Image Bearing Member Manufacturing Example 3 except that the charge transport material in Image Bearing Member Manufacturing Example 3 is changed to the material represented by the following chemical structure:

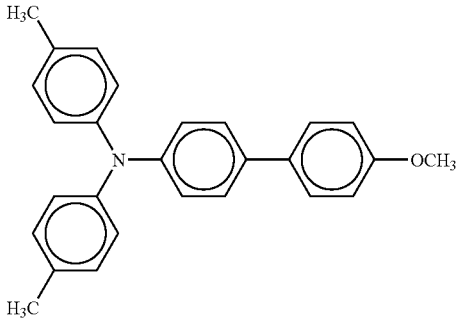

The transmission factor of the charge transport layer in Image Bearing Member Manufacturing Example 12 is 3% when measured and evaluated in the same manner as described above.

Example 1

The image bearing member 1 is implemented in an image forming apparatus as shown in FIG. 8. The irradiation light source is a semi-conductor laser (image writing by a polygon mirror) emitting light having a wavelength of 780 nm. A scortron charger is used as the charging device. A transfer belt is used as the transfer device. A 380 nm LED, manufactured by Nichia Corporation, is as the discharging light source. The process conditions before the test of 50,000 continuous printing of a chart in which characters corresponding to about 6% based on the total area of an A4 sheet are uniformly written are set as follows. Charging device of image bearing member (non irradiated portion): −900V Developing bias: −650 V (negative/positive development) Surface voltage after discharging (for non-irradiated portion by writing light): −100 V Evaluation is made based on the measurement of the voltage at irradiated portion on the image bearing member before and after the 50,000 image printing.

The surface voltage of the non-irradiated portions at the development portion and the irradiation voltage are measured for solid printing by the semi-conductor laser after −900 V charging on the image bearing member with a surface voltometer placed on the developing position shown in FIG. 8. The result is shown in Table 3.

Comparative Example 1

The evaluation is made in the same manner as in Example 1 except that a 502 nm LED with a half value width of 15 nm (manufactured by Seiwa Electric Mfg. Co., Ltd.) is used instead. The amount of discharging light is adjusted such that the surface voltage of the image bearing member after discharging is the same as in Example 1. The result is shown in Table 3. The transmission factor of the charge generating layer is 70% for the discharging light used for the image bearing member and of the charge transport layer is 98%.

Comparative Example 2

The evaluation is made in the same manner as in Example 1 except that a 591 nm LED with a half value width of 15 nm (manufactured by Rohm Co., Ltd.) is used instead. The amount of discharging light is adjusted such that the surface voltage of the image bearing member after discharging is the same as in Example 1. The result is shown in Table 3. The transmission factor of the charge generating layer is 70% and of the charge transport layer is 98% for the discharging light used for the image bearing member.

Comparative Example 3

The evaluation is made in the same manner as in Example 1 except that a 630 nm LED with a half value width of 20 nm (manufactured by Rohm Co., Ltd.) is used instead. The amount of discharging light is adjusted such that the surface voltage of the image bearing member after discharging is the same as in Example 1. The result is shown in Table 3. The transmission factor of the charge generating layer is 53% and of the charge transport layer is 98% for the discharging light used for the image bearing member.

Comparative Example 4

The evaluation is made in the same manner as in Example 1 except that a fluorescent light having a luminescent spectrum shown in FIG. 1 is used instead. The amount of discharging light is adjusted such that the surface voltage of the image bearing member after discharging is the same as in Example 1. The result is shown in Table 3.

Comparative Example 5

The evaluation is made in the same manner as in Example 1 except that a 380 nm LED (manufactured by Nichia Corporation fluorescent light) and a 630 nm LED with a half value width of 20 nm (manufactured by Rohm Co., Ltd.) are used as the discharging light source. The two discharging light sources simultaneously irradiate the image bearing member in almost the same amount of light. The amount of discharging light is adjusted such that the surface voltage of the image bearing member after discharging is the same as in Example 1. The result is shown in Table 3.

Example 2

The evaluation is made in the same manner as in Example 1 except that the image bearing member 2 is used instead of the image bearing member 1. The result is shown in Table 3.

Example 3

The evaluation is made in the same manner as in Example 1 except that the image bearing member 4 is used instead of the image bearing member 1. The result is shown in Table 3.

Example 4

The evaluation is made in the same manner as in Example 1 except that the image bearing member 5 is used instead of the image bearing member 1. The result is shown in Table 3.

Example 5

The evaluation is made in the same manner as in Example 1 except that the image bearing member 6 is used instead of the image bearing member 1. The result is shown in Table 3.

Example 6

The evaluation is made in the same manner as in Example 1 except that the image bearing member 7 is used instead of the image bearing member 1. The result is shown in Table 3.

Example 7

The evaluation is made in the same manner as in Example 1 except that the image bearing member 8 is used instead of the image bearing member 1. The result is shown in Table 3.

Example 8

The evaluation is made in the same manner as in Example 1 except that the image bearing member 9 is used instead of the image bearing member 1. The result is shown in Table 3.

TABLE 3

| | Discharging light wavelength (nm) | Initial: Surface voltage at non-irradiated portion (−V) | Initial: Surface voltage at irradiated portion (−V) | After 50,000 image printing: Surface voltage at non-irradiated portion (−V) | After 50,000 image printing: Surface voltage at irradiated portion (−V) |
|---|---|---|---|---|---|
| Example 1 | 380 | 900 | 115 | 900 | 135 |
| Comparative Example 1 | 502 | 900 | 115 | 900 | 175 |
| Comparative Example 2 | 591 | 900 | 115 | 900 | 180 |
| Comparative Example 3 | 630 | 900 | 115 | 900 | 185 |
| Comparative Example 4 | White light | 900 | 115 | 900 | 170 |
| Comparative Example 5 | 380 and 630 | 900 | 115 | 900 | 175 |
| Example 2 | 380 | 900 | 115 | 900 | 150 |
| Example 3 | 380 | 900 | 110 | 900 | 130 |
| Example 4 | 380 | 900 | 105 | 900 | 160 |
| Example 5 | 380 | 900 | 110 | 900 | 145 |
| Example 6 | 380 | 900 | 105 | 900 | 180 |
| Example 7 | 380 | 900 | 110 | 900 | 150 |
| Example 8 | 380 | 900 | 110 | 900 | 165 |

As seen in Table 3, when the wavelength of discharging light is set to be 380 nm and the discharging light is optically absorbed by titanium oxide contained in the intermediate layer as in Example 1, the rise of the voltage at irradiated portions after repetitive use is relatively small in comparison with those in the cases of the discharging light on the long wavelength side which is not absorbed by the titanium oxide as in Comparative Examples 1 to 3.

In addition, the effect of the discharging light having a wide luminescence distribution and containing light having a wavelength of not less than 410 nm as in Comparative Example 4 is not as clear as in Examples. Furthermore, it is found that, when two light sources having different irradiation wavelengths are used as in Comparative Example 5, the effect of discharging on the short wavelength side is reduced.

The effect of reducing the rise of the residual voltage is relatively small in Example 2 in which the surface treated titanium oxide is contained in the intermediate layer in comparison with the case in which the non-surface treated titanium oxide is used as in Example 1.

It is also found that when the transmission factor of the charge generating layer for discharging light is less than 10% as in Examples 4 and 6, the rise of the voltage at the irradiated portions after repetitive use is relatively large in comparison with the case in which the transmission factor is not less than 10% as in Examples 1, 2, 3 and 5.

It is also found that when the transmission factor of the charge transport layer for discharging light is less than 30% as in Examples 7 and 8, the rise of the voltage at the irradiated portions after repetitive use is relatively large in comparison with the case in which the transmission factor is not less than 30% as in Examples 1 and 2.

Example 9

The evaluation is made in the same manner as in Example 1 except that the image bearing member 3 is used instead of the image bearing member 1. The result is shown in Table 4.

Comparative Example 6

The evaluation is made in the same manner as in Example 9 except that a 502 nm LED with a half value width of 15 nm (manufactured by Seiwa Electric Mfg. Co., Ltd.) is used instead. The amount of discharging light is adjusted such that the surface voltage of the image bearing member after discharging is the same as in Example 9. The result is shown in Table 4. The transmission factor of the charge generating layer is 70% and of the charge transport layer is 98% for the discharging light used for the image bearing member.

Comparative Example 7

The evaluation is made in the same manner as in Example 9 except that a 591 nm LED with a half value width of 15 nm (manufactured by Rohm Co., Ltd.) is used instead. The amount of discharging light is adjusted such that the surface voltage of the image bearing member after discharging is the same as in Example 9. The result is shown in Table 4. The transmission factor of the charge generating layer is 70% and of the charge transport layer is 98% for the discharging light used for the image bearing member.

Comparative Example 8

The evaluation is made in the same manner as in Example 9 except that a 630 nm LED with a half value width of 20 nm (manufactured by Rohm Co., Ltd.) is used instead. The amount of discharging light is adjusted such that the surface voltage of the image bearing member after discharging is the same as in Example 9. The result is shown in Table 4. The transmission factor of the charge generating layer is 53% and of the charge transport layer is 98% for the discharging light used for the image bearing member.

Comparative Example 9

The evaluation is made in the same manner as in Example 9 except that a fluorescent light having a luminescent spectrum shown in FIG. 1 is used instead. The amount of discharging light is adjusted such that the surface voltage of the image bearing member after discharging is the same as in Example 9. The result is shown in Table 4.

Comparative Example 10

The evaluation is made in the same manner as in Example 9 except that a 380 nm LED (manufactured by Nichia Corporation fluorescent light) and a 630 nm LED with a half value width of 20 nm (manufactured by Rohm Co., Ltd.) are used as the discharging light source. The two discharging light sources simultaneously irradiate the image bearing member in almost the same amount of light. The amount of discharging light is adjusted such that the surface voltage of the image bearing member after discharging is the same as in Example 9. The result is shown in Table 4.

Example 10

The evaluation is made in the same manner as in Example 9 except that the image bearing member 10 is used instead of the image bearing member 3. The result is shown in Table 4.

Example 11

The evaluation is made in the same manner as in Example 9 except that the image bearing member 11 is used instead of the image bearing member 3. The result is shown in Table 4.

Example 12

The evaluation is made in the same manner as in Example 9 except that the image bearing member 12 is used instead of the image bearing member 3. The result is shown in Table 4.

TABLE 4

| | Discharging light wavelength (nm) | Initial: Surface voltage at non-irradiated portion (−V) | Initial: Surface voltage at irradiated portion (−V) | After 50,000 image printing: Surface voltage at non-irradiated portion (−V) | After 50,000 image printing: Surface voltage at irradiated portion (−V) |
|---|---|---|---|---|---|
| Example 9 | 380 | 900 | 120 | 900 | 145 |
| Comparative Example 6 | 502 | 900 | 120 | 900 | 185 |
| Comparative Example 7 | 591 | 900 | 120 | 900 | 190 |
| Comparative Example 8 | 630 | 900 | 120 | 900 | 195 |
| Comparative Example 9 | White light | 900 | 120 | 900 | 180 |
| Comparative Example 10 | 380 and 630 | 900 | 120 | 900 | 185 |
| Example 10 | 380 | 900 | 110 | 900 | 135 |
| Example 11 | 380 | 900 | 100 | 900 | 175 |
| Example 12 | 380 | 900 | 110 | 900 | 170 |

As seen in Table 4, when the wavelength of discharging light is set to be 380 nm and the discharging light is optically absorbed by titanium oxide contained in the intermediate layer as in Example 9, the rise of the voltage at irradiated portions after repetitive use is relatively small in comparison with those in the cases of the discharging light on the long wavelength side which is not absorbed by the titanium oxide as in Comparative Examples 6 to 8.

In addition, the effect of the discharging light having a wide luminescence distribution and containing light having a wavelength of not less than 388 nm as in Comparative Example 7 is not as clear as in Examples. Furthermore, it is found that, when two light sources having different irradiation wavelengths are used as in Comparative Example 10, the effect of discharging on the short wavelength side is reduced.

It is also found that when the transmission factor of the charge generating layer for discharging light is less than 10% as in Example 11, the rise of the voltage at the irradiated portions after repetitive use is relatively large in comparison with the case in which the transmission factor is not less than 10% as in Examples 9 and 10.

It is also found that when the transmission factor of the charge transport layer for discharging light is less than 30% as in Example 12, the rise of the voltage at the irradiated portions after repetitive use is relatively large in comparison with the case in which the transmission factor is not less than 30% as in Example 9.

Image Bearing Member Manufacturing Example 13

Image bearing member 13 is manufactured in the same manner as in Image Bearing Member Manufacturing Example 1 except that the liquid dispersions 2 is used as the liquid of application for charge generating layer. The layer thickness of the charge generating layer is adjusted such that the transmission factor thereof for discharging light is 20%.

Image Bearing Member Manufacturing Example 14

Image bearing member 14 is manufactured in the same manner as in Image Bearing Member Manufacturing Example 13 except that the layer thickness of the charge generating layer in Image Bearing Member Manufacturing Example 13 is changed such that the transmission factor is 12% for light having a wavelength of 380 nm.

Image Bearing Member Manufacturing Example 15

Image bearing member 15 is manufactured in the same manner as in Image Bearing Member Manufacturing Example 13 except that the layer thickness of the charge generating layer in Image Bearing Member Manufacturing Example 13 is changed such that the transmission factor is 8% for light having a wavelength of 380 nm.

Image Bearing Member Manufacturing Example 16

Image bearing member 16 is manufactured in the same manner as in Image Bearing Member Manufacturing Example 13 except that the charge transport material in Image Bearing Member Manufacturing Example 13 is changed to the material represented by the following chemical structure:

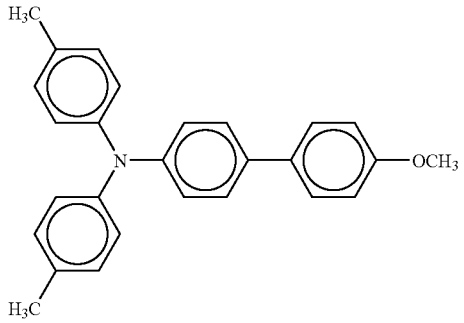

The transmission factor of the charge transport layer in Image Bearing Member Manufacturing Example 16 is 3% when measured and evaluated in the same manner as described above.

Example 13

The evaluation is made in the same manner as in Example 1 except that the image bearing member 13 is used instead of the image bearing member 1. The result is shown in Table 5.

Comparative Example 11

The evaluation is made in the same manner as in Comparative Example 1 except that the image bearing member 13 is used instead of the image bearing member 1. The result is shown in Table 5. The transmission factor of the charge generating layer is 70% and of the charge transport layer is 98% for the discharging light used for the image bearing member.

Comparative Example 12

The evaluation is made in the same manner as in Comparative Example 2 except that the image bearing member 13 is used instead of the image bearing member 1. The result is shown in Table 5. The transmission factor of the charge generating layer is 70% and of the charge transport layer is 98% for the discharging light used for the image bearing member.

Comparative Example 13

The evaluation is made in the same manner as in Comparative Example 3 except that the image bearing member 13 is used instead of the image bearing member 1. The result is shown in Table 5. The transmission factor of the charge generating layer is 53% and of the charge transport layer is 98% for the discharging light used for the image bearing member.

Comparative Example 14

The evaluation is made in the same manner as in Comparative Example 4 except that the image bearing member 13 is used instead of the image bearing member 1. The result is shown in Table 5.

Comparative Example 15

The evaluation is made in the same manner as in Comparative Example 5 except that the image bearing member 13 is used instead of the image bearing member 1. The result is shown in Table 5.

Example 14

The evaluation is made in the same manner as in Example 13 except that the image bearing member 14 is used instead of the image bearing member 13. The result is shown in Table 5.

Example 15

The evaluation is made in the same manner as in Example 13 except that the image bearing member 15 is used instead of the image bearing member 13. The result is shown in Table 5.

Example 16

The evaluation is made in the same manner as in Example 13 except that the image bearing member 16 is used instead of the image bearing member 13. The result is shown in Table 5.

TABLE 5

| | | Initial | | After 50,000 image printing | |
|---|---|---|---|---|---|
| | Discharging light wavelength (nm) | Surface voltage at non-irradiated portion (−V) | Surface voltage at irradiated portion (−V) | Surface voltage at non-irradiated portion (−V) | Surface voltage at irradiated portion (−V) |
| Example 13 | 380 | 900 | 105 | 900 | 125 |
| Comparative Example 11 | 502 | 900 | 105 | 900 | 165 |
| Comparative Example 12 | 591 | 900 | 105 | 900 | 170 |
| Comparative Example 13 | 630 | 900 | 105 | 900 | 175 |
| Comparative Example 14 | White light | 900 | 105 | 900 | 160 |
| Comparative Example 15 | 380 and 630 | 900 | 105 | 900 | 165 |
| Example 14 | 380 | 900 | 100 | 900 | 120 |

TABLE 5-continued

| | Discharging light wavelength (nm) | Initial: Surface voltage at non-irradiated portion (−V) | Initial: Surface voltage at irradiated portion (−V) | After 50,000 image printing: Surface voltage at non-irradiated portion (−V) | After 50,000 image printing: Surface voltage at irradiated portion (−V) |
|---|---|---|---|---|---|
| Example 15 | 380 | 900 | 95 | 900 | 150 |
| Example 16 | 380 | 900 | 100 | 900 | 145 |

As seen in Table 5, when the wavelength of discharging light is set to be 380 nm and the discharging light is optically absorbed by titanium oxide as in Example 13, the rise of the voltage at irradiated portions after repetitive use is relatively small in comparison with those in the cases of the discharging light on the long wavelength side which is not absorbed by the titanium oxide as in Comparative Examples 11 to 13.

In addition, the effect of the discharging light having a wide luminescence distribution and containing light having a wavelength of not less than 410 nm as in Comparative Example 14 is not as clear as in Examples. Furthermore, it is found that, when two light sources having different irradiation wavelengths are used as in Comparative Example 15, the effect of discharging on the short wavelength side is reduced.

When the voltage at the irradiated portion of Example 1 shown in Table 3 is compared with that of Example 13 shown in Table 5, it is found that the sensitivity is increased by making the charge generating material fine.

It is also found that when the transmission factor of the charge generating layer for discharging light is less than 10% as in Example 15, the rise of the voltage at the irradiated portions after repetitive use is relatively large in comparison with the case in which the transmission factor is not less than 10% as in Examples 13 and 14.

It is also found that when the transmission factor of the charge transport layer for discharging light is less than 30% as in Example 16, the rise of the voltage at the irradiated portions after repetitive use is relatively large in comparison with the case in which the transmission factor is not less than 30% as in Example 13.

Image Bearing Member Manufacturing Example 17

Image bearing member 17 is manufactured in the same manner as in Image Bearing Member Manufacturing Example 1 except that the liquid dispersions 3 is used instead of the liquid dispersion 1. The layer thickness of the charge generating layer is adjusted such that the transmission factor thereof for discharging light is 20%.

Image Bearing Member Manufacturing Example 18

Image bearing member 18 is manufactured in the same manner as in Image Bearing Member Manufacturing Example 1 except that the liquid dispersions 4 is used instead of the liquid dispersion 1. The layer thickness of the charge generating layer is adjusted such that the transmission factor thereof for discharging light is 20%.

Example 17

The evaluation is made in the same manner as in Example 1 except that the image bearing member 17 is used instead of the image bearing member 1. The background fouling is evaluated for white solid image output after the 50,000 image outputs. The result is shown in Table 6 with those of Examples 1 and 13.

Example 18

The evaluation is made in the same manner as in Example 1 except that the image bearing member 18 is used instead of the image bearing member 1. The background fouling is evaluated for white solid image output after the 50,000 image outputs. The result is shown in Table 6.

The background fouling is evaluated with scaling by the number and the size of black spots on the background portion. The scaling is from 1 to 4, in which "excellent" is rated as E, "good" is rated as G, "fair" is rated as F and "bad" is rated as B.

TABLE 6

| | Initial: Surface voltage at non-irradiated portion (−V) | Initial: Surface voltage at irradiated portion (−V) | After 50,000 image printing: Surface voltage at non-irradiated portion (−V) | After 50,000 image printing: Surface voltage at irradiated portion (−V) | Background fouling evaluation |
|---|---|---|---|---|---|
| Example 1 | 900 | 115 | 90 | 135 | F or B |
| Example 13 | 900 | 105 | 900 | 125 | E |
| Example 17 | 900 | 105 | 900 | 125 | E |
| Example 18 | 900 | 105 | 900 | 130 | G |

As seen in Table 6, it is found that, when the average particle diameter in the liquid of application for charge generating layer is not greater than 0.25 μm as in Examples 13 to 18, the surface voltage at the irradiated portion in the initial state of the image bearing member can be reduced and the occurrence of background fouling can be restrained after repetitive use without having an adverse impact on the rise of the irradiated portions.

Image Bearing Member Manufacturing Example 19

Image bearing member 19 is manufactured in the same manner as in Example 1 except that the layer thickness of the charge generating layer is set to be 22 μm and the liquid of application for protective layer having the following recipe is coated and dried on the charge transport layer to obtain a protective layer having a thickness of 3 μm. The transmission factor of the protective layer formed not on the image bearing member but on polyethylene terephthalate film is measured by spectroscopic photometer at 405 nm. The result of the transmission factor is 98%. The transmission factor of the charge transport layer is 98%.

| | |
|---|---|
| Liquid of Application for Protective Layer Polycarbonate (TS20507, manufactured by Teijin Chemicals Ltd.) | 10 parts |
| Charge transport material represented by the following chemical structure: | 7 parts |

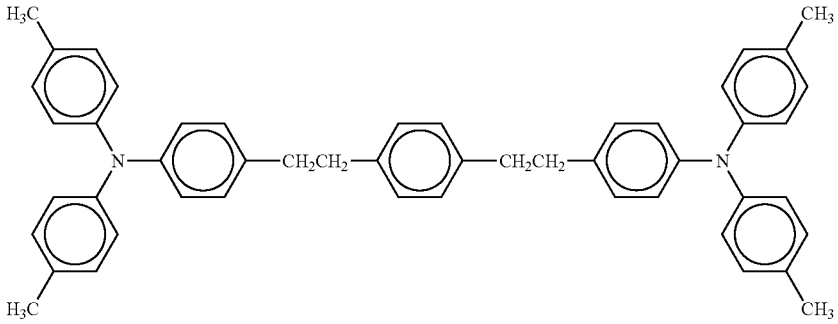

| | |
|---|---|
| Aluminum particulates (specific resistance: $2.5 \times 10^{12}$ Ω · cm, average primary particle diameter: 0.4 μm) | 4 parts |
| Cyclohexanone | 500 parts |
| Tetrahydrofuran | 150 parts |

Image Bearing Member Manufacturing Example 20

Image bearing member 20 is manufactured in the same manner as in Image Bearing Member Manufacturing Example 19 except that the aluminum particulates in the liquid of application for protective layer in Image Bearing Member Manufacturing Example 19 is changed to the following. The transmission factor of the protective layer is 95%.

| | |
|---|---|
| Titanium oxide particulate (specific resistance: $1.5 \times 10^{10}$ Ω · cm, average primary particle diameter: 0.5 μm) | 4 parts |

Image Bearing Member Manufacturing Example 21

Image bearing member 21 is manufactured in the same manner as in Image Bearing Member Manufacturing Example 19 except that the aluminum particulates in the liquid of application for protective layer in Image Bearing Member Manufacturing Example 19 is changed to the following. The transmission factor of the protective layer is 93%.

| | |
|---|---|
| Powder of tin oxide and anthimony oxide (specific resistance: $10^{6}$ Ω · cm, average primary particle diameter: 0.4 μm) | 4 parts |

Image Bearing Member Manufacturing Example 22

Image bearing member 22 is manufactured in the same manner as in Image Bearing Member Manufacturing Example 19 except that the liquid of application for protective layer in Image Bearing Member Manufacturing Example 19 is changed to the following. The transmission factor of the protective layer is 90%.

Liquid of Application for Protective Layer

| | |
|---|---|
| Charge transport material represented by the following chemical structure: (weight averge molecular weight: about 140,000) | 17 parts |

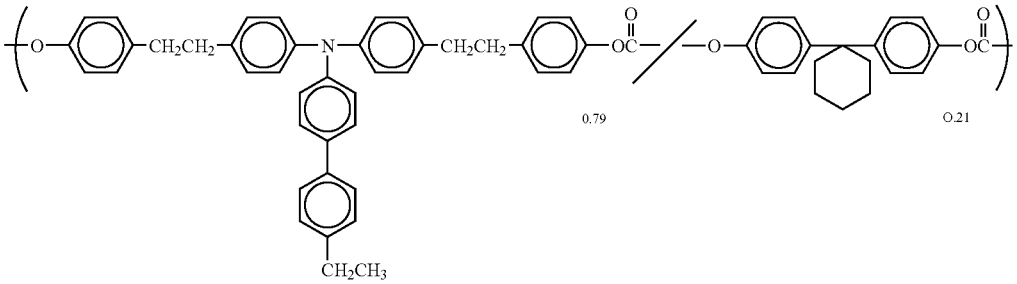

| | |
|---|---|
| Aluminum particulates (specific resistance: $2.5 \times 10^{12}$ Ω · cm, average primary particle diameter: 0.4 μm) | 4 parts |
| Cyclohexanone | 500 parts |
| Tetrahydrofuran | 150 parts |

Image Bearing Member Manufacturing Example 23

Image bearing member 23 is manufactured in the same manner as in Image Bearing Member Manufacturing Example 19 except that the liquid of application for protective layer in Image Bearing Member Manufacturing Example 19 is changed to the following. The transmission factor of the protective layer is 38%.

| | |
|---|---|
| Liquid of Application for Protective Layer Methyltrimethoxysilane | 100 parts |
| 3% acetic acid | 20 parts |
| Charge transport material represented by the following chemical | 35 parts |

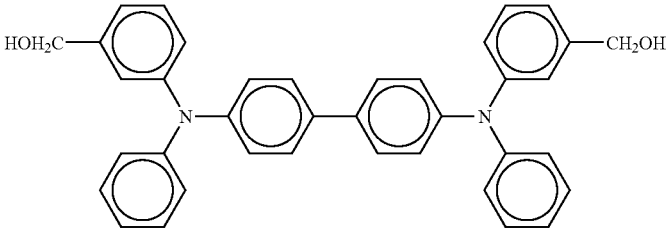

| | |
|---|---|
| structure: (weight averge molecular weight: about 140,000) | |
| Anti-oxidant agent (SANOL LS2626, manufactured by Sankyo Unite Industry Co., Ltd.) | 1 part |
| Curing agent (dibutyl tin acetate) | 1 part |
| 2-propanol | 200 parts |

Image Bearing Member Manufacturing Example 24

Image bearing member 24 is manufactured in the same manner as in Image Bearing Member Manufacturing Example 19 except that the liquid of application for protective layer in Image Bearing Member Manufacturing Example 19 is changed to the following. The transmission factor of the protective layer is 35%.

| | |
|---|---|
| Liquid of Application for Protective Layer Methyltrimethoxysilane | 100 parts |
| 3% acetic acid | 20 parts |
| Charge transport material represented by the following chemical structure: | 35 parts |

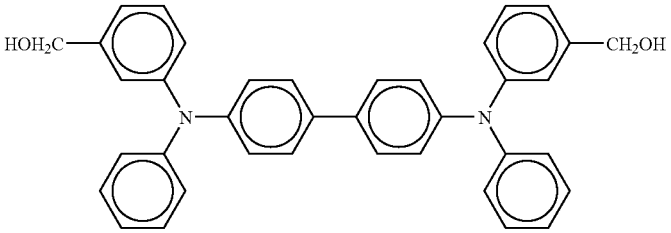

| | |
|---|---|
| Aluminum particulates (specific resistance: $2.5 \times 10^{12}$ Ω · cm, average primary particle diameter: 0.4 μm) | 15 parts |
| Anti-oxidant agent (SANOL LS2626, manufactured by Sankyo Unite Industry Co., Ltd.) | 1 part |
| Polycarbonate compound (BYK P104, manufactured by Byk Chemie) | 0.4 parts |
| Curing agent (dibutyl tin acetate) | 1 part |
| 2-propanol | 200 parts |

Image Bearing Member Manufacturing Example 25

Image bearing member 25 is manufactured in the same manner as in Image Bearing Member Manufacturing Example 19 except that the liquid of application for protective layer in Image Bearing Member Manufacturing Example 19 is changed to the following. The transmission factor of the protective layer is 72%.

| | |
|---|---|
| Liquid of Application for Protective Layer<br>Radical polymeric monomer having at least 3 functional groups which does not have a charge transport structure (trimetyhlol propane triacrylate: KAYARAD TAMPTA, manufactured by Nippon Kayaku Co., Ltd.) (molecular weight: 296, number of functional groups: 3, molecular weight/number of functional groups: 99) | 10 parts |

-continued

| | |
|---|---|
| Radical polymeric compound having a functional group and a charge transport structure representd by the following chemical strucuture: (No. 54 compound illustrated above) | 10 parts |
| Optical polymerization initiator (1-hydroxy-cyclohexyl-phenyl-ketone: ILUGACURE 184, manufactured by Ciba Specialty Chemicals) | 1 part |
| Tetrahydrofuran | 100 parts |

The protective layer is cured after 20 minute natural drying after spraying coating by irradiation under the condition of metal halide lamp: 160 W/cm, irradiation intensity: 500 mW/cm$^2$ and irradiation time: 60 seconds.

Image Bearing Member Manufacturing Example 26

Image bearing member 26 is manufactured in the same manner as in Image Bearing Member Manufacturing Example 25 except that the radical polymeric monomer having at least 3 functional groups which does not have a charge transport structure is changed to the following radical polymeric monomer. The transmission factor of the protective layer is 70%.

| | |
|---|---|
| Radical polymeric monomer having at least 3 functional groups which does not have a charge transport structure (penta erythritol tetraacrylate, SR-295, manufactured by Sartomer Company Inc.) (molecular weight: 352, number of functional groups: 4, molecular weight/number of functional groups: 88) | 10 parts |

Image Bearing Member Manufacturing Example 27

Image bearing member 27 is manufactured in the same manner as in Image Bearing Member Manufacturing Example 25 except that the radical polymeric monomer having at least 3 functional groups which does not have a charge transport structure is changed to the following radical polymeric monomer having two functional groups which does not have a charge transport structure. The transmission factor of the protective layer is 71%.

| | |
|---|---|
| Radical polymeric monomer having two functional groups which does not have a charge transport structure (1,6-hexanediol diacrylate, manufactured by Wako Pure Chemical Indutries, Ltd.) (molecular weight: 226, number of functional groups: 2, molecular weight/number of functional groups: 113) | 10 parts |

Image Bearing Member Manufacturing Example 28

Image bearing member 28 is manufactured in the same manner as in Image Bearing Member Manufacturing Example 25 except that the radical polymeric monomer having at least 3 functional groups which does not have a charge transport structure is changed to the following radical polymeric monomer. The transmission factor of the protective layer is 72%.

| | |
|---|---|
| Radical polymeric monomer having at least 3 functional groups which does not have a charge transport structure (caprolactone modified dipenta erythritol hexaacrylate (KAYARAD DPCA-120, manufactued by Nippon Kayakku Co., Ltd.) (molecular weight: 1, 947, number of functional groups: 6, molecular weight/number of functional groups: 325) | 10 carts |

Image Bearing Member Manufacturing Example 29

Image bearing member 29 is manufactured in the same manner as in Image Bearing Member Manufacturing Example 25 except that the Radical polymeric compound having a functional group and a charge transport structure is changed to the radical polymeric monomer having two functional groups and a charge transport structure represented by the following chemical structure. The transmission factor of the protective layer is 2%.

Image Bearing Member Manufacturing Example 30

Image bearing member 30 is manufactured in the same manner as in Image Bearing Member Manufacturing Example 25 except that the liquid of application for protective layer is changed to the following recipe. The transmission factor of the protective layer is 72%.

Liquid of Application for Protective Layer

| | |
|---|---|
| Radical polymeric monomer having at least 3 functional groups which does not have a charge transport structure (trimetyhlol propane triacrylate: KAYAD TAMPTA, manufactured by Nippon Kayaku Co., Ltd.) (molecular weight: 296, number of functional groups: 3, molecular weight/number of functional groups: 99) | 6 parts |
| Radical polymeric compound having a functional group and a charge transport structure representd by the following chemical strucuture: (No, 54 compound illustrated above) | 14 parts |

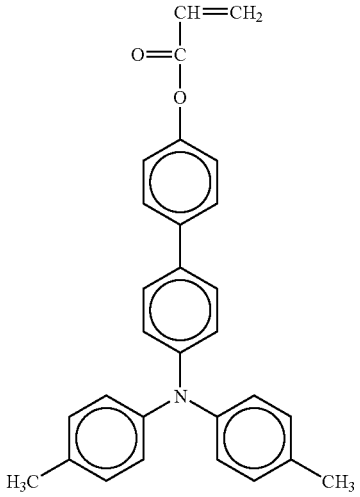

| | |
|---|---|
| Optical polymerization initiator (1-hydroxy-cyclohexyl-phenyl-ketone: ILUGACURE 184, manufactured by Ciba Specialty Chemicals) | 1 part |
| Tetrahydrofuran | 100 parts |

Image Bearing Member Manufacturing Example 31

Image bearing member 31 is manufactured in the same manner as in Image Bearing Member Manufacturing Example 25 except that the liquid of application for protective layer is changed to the following recipe. The transmission factor of the protective layer is 72%.

Liquid of Application for Protective Layer

| | |
|---|---|
| Radical polymeric monomer having at least 3 functional groups which does not have a charge transport structure (trimetyhlol propane triacrylate: KAYARAD TAMPTA, manufactured by Nippon Kayaku Co., Ltd.) (molecular weight: 296, number of functional groups: 3, molecular weight/number of functional groups: 99) | 14 parts |
| Radical polymeric compound having a functional group and a charge transport structure represented by the following chemical structure: (No. 54 compound illustrated here above) | 6 parts |

-continued

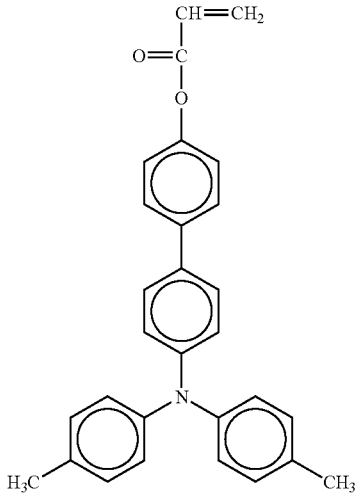

| | |
|---|---|
| Optical polymerization initiator (l-hydroxy-cyclohexyl-phenyl-ketone: ILUGACURE 184, manufactured by Ciba Specialty Chemicals) | 1 part |
| Tetrahydrofuran | 100 parts |

Image Bearing Member Manufacturing Example 32 Image bearing member 32 is manufactured in the same manner as in Image Bearing Member Manufacturing Example 25 except that the liquid of application for protective layer is changed to the following recipe. The transmission factor of the protective layer is 72%.

Liquid of Application for Protective Layer

| | |
|---|---|
| Radical polymeric monomer having at least 3 functional groups which does not have a charge transport structure (trimetyhlol propane triacrylate: KAYARAD TAMPTA, manufactured by Nippon Kayaku Co., Ltd.) (molecular weight: 296, number of functional groups: 3, molecular weight/number of functional groups: 99) | 2 parts |
| Radical polymeric compound having a functional group and a charge transport structure representd by the following chemical strucuture: (No, 54 compound illustrated above) | 18 parts |

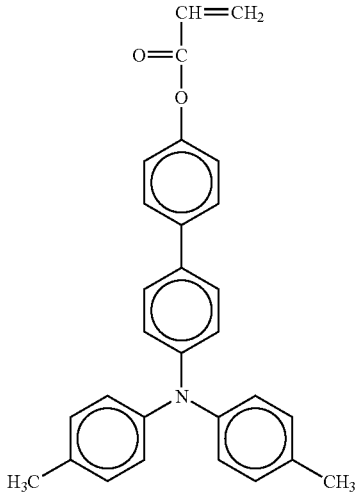

-continued

| | |
|---|---|
| Optical polymerization initiator (l-hydroxy-cyclohexyl-phenyl-ketone ILUGACURE 184, manufactured by Ciba Specialty Chemicals) | 1 part |
| Tetrahydrofuran | 100 parts |

Image Bearing Member Manufacturing Example 33

Image bearing member 33 is manufactured in the same manner as in Image Bearing Member Manufacturing Example 25 except that the liquid of application for protective layer is changed to the following recipe. The transmission factor of the protective layer is 72%.

Liquid of Application for Protective Layer

| | |
|---|---|
| Radical polymeric monomer having at least 3 functional groups which does not have a charge transport structure (trimetyhlol propane triacrylate: KAYARAD TAMPTA, manufactured by Nippon Kayaku Co, Ltd) (molecular weight: 296, number of functional groups: 3, molecular weight/number of functional groups: 99) | 18 parts |
| Radical polymeric compound having a functional group and a charge transport structure representd by the following chemical strucuture: (No 54 compound illustrated above) | 2 parts |

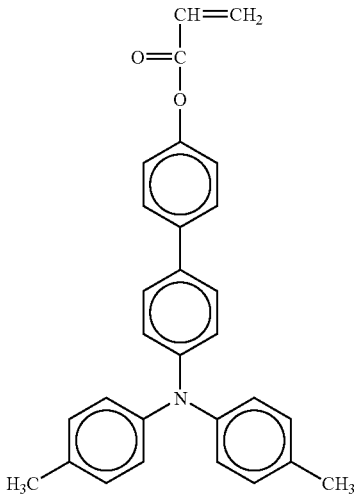

| | |
|---|---|
| Optical polymerization initiator (1-hydroxy-cyclohexyl-phenyl-ketone: ILUGACURE 184, manufactured by Ciba Specialty Chemicals) | 1 part |
| Tetrahydrofuran | 100 parts |

Example 19

The image bearing member 1 is implemented in an image forming apparatus as shown in FIG. 8. The irradiation light source is a semi-conductor laser (image writing by a polygon mirror) emitting light having a wavelength of 780 nm. A scortron charger is used as the charging device. A transfer belt is used as the transfer device. The process conditions before the test of 70,000 continuous printing of a chart having a writing ratio of 6% are as follows.

Charging device of image bearing member (non irradiated portion): −900V

Developing bias: −650 V (negative/positive development)

Surface voltage after discharging (for non-irradiated portion by writing light): −100 V Discharging light: Make homogeneous light having a wavelength of 405 nm by combining a Xenon lamp with a spectroscope and guide the light to the image forming apparatus with optical fiber to irradiate the surface of the image bearing member therewith through slits.

Evaluation Items (1) Surface Voltage

Evaluation is made based on the measurement of the voltage at irradiated portion on the image bearing member before and after the 70,000 image printing.

The surface voltage of non-irradiated portions at the development portion and the irradiation voltage are measured for solid printing by the semi-conductor laser after −900 V charging on the image bearing member with a surface voltometer placed on the developing position shown in FIG. 8. The result is shown in Table 7.

(2) Background Fouling

The background fouling is evaluated for white solid image output after the 70,000 image outputs (after measuring the surface voltage) at 22° C. and 50% RH. The background fouling is evaluated as the 4 rank scaling mentioned above. The result is shown in Table 7.

(3) Cleaning Property

Figure 13:
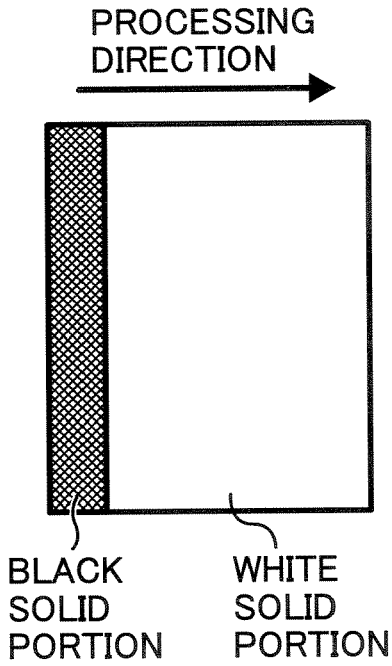
FIG. 13 is a test chart for use in Example 19, which is described later.

After the evaluation of the background fouling, 50 test charts as illustrated in FIG. 13 are continuously printed in the direction from the black solid portion to the white solid portion under the same condition as in Example 1 at a low temperature (10° C.) and a low humidity (15% RH) for evaluating cleaning property. The white solid portion of the 50th image is observed with naked eyes. The evaluation is made with the 4 rank scaling as follows: Excellent (no bad cleaning performance) represented by E; Good (one or two black streaks are slightly observed in the longitudinal direction) represented by G; Fair (three or four black streaks are slightly observed in the longitudinal direction) represented by F; and Poor (clear black streaks are observed) represented by P. The result is shown in Table 7.

(4) Dot Representation

After the cleaning property evaluation, 1,000 images of the test charts having a writing ratio of 6% are output at a high temperature 30° C.) and a high humidity (90% RH) for 1 dot image evaluation (an image in which an independent dot is written is output). The 1 dot image is observed by an optical microscope and the clearness of the dot contour is evaluated by 4 rank scaling as follows: Excellent represented by E; Good represented by G; Fair represented by F; and Poor represented by P. The result is shown in Table 7.

(5) Amount of Abrasion

The layer thickness of the image bearing member at the initial state is measured and again measured after all the tests of (1) to (4). The differences (amount of abrasion) between the layer thickness before and after the tests are evaluated. The layer thickness is measured with an interval of 1 cm except for 5 cm from both ends in the longitudinal direction of the image bearing member and the average is determined as the layer thickness.

TABLE 7

| | Number of image bearing member | Voltage at irradiated portion (−V) Initial | After 70,000 image print | Background fouling evaluation | Cleaning property evaluation | Dot representation evaluation | Amount of abrasion (μm) |
|---|---|---|---|---|---|---|---|
| Example 19 | 1 | 115 | 140 | F | G | E | 9.8 |
| Example 20 | 19 | 120 | 150 | E | F or G | E or G | 2.8 |
| Example 21 | 20 | 125 | 155 | E | F or G | G | 2.5 |
| Example 22 | 21 | 115 | 145 | G | F or G | F or G | 2.8 |
| Example 23 | 22 | 125 | 150 | E | F or G | G | 2.2 |
| Example 24 | 23 | 125 | 150 | E or G | G | G | 3.5 |
| Example 25 | 24 | 130 | 155 | E | F or G | F or G | 2.2 |
| Example 26 | 25 | 125 | 150 | E | E | E | 2.0 |
| Example 27 | 26 | 125 | 150 | G | E | E | 1.7 |
| Example 28 | 27 | 125 | 150 | E | F or G | E | 3.6 |
| Example 29 | 28 | 125 | 150 | E | E | E | 2.0 |
| Example 30 | 29 | 125 | 170 | E | F or G | E | 1.7 |
| Example 31 | 30 | 120 | 145 | E or G | E | E | 2.2 |
| Example 32 | 31 | 130 | 155 | E | E | E | 2.0 |
| Example 33 | 32 | 115 | 140 | E or G | E | E | 2.5 |
| Example 34 | 33 | 135 | 155 | E | E | E | 2.0 |

The following is seen in Table 7.

Even when a protective layer is formed, the rise of the residual voltage is prevented by optical absorption by the titanium oxide contained in the intermediate layer.

The anti-abrasion property is improved by the protective layer as in Example 20 to 34).

Among the cases in which the protective layer containing an inorganic pigment (metal oxide) is provided as in Examples 20 to 22, the dot representation is not significantly decreased at a high temperature and a high humidity when the organic pigment has a specific resistance of not less than $10^{10}$ Ω·cm as in Examples 20 and 21.

The anti-abrasion property is relatively improved by the protective layer having a cross linking structure in comparison with the protective layer without a cross linking structure. The protective layer formed by curing a radical polymeric monomer having at least 3 functional groups which does not have a charge transport structure and a radical polymeric compound having a functional group and a charge transport structure can improve the anti-abrasion property as in Examples 26, 27, 29, and 31 to 34.

In addition, the cleaning property can be improved by using the protective layer formed by curing a radical polymeric monomer having at least 3 functional groups which does not have a charge transport structure and a radical polymeric compound having a functional group and a charge transport structure.

Comparative Example 16

The evaluation is made in the same manner as in Example 29 except that a 502 nm LED with a half value width of 15 nm (manufactured by Seiwa Electric Mfg. Co., Ltd.) is used instead. The amount of discharging light is adjusted such that the surface voltage of the image bearing member after discharging is the same as in Example 29. The result is shown in Table 8.

Comparative Example 17

The evaluation is made in the same manner as in Example 29 except that a 591 nm LED with a half value width of 15 nm (manufactured by Rohm Co., Ltd.) is used instead. The amount of discharging light is adjusted such that the surface voltage of the image bearing member after discharging is the same as in Example 29. The result is shown in Table 8.

Comparative Example 18

The evaluation is made in the same manner as in Example 29 except that a 630 nm LED with a half value width of 20 nm (manufactured by Rohm Co., Ltd.) is used instead. The amount of discharging light is adjusted such that the surface voltage of the image bearing member after discharging is the same as in Example 29. The result is shown in Table 8.

Comparative Example 19

The evaluation is made in the same manner as in Example 29 except that a fluorescent light having a luminescent spectrum shown in FIG. 1 is used instead. The amount of discharging light is adjusted such that the surface voltage of the image bearing member after discharging is the same as in Example 29. The result is shown in Table 8.

TABLE 8

| | Wavelength of discharging light (nm) | Surface voltage at irradiation portion (−V) Initial | After 70,000 image printing |
|---|---|---|---|
| Example 29 | 405 | 125 | 150 |
| Comparative Example 16 | 502 | 125 | 180 |
| Comparative Example 17 | 591 | 125 | 185 |
| Comparative Example 18 | 630 | 125 | 195 |
| Comparative Example 19 | White light | 125 | 175 |

As seen in Table 8, when the wavelength of discharging light is set to be 405 nm and the discharging light is optically absorbed by the titanium oxide contained in the intermediate layer as in Example 29, the rise of the voltage at irradiated portions after repetitive use is relatively small in comparison with those in the cases of the discharging light on the long wavelength side which is not absorbed by the titanium oxide as in Comparative Examples 16 to 18.

In addition, the effect of the discharging light having a wide luminescence distribution and containing light having a wavelength of not less than 388 nm as in Comparative Example 19 is not as clear as in Examples.

Example 35

The image bearing member 28 is implemented in an image forming apparatus as shown in FIG. 8. The irradiation light source is a semi-conductor laser (image writing by a polygon mirror) emitting light having a wavelength of 780 nm. A scortron charger is used as the charging device. A transfer belt is used as the transfer device. The process conditions before the test of 70,000 continuous printing of a chart having a writing ratio of 6% are as follows.

Charging device of image bearing member (non irradiated portion): −900V

Developing bias: −650 V (negative/positive development)

Surface voltage after discharging (for non-irradiated portion by writing light): −100 V Discharging light: Make homogeneous light having a wavelength of 409 nm by combining a Xenon lamp with a spectroscope and guide the light to the image forming apparatus with optical fiber to irradiate the surface of the image bearing member therewith through slits.

Evaluation is made based on the measurement of the voltage at irradiated portion on the image bearing member before and after the 70,000 image printing.

The surface voltage of non-irradiated portions at the development portion and the irradiation voltage are measured for solid printing by the semi-conductor laser after −900 V charging on the image bearing member with a surface voltometer placed on the developing position shown in FIG. 8. The result is shown in Table 9.

Figure 14:
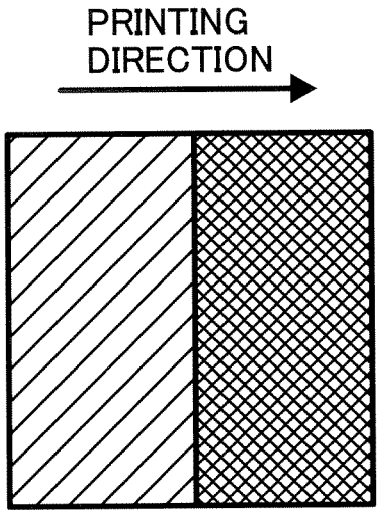
FIG. 14 is a test chart for use in Example 35, which is described later.

In addition, after measuring the voltage after the 70,000 image outputs, the image of the chart shown in FIG. 14 in which the front end half is a stripe image and the rear end half is a halftone image is output and non-uniformity of the image on the halftone portion is observed.

To measure the transmission factor of a protective layer, the protective layer of the image bearing member 28 is formed under the same conditions as described in the case of the image bearing member 28 on an aluminum drum having a diameter of 30 mm around which polyethylene terephthalate film is wound. This material is cut to a suitable size and the spectroscopic transmission factor in the range of from 500 to 300 nm is measured by using a marketed spectral photometer (UV-3100, manufactured by Shimazu Corporation) while comparing with polyethylene terephthalate on which a liquid for protective layer is not coated. The transmission factor of the charge generating layer is 25% and the transmission factor of the charge transport layer is 87% for discharging light for the image bearing member.

Example 36

The evaluation is made in the same manner as in Example 35 except that the wavelength of the discharging light is changed to 393 nm by a spectroscope. The result is shown in Table 9. The transmission factor of the charge generating layer is 22% and the transmission factor of the charge transport layer is 86% for discharging light for the image bearing member.

Example 37

The evaluation is made in the same manner as in Example 35 except that the wavelength of the discharging light is changed to 390 nm by a spectroscope. The result is shown in Table 9. The transmission factor of the charge generating layer is 22% and the transmission factor of the charge transport layer is 86% for discharging light for the image bearing member.

Example 38

The evaluation is made in the same manner as in Example 35 except that the wavelength of the discharging light is changed to 385 nm by a spectroscope. The result is shown in Table 9. The transmission factor of the charge generating layer is 22% and the transmission factor of the charge transport layer is 86% for discharging light for the image bearing member.

TABLE 9

| | Wavelength of discharging light (nm) | Transmission factor of protective layer for wavelength of discharging light (%) | Surface voltage at irradiated portions (−V) Initial | After 70,000 image output |
|---|---|---|---|---|
| Example 35 | 409 | 82 | 125 | 150 |
| Example 36 | 393 | 50 | 125 | 150 |
| Example 37 | 390 | 29 | 125 | 155 |
| Example 38 | 385 | 9 | 125 | 155 |

As seen in Table 9, when the transmission factor of the protective layer for the discharging light is less than 30%, the effect slightly deteriorates.

In addition, the half tone portion in the output of the chart illustrated in FIG. 14 for Examples 35 and 36 is properly formed but a slight residual image corresponding to the stripe in the half tone is recognized in Examples 37 and 38. The degree of the residual image is worse in Example 38 than in Example 37.

Based on the results, it is found that it is possible to restrain the rise of the residual voltage after repetitive use by the absorption of the discharging light having a wavelength shorter than 410 nm by the titanium oxide contained in the intermediate layer. However, it is also found that, when the transmission factor of the protective layer for the discharging light is less than 30%, a slight side effect may appear.

Image Bearing Member Manufacturing Example 34

Image bearing member 34 is manufactured in the same manner as in Image Bearing Member Manufacturing Example 1 except that the intermediate layer in the Image Bearing Member Manufacturing Example 1 is changed to a layered structure having a charge blocking layer and a moiré prevention layer, and a liquid of application having the following recipe for the charge blocking layer and for the moiré prevention layer are applied and dried such that the layer thickness of the charge blocking layer and of the moiré prevention layer are 1.0 μm and 3.5 μm, respectively.

Liquid of Application for Charge Blocking Layer

| Liquid of Application for Charge Blocking Layer | |
|---|---|
| N-methoxy methylated nylon (FINERESIN FR-101, manufactured by Namariichi Chemical Industrial Co., Ltd.) | 4 parts |
| Methanol | 70 parts |
| n-butanol | 30 parts |

-continued

| Liquid of Application for Moire Layer | |
|---|---|
| Non-surface treated rutile type titanium oxide having an average particle diameter of 0.25 μm (CR-EL, manufactured by Ishihara Industry Co., Ltd.) | 126 parts |
| Alkyd resin (BECKOLITE M6401-50-S, manufactured by Dainippon Ink and Chemicals Incorporated, solid portion: 50%) | 33.6 parts |
| Melamine resin (SUPERBECAKMINE L-121-60, manufactured by Dainippon Ink and Chemicals Incorporated, solid portion: 60%) | 18.7 parts |
| 2-butanone | 100 parts |

The volume ratio of the inorganic pigment to the binder resin is 1.5/1 in the composition. The weight ratio of the alkyd resin to the melamine resin is 6/4.

Image Bearing Member Manufacturing Example 35

Image bearing member 35 is manufactured in the same manner as in Image Bearing Member Manufacturing Example 34 except that the layer thickness of the charge blocking layer is changed to 0.3 μm.

Image Bearing Member Manufacturing Example 36

Image bearing member 36 is manufactured in the same manner as in Image Bearing Member Manufacturing Example 34 except that the layer thickness of the charge blocking layer is changed to 1.8 μm.

Image Bearing Member Manufacturing Example 37

Image bearing member 37 is manufactured in the same manner as in Image Bearing Member Manufacturing Example 34 except that the liquid of application for the charge blocking layer is changed to have the following recipe.

| Liquid of Application for Charge Blocking Layer | |
|---|---|
| Alcohol soluble nylon (AMILAN CM8000, manufactured by Toray Industries, Inc.) | 4 parts |
| Methanol | 70 parts |
| n-butanol | 30 parts |

Image Bearing Member Manufacturing Example 38

Image bearing member 38 is manufactured in the same manner as in Image Bearing Member Manufacturing Example 34 except that the liquid of application for the moiré prevention layer is changed to have the following recipe.

Liquid of application for Moire Prevention Layer

| | |
|---|---|
| Non-surface treated rutile type titanium oxide having an average particle diameter of 0.25 μm (CR-EL, manufactured by Ishihara Industry Co., Ltd.) | 252 parts |
| Alkyd resin (BECKOLITE M6401-50-S, manufactured by Dainippon Ink and Chemicals Incorporated, solid portion: 50%) | 33.6 parts |
| Melamine resin (SUPERBECAKIMINE L-121-60, manufactured by Dainippon Ink and Chemicals Incorporated, solid portion: 60%) | 18.7 parts |
| 2 -butanone | 100 parts |

The volume ratio of the inorganic pigment to the binder resin is 3/1 in the composition. The weight ratio of the alkyd resin to the melamine resin is 6/4.

Image Bearing Member Manufacturing Example 39

Image bearing member 39 is manufactured in the same manner as in Image Bearing Member Manufacturing Example 34 except that the liquid of application for the moiré prevention layer is changed to have the following recipe.

| Liquid of Application for Moire Prevention Layer | |
|---|---|
| Non-surface treated rutile type titanium oxide having an average particle diameter of 0.25 μm (CR-EL, manufactured by Ishihara Industry Co., Ltd.) | 84 parts |
| Alkyd resin (BECKOLITE M6401-50-S, manufactured by Dainippon Ink and Chemicals Incorporated, solid portion: 50%) | 33.6 parts |
| Melamine resin (SUPERBECAKIME L-121-60, manufactured by Dainippon Ink and Chemicals Incorporated, solid portion: 60%) | 18.7 parts |
| 2-butanone | 100 parts |

The volume ratio of the inorganic pigment to the binder resin is 1/1 in the composition. The weight ratio of the alkyd resin to the melamine resin is 6/4.

Examples 39 to 44

70,000 image continuous printing is performed using the image bearing members 34 to 39 under the same condition as in Example 19. The evaluation is made in the same manner for the same items. The results are shown in Table 10 in comparison with the results of Example 19.

TABLE 10

| | Number of image bearing member | Voltage at irradiated portion (−V) Initial | After 70,000 image prints | Background fouling evaluation | Cleaning property evaluation | Dot representation evaluation | Amount of abrasion (μm) |
|---|---|---|---|---|---|---|---|
| Example 19 | 1 | 115 | 140 | F | G | E | 9.8 |
| Example 39 | 34 | 115 | 145 | E | G | E | 9.8 |

TABLE 10-continued

| | Number of image bearing member | Voltage at irradiated portion (−V) Initial | After 70,000 image prints | Background fouling evaluation | Cleaning property evaluation | Dot representation evaluation | Amount of abrasion (μm) |
|---|---|---|---|---|---|---|---|
| Example 40 | 35 | 115 | 140 | G | G | E | 9.8 |
| Example 41 | 36 | 120 | 150 | E | G | E | 9.8 |
| Example 42 | 37 | 125 | 160 | E | G | E | 9.8 |
| Example 43 | 38 | 115 | 140 | G | G | E | 9.8 |
| Example 44 | 39 | 125 | 150 | E | G | E | 9.8 |

As seen in the results shown in Table 10, it is found that the anti-background fouling property is improved by having a structure in which the intermediate layer is formed of a charge blocking layer and a moiré blocking layer.

Example 45

The same evaluation is made in the same manner as in Example except that the irradiation light source is changed to a semi-conductor laser (manufactured by Nichia Corporation) having a wavelength of 407 nm. The result is shown in Table 11 accompanied by the result of Example 1 for comparison.

In addition, an image having one dot having a diameter of 60 μm is formed and the dot formed state is observed by a microscope with a magnification power of 150 and compared with Example 1.

TABLE 11

| | Wavelength of discharging light (nm) | Initial Surface voltage at non-irradiated portion (−V) | Initial Surface voltage at irradiated portion (−V) | After 50,000 image prints Surface voltage at non-irradiated portion (−V) | After 50,000 image prints Surface voltage at irradiated portion (−V) |
|---|---|---|---|---|---|
| Example 1 | 380 | 900 | 115 | 900 | 135 |
| Example 45 | 380 | 900 | 115 | 900 | 130 |

As seen in Table 11, it is found that, when an LD having a short wavelength (407 nm) is used for writing as in Example 45, the rise of the residual voltage at irradiated portions is further restrained when compared with Example 1. Furthermore, with regard to the dot representation, the one dot image in Example 45 has a clear contour.

Image Bearing Member Manufacturing Example 40

Image bearing member 40 is manufactured in the same manner as in Image Bearing Member Manufacturing Example 1 except that the liquid of application (the liquid dispersion No. 1) for charge generating layer is changed to the liquid dispersion No. 5. The layer thickness of the charge generating layer is adjusted such that the transmission factor thereof is 20% for light having a wavelength of 380 nm.

Image Bearing Member Manufacturing Example 41

Image bearing member 41 is manufactured in the same manner as in Image Bearing Member Manufacturing Example 40 except that the layer thickness of the charge generating layer is changed and adjusted such that the transmission factor thereof is 12% for light having a wavelength of 380 nm.

Image bearing member 42 is manufactured in the same manner as in Image Bearing Member Manufacturing Example 40 except that the layer thickness of the charge generating layer is changed and adjusted such that the transmission factor thereof is 8% for light having a wavelength of 380 nm.

Image Bearing Member Manufacturing Example 43

Image bearing member 43 is manufactured in the same manner as in Image Bearing Member Manufacturing Example 40 except that the charge transport material is changed to the compound represented by the following chemical structure:

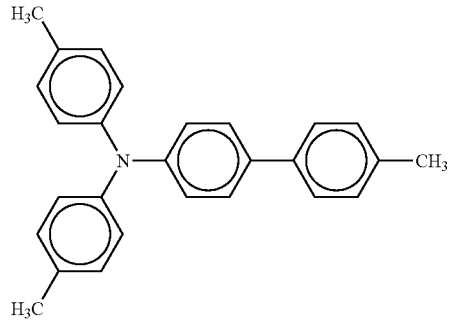

Example 46

The Image bearing member 40 is implemented in a process cartridge as illustrated in FIG. 10 which is implemented in an image forming apparatus as shown in FIG. 9. The irradiation light source is a semi-conductor laser (image writing by a polygon mirror) emitting light having a wavelength of 655 nm. A contact type charging roller is used as the charging device. A transfer belt is used as the transfer device. A 380 nm LED, manufactured by Nichia Corporation, is as the discharging light source. The process conditions before the test of 50,000 image continuous printing of a chart in which characters corresponding to about 6% based on the total area of an A4 sheet are uniformly written are set as follows. The transmission factor of the charge generating layer is 20% and the transmission factor of the charge transport layer is 83% for discharging light for the image bearing member.

Charging device of image bearing member (non-iraddiated portion): −900V

Developing bias: −650 V (negative/positive development)

Surface voltage after discharging (for non-irradiated portion by writing light): −100 V Evaluation is made based on the measurement of the voltage at irradiated portion on the image bearing member before and after the 50,000 image continuous printing.

The surface voltage of non-irradiated portions at the development portion and the irradiation voltage are measured for solid printing by the semi-conductor laser after −900 V charging on the image bearing member with a surface voltometer placed on the developing position shown in FIG. 9. The result is shown in Table 12.

In addition, color representation is evaluated by outputting ISO/JIS-SCID image N1 (portrait) before and after the 50,000 image continuous printing.

Comparative Example 20

The evaluation is made in the same manner as in Example 46 except that a 502 nm LED with a half value width of 15 nm (manufactured by Seiwa Electric Mfg. Co., Ltd.) is used instead. The amount of discharging light is adjusted such that the surface voltage of the image bearing member after discharging is the same as in Example 46.

The result is shown in Table 12. The transmission factor of the charge generating layer is 14% and of the charge transport layer is 98% for the discharging light used for the image bearing member.

Comparative Example 21

The evaluation is made in the same manner as in Example 46 except that a 591 nm LED with a half value width of 15 nm (manufactured by Rohm Co., Ltd.) is used instead. The amount of discharging light is adjusted such that the surface voltage of the image bearing member after discharging is the same as in Example 46. The result is shown in Table 12. The transmission factor of the charge generating layer is 3% and of the charge transport layer is 98% for the discharging light used for the image bearing member.

Comparative Example 22

The evaluation is made in the same manner as in Example 1 except that a 630 nm LED with a half value width of 20 nm (manufactured by Rohm Co., Ltd.) is used instead. The amount of discharging light is adjusted such that the surface voltage of the image bearing member after discharging is the same as in Example 46. The result is shown in Table 12. The transmission factor of the charge generating layer is 8% and of the charge transport layer is 98% for the discharging light used for the image bearing member.

Comparative Example 23

The evaluation is made in the same manner as in Example 46 except that a fluorescent light having a luminescent spectrum shown in FIG. 1 is used instead. The amount of discharging light is adjusted such that the surface voltage of the image bearing member after discharging is the same as in Example 46. The result is shown in Table 12.

Comparative Example 24

The evaluation is made in the same manner as in Example 46 except that a 380 nm LED (manufactured by Nichia Corporation fluorescent light) and a 630 nm LED with a half value width of 20 nm (manufactured by Rohm Co., Ltd.) are used as the discharging light sources. The two discharging light sources simultaneously irradiate the image bearing member in almost the same amount of light. The amount of discharging light is adjusted such that the surface voltage of the image bearing member after discharging is the same as in Example 46. The result is shown in Table 12.

Example 47

The evaluation is made in the same manner as in Example 46 except that the image bearing member 41 is used instead of the image bearing member 40. The result is shown in Table 12. The transmission factor of the charge generating layer is 12% and of the charge transport layer is 83% for the discharging light used for the image bearing member.

Example 48

The evaluation is made in the same manner as in Example 46 except that the image bearing member 42 is used instead of the image bearing member 40. The result is shown in Table 12. The transmission factor of the charge generating layer is 8% and of the charge transport layer is 83% for the discharging light used for the image bearing member.

Example 49

The evaluation is made in the same manner as in Example 46 except that the image bearing member 43 is used instead of the image bearing member 40. The result is shown in Table 12. The transmission factor of the charge generating layer is 20% and of the charge transport layer is 3% for the discharging light used for the image bearing member.

TABLE 12

| | Wavelength of discharging light (nm) | Surface voltage at irradiated portion (−V) | |
|---|---|---|---|
| | | Initial | After 50,000 image output |
| Example 46 | 380 | 50 | 70 |
| Comparative Example 20 | 502 | 50 | 105 |
| Comparative Example 21 | 591 | 50 | 110 |
| Comparative Example 22 | 630 | 50 | 115 |
| Comparative Example 23 | White light | 50 | 100 |
| Comparative Example 24 | 380, 630 | 50 | 105 |

TABLE 12-continued

| | Wavelength of discharging light (nm) | Surface voltage at irradiated portion (−V) Initial | After 50,000 image output |
|---|---|---|---|
| Example 47 | 380 | 45 | 65 |
| Example 48 | 380 | 40 | 95 |
| Example 49 | 380 | 45 | 90 |

As seen in Table 12, when the wavelength of discharging light is set to be 380 nm and the discharging light is optically absorbed by titanium oxide contained in the intermediate layer as in Example 46, the rise of the voltage at irradiated portions after repetitive use is relatively small in comparison with those in the cases of the discharging light on the long wavelength side which is not absorbed by the titanium oxide as in Comparative Examples 20 to 22.

In addition, the effect of the discharging light having a wide luminescence distribution and containing light having a wavelength of not less than 410 nm as in Comparative Example 23 is not as clear as in Examples. Furthermore, it is found that, when two light sources having different irradiation wavelengths are used as in Comparative Example 24, the effect of discharging on the short wavelength side is reduced.

As seen in the result of the test chart, the obtained image in Example 46 after the 50,000 image output is almost as same as the image obtained at the initial stage but the obtained images in Comparative Examples 20 to 24 are slightly off balance in color after the 50,000 image output.

It is also found that when the transmission factor of the charge generating layer for discharging light is less than 10% as in Example 48, the rise of the voltage at the irradiated portions after repetitive use is relatively large in comparison with the case in which the transmission factor is not less than 10% as in Examples 46 and 47.

It is also found that when the transmission factor of the charge transport layer for discharging light is less than 30% as in Example 49, the rise of the voltage at the irradiated portions after repetitive use is relatively large in comparison with the case in which the transmission factor is not less than 30% as in Example 46.

Image Bearing Member Manufacturing Example 44

Image bearing member 44 is manufactured in the same manner as in Image Bearing Member Manufacturing Example 40 except that the liquid dispersion 6 is used instead of the liquid dispersion 5. The layer thickness of the charge generating layer is adjusted such that the transmission factor thereof for discharging light having a wavelength of 380 nm is 20%.

Image Bearing Member Manufacturing Example 45

Image bearing member 45 is manufactured in the same manner as in Image Bearing Member Manufacturing Example 44 except that the layer thickness of the charge generating layer is changed and adjusted such that the transmission factor thereof for discharging light having a wavelength of 380 nm is 12%.

Image Bearing Member Manufacturing Example 46

Image bearing member 46 is manufactured in the same manner as in Image Bearing Member Manufacturing Example 44 except that the layer thickness of the charge generating layer is changed and adjusted such that the transmission factor thereof for discharging light having a wavelength of 380 nm is 8%.

Image Bearing Member Manufacturing Example 47

Image bearing member 47 is manufactured in the same manner as in Image Bearing Member Manufacturing Example 44 except that the charge transport material in Image Bearing Member Manufacturing Example 44 is changed to the material represented by the following chemical structure:

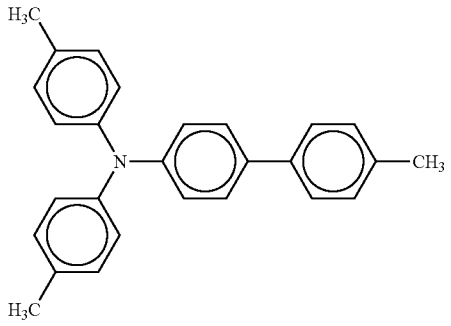

Example 50

The evaluation is made in the same manner as in Example 46 except that the image bearing member 44 is used instead of the image bearing member 40. The result is shown in Table 13. The transmission factor of the charge generating layer is 20% and of the charge transport layer is 83% for the discharging light used for the image bearing member.

Comparative Example 25

The evaluation is made in the same manner as in Comparative Example 20 except that the image bearing member 44 is used instead of the image bearing member 40. The result is shown in Table 13. The transmission factor of the charge generating layer is 14% and of the charge transport layer is 98% for the discharging light used for the image bearing member.

Comparative Example 26

The evaluation is made in the same manner as in Comparative Example 21 except that the image bearing member 44 is used instead of the image bearing member 40. The result is shown in Table 13. The transmission factor of the charge generating layer is 3% and of the charge transport layer is 98% for the discharging light used for the image bearing member.

Comparative Example 27

The evaluation is made in the same manner as in Comparative Example 22 except that the image bearing member 44 is used instead of the image bearing member 40. The result is shown in Table 13. The transmission factor of the charge generating layer is 8% and of the charge transport layer is 98% for the discharging light used for the image bearing member.

Comparative Example 28

The evaluation is made in the same manner as in Comparative Example 23 except that the image bearing member 44 is used instead of the image bearing member 40. The result is shown in Table 13.

Comparative Example 29

The evaluation is made in the same manner as in Comparative Example 24 except that the image bearing member 44 is used instead of the image bearing member 40. The result is shown in Table 13.

Example 51

The evaluation is made in the same manner as in Example 50 except that the image bearing member 45 is used instead of the image bearing member 44. The result is shown in Table 13. The transmission factor of the charge generating layer is 12% and of the charge transport layer is 83% for the discharging light used for the image bearing member.

Example 52

The evaluation is made in the same manner as in Example 50 except that the image bearing member 46 is used instead of the image bearing member 44. The result is shown in Table 13. The transmission factor of the charge generating layer is 8% and of the charge transport layer is 83% for the discharging light used for the image bearing member.

Example 53

The evaluation is made in the same manner as in Example 50 except that the image bearing member 47 is used instead of the image bearing member 44. The result is shown in Table 13. The transmission factor of the charge generating layer is 12% and of the charge transport layer is 3% for the discharging light used for the image bearing member.

TABLE 13

| | Wavelength of discharging light (nm) | Surface voltage at irradiated portion (−V) | |
|---|---|---|---|
| | | Initial | After 50,000 image output |
| Example 50 | 380 | 65 | 85 |
| Comparative Example 25 | 502 | 65 | 120 |
| Comparative Example 26 | 591 | 65 | 125 |
| Comparative Example 27 | 630 | 65 | 130 |
| Comparative Example 28 | White light | 65 | 115 |
| Comparative Example 29 | 380 and 630 | 65 | 120 |
| Example 51 | 380 | 60 | 80 |
| Example 52 | 380 | 55 | 110 |
| Example 53 | 380 | 60 | 105 |

As seen in Table 13, when the wavelength of discharging light is set to be 380 nm and the discharging light is optically absorbed by the titanium oxide contained in the intermediate layer as in Example 50, the rise of the voltage at irradiated portions after repetitive use is relatively small in comparison with those in the cases of the discharging light on the long wavelength side as in Comparative Examples 25 to 27.

In addition, the effect of the discharging light having a wide luminescence distribution and containing light having a wavelength of not less than 500 nm as in Comparative Example 28 is not as clear as in Examples. Furthermore, it is found that, when two light sources having different irradiation wavelengths are used as in Comparative Example 29, the effect of discharging on the short wavelength side is reduced.

As seen in the result of the test chart, the obtained image in Example 50 after the 50,000 image output is almost as same as the image obtained at the initial stage but the obtained images in Comparative Examples 25 to 29 are slightly off balance in color after the 50,000 image output.

When the surface voltage at the irradiated portion in Example 46 shown in Table 12 is compared with the surface voltage at the irradiated portion in Example 50 shown in Table 13, the surface voltage at the irradiated portion in Example 46 is low. It is found that asymmetry of the coupler composition of the azo pigments for use in Example 46 contributes to the improvement on the sensitivity.

It is also found that when the transmission factor of the charge generating layer for discharging light is less than 10% as in Example 52, the rise of the voltage at the irradiated portions after repetitive use is relatively large in comparison with the case in which the transmission factor is not less than 10% as in Examples 50 and 51.

It is also found that when the transmission factor of the charge transport layer for discharging light is less than 30% as in Example 53, the rise of the voltage at the irradiated portions after repetitive use is relatively large in comparison with the case in which the transmission factor is not less than 30% as in Example 50.

Image Bearing Member Manufacturing Example 48

Image bearing member 48 is manufactured in the same manner as in Image Bearing Member Manufacturing Example 40 except that the liquid of application for intermediate layer is changed to have the following recipe.

| | |
|---|---|
| Liquid of Application for Intermediate Layer | |
| Non-surface treated zinc oxide (SAZEX #2000, manufactured by Sakai Chemical Industry Co., Ltd.) | 112 parts |
| Alkyd resin (BECKOLITE M6401-50-S, manufactured by Dainippon Ink and Chemicals Incorporated, solid portion: 50%) | 33.6 parts |
| Melamine resin (SUPERBECAKMINE L-121-60, manufactured by Dainippon Ink and Chemicals Incorporated, solid portion: 60%) | 18.7 parts |
| 2-butanone | 260 parts |

Image Bearing Member Manufacturing Example 49

Image bearing member 49 is manufactured in the same manner as in Image Bearing Member Manufacturing Example 48 except that the layer thickness of the charge generating layer in Image Bearing Member Manufacturing Example 48 is changed such that the transmission factor is 12% for light having a wavelength of 380 nm.

Image Bearing Member Manufacturing Example 50

Image bearing member 50 is manufactured in the same manner as in Image Bearing Member Manufacturing Example 48 except that the layer thickness of the charge generating layer in Image Bearing Member Manufacturing Example 48 is changed such that the transmission factor is 8% for light having a wavelength of 380 nm.

Image Bearing Member Manufacturing Example 51

Image bearing member 51 is manufactured in the same manner as in Image Bearing Member Manufacturing Example 48 except that the charge transport material in Image Bearing Member Manufacturing Example 48 is changed to the material represented by the following chemical structure:

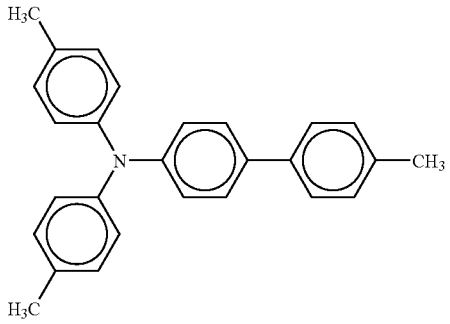

Example 54

The evaluation is made in the same manner as in Example 46 except that the image bearing member 48 is used instead of the image bearing member 40. The result is shown in Table 14. The transmission factor of the charge generating layer is 20% and of the charge transport layer is 83% for the discharging light used for the image bearing member.

Comparative Example 30

The evaluation is made in the same manner as in Comparative Example 20 except that the image bearing member 48 is used instead of the image bearing member 40. The result is shown in Table 14. The transmission factor of the charge generating layer is 14% and of the charge transport layer is 98% for the discharging light used for the image bearing member.

Comparative Example 31

The evaluation is made in the same manner as in Comparative Example 21 except that the image bearing member 48 is used instead of the image bearing member 40. The result is shown in Table 14. The transmission factor of the charge generating layer is 3% and of the charge transport layer is 98% for the discharging light used for the image bearing member.

Comparative Example 32

The evaluation is made in the same manner as in Comparative Example 22 except that the image bearing member 48 is used instead of the image bearing member 40. The result is shown in Table 14. The transmission factor of the charge generating layer is 8% and of the charge transport layer is 98% for the discharging light used for the image bearing member.

Comparative Example 33

The evaluation is made in the same manner as in Comparative Example 23 except that the image bearing member 48 is used instead of the image bearing member 40. The result is shown in Table 14.

Comparative Example 34

The evaluation is made in the same manner as in Comparative Example 24 except that the image bearing member 48 is used instead of the image bearing member 40. The result is shown in Table 14.

Example 55

The evaluation is made in the same manner as in Example 54 except that the image bearing member 49 is used instead of the image bearing member 48. The result is shown in Table 14. The transmission factor of the charge generating layer is 12% and of the charge transport layer is 83% for the discharging light used for the image bearing member.

Example 56

The evaluation is made in the same manner as in Example 54 except that the image bearing member 50 is used instead of the image bearing member 48. The result is shown in Table 14. The transmission factor of the charge generating layer is 8% and of the charge transport layer is 83% for the discharging light used for the image bearing member.

Example 57

The evaluation is made in the same manner as in Example 54 except that the image bearing member 51 is used instead of the image bearing member 48. The result is shown in Table 14. The transmission factor of the charge generating layer is 12% and of the charge transport layer is 3% for the discharging light used for the image bearing member.

TABLE 14

| | Wavelength of discharging light (nm) | Surface voltage at irradiated portion (−V) | |
|---|---|---|---|
| | | Initial | After 50,000 image output |
| Example 54 | 380 | 60 | 85 |
| Comparative Example 30 | 502 | 60 | 120 |
| Comparative Example 31 | 591 | 60 | 125 |
| Comparative Example 32 | 630 | 60 | 130 |
| Comparative Example 33 | White light | 60 | 115 |
| Comparative Example 34 | 380 and 630 | 60 | 120 |
| Example 55 | 380 | 55 | 80 |
| Example 56 | 380 | 50 | 110 |
| Example 57 | 380 | 55 | 105 |

As seen in Table 14, when the wavelength of discharging light is set to be 380 nm and the discharging light is optically absorbed by zinc oxide contained in the intermediate layer as in Example 54, the rise of the voltage at irradiated portions after repetitive use is relatively small in comparison with those in the cases of the discharging light on the long wavelength side as in Comparative Examples 30 to 32.

In addition, the effect of the discharging light having a wide luminescence distribution and containing light having a wavelength of not less than 500 nm as in Comparative Example 33 is not as clear as in Examples. Furthermore, it is found that, when two light sources having different irradiation wavelengths are used as in Comparative Example 34, the effect of discharging on the short wavelength side is reduced.

As seen in the result of the test chart, the obtained image in Example 54 after the 50,000 image output is almost as same as the image obtained at the initial stage but the obtained images in Comparative Examples 30 to 34 are slightly off balance in color after the 50,000 image output.

It is also found that when the transmission factor of the charge generating layer for discharging light is less than 10% as in Example 56, the rise of the voltage at the irradiated portions after repetitive use is relatively large in comparison with the case in which the transmission factor is not less than 10% as in Examples 54 and 55.

It is also found that when the transmission factor of the charge transport layer for discharging light is less than 30% as in Example 57, the rise of the voltage at the irradiated portions after repetitive use is relatively large in comparison with the case in which the transmission factor is not less than 30% as in Example 54.

Example 58

The same evaluation is made in the same manner as in Example 46 except that the image irradiation light source is changed to a semi-conductor laser (manufactured by Nichia Corporation) having a wavelength of 407 nm. The result is shown in Table accompanied by the result of Example 46 for comparison.

In addition, an image having one dot having a diameter of 60 μm is formed and the dot formed state is observed by a microscope with a magnification power of 150 and compared with Example 46.

TABLE 15

| | | Initial | | After 50,000 image prints | |
|---|---|---|---|---|---|
| | Wavelength of discharging light (nm) | Surface voltage at non-irradiated portion (−V) | Surface voltage at irradiated portion (−V) | Surface voltage at non-irradiated portion (−V) | Surface volatge at irradiated portion (−V) |
| Example 46 | 428 | 900 | 50 | 900 | 70 |
| Example 58 | 428 | 900 | 50 | 900 | 65 |

As seen in Table 15, it is found that, when an LD having a short wavelength (407 nm) is used for writing as in Example 58, the rise of the residual voltage at irradiated portions is further restrained when compared with Example 46. Furthermore, with regard to the dot representation, the one dot image in Example 58 has a clear contour.

This document claims priority and contains subject matter related to Japanese Patent Applications Nos. 2005-361191 and 2006-255190, filed on Dec. 15, 2005, and Sep. 21, 2006, respectively, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image bearing member configured to bear a latent electrostatic image comprising:

a substrate;

an intermediate layer comprising a charge blocking layer comprising N-methoxy methylated nylon and a moiré prevention layer having a layer thickness of from 2 to 5 μm which comprises a metal oxide and is provided on the charge blocking layer; and a photosensitive layer comprising a charge transport layer and a charge generating layer comprising an organic charge generating material;

an image forming device configured to form the latent electrostatic image on the image bearing member;

a developing device configured to develop the latent electrostatic image with a toner to form a visualized image;

a transfer device configured to transfer the visualized image to a recording medium;

a fixing device configured to fix the transferred image on the recording medium; and a discharging device comprising a light source that provides light having a wavelength shorter than 500 nm configured to optically discharge the image bearing member to remove remaining charges thereon by irradiating the image bearing member with light having a wavelength shorter than 500 nm which is absorbed by the metal oxide in the moiré prevention layer.

2. The image forming apparatus according to claim 1, wherein the metal oxide is a non-surface treated metal oxide.

3. The image forming apparatus according to claim 1, wherein a transmission factor of the charge generating layer for light having a wavelength shorter than 500 nm is not less than 10%.

4. The image forming apparatus according to claim 1, wherein the organic charge generating material is an azo pigment represented by the chemical structure (1):

(1)

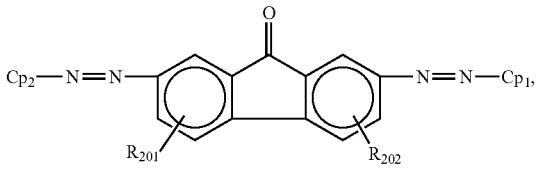

wherein $Cp_1$ and $Cp_2$ independently represent coupler residues, $R_{201}$ and $R_{202}$ independently represent one of a hydrogen atom, a halogen atom, an alkyl group, an alkoxy group, and a cyano group, and $Cp_1$ and $Cp_2$ are individually represented by chemical structure (2):

(2)

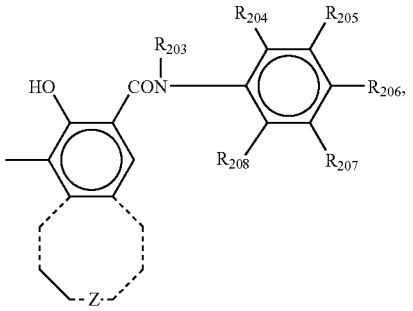

wherein $R_{203}$ represents a hydrogen atom, an alkyl group, or an aryl group, $R_{204}$, $R_{205}$, $R_{206}$, $R_{207}$ and $R_{208}$ independently represent a hydrogen atom, a nitro group, a cyano group, a halogen atom, a halogenated alkyl group, an alkyl group, an alkoxy group, a dialkyl amino group or a hydroxyl group, and Z represents atom groups for forming a substituted or non-substituted aromatic series carbon ring or a substituted or non-substituted aromatic hetrocyclic ring.

5. The image forming apparatus according to claim 1, wherein the organic charge generating material is titanyl phthalocyanine having a crystal form having a CuKα X ray diffraction spectrum having a wavelength of 1.542 Å such that a maximum diffraction peak is observed at a Bragg (2θ) angle of 27.2±0.2°, main peaks at a Bragg (2θ) angle of 9.4±0.2°, 9.6±0.2°, and 24.0±0.2°, and a peak at a Bragg (2θ) angle of 7.3+0.2° as a lowest angle diffraction peak, and having no peak between the peak of 9.4°±0.2° peak and the peak of 7.3°±0.2° and no peak at 26.3°.

6. The image forming apparatus according to claim 1, wherein a transmission factor of the charge transport layer for the light for discharging is not less than 30%.

7. The image forming apparatus according to claim 1, wherein a protective layer is provided overlying the photosensitive layer.

8. The image forming apparatus according to claim 7, wherein a transmission factor of the protective layer for the light for discharging is not less than 30%.

9. The image forming apparatus according to claim 7, wherein the protective layer comprises at least one of an inorganic pigment and a metal oxide having a specific resistance of not less than $10^{10}$ Ω·cm.

10. The image forming apparatus according to claim 7, wherein the protective layer is formed by curing a radical polymeric monomer having at least three functional groups which does not have a charge transport structure and a radical polymeric compound having one functional group which has a charge transport structure.

11. The image forming apparatus according to claim 10, wherein the radical polymeric compound having one functional group which has a charge transport structure for use in the protective layer is at least one represented by chemical structures (3) and (4):

(3)

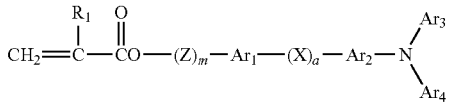

(4)

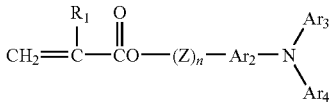

wherein, $R_1$ represents a hydrogen atom, a halogen atom, an alkyl group, an aralkyl group, an aryl group, a cyano group, a nitro group, an alkoxy group, —$COOR_7$, wherein $R_7$ represents a hydrogen atom, a substituted or non-substituted alkyl group, a substituted or non-substituted aralkyl group or a substituted or non-substituted aryl group, a halogenated carbonyl group or $CONR_8R_9$, wherein $R_8$ and $R_9$ independently represent a hydrogen atom, a halogen atom, a substituted or non-substituted alkyl group, a substituted or non-substituted aralkyl group or a substituted or non-substituted aryl group, $Ar_1$ and $Ar_2$ independently represent a substituted or unsubstituted arylene group, $Ar_3$ and $Ar_4$ independently represent a substituted or unsubstituted aryl group, X represents a substituted or non-substituted alkylene group, a substituted or non-substituted cycloalkylene group, a substituted or non-substituted alkylene ether group, an oxygen atom, a sulfur atom or a vinylene group, Z represents a substituted or non-substituted alkylene group, a substituted or non-substituted alkylene ether divalent group or an alkyleneoxy carbonyl divalent group, and a represents 0 or 1, m and n represent an integer of from 0 to 3.

12. The image forming apparatus according to claim 10, wherein the radical polymeric compound having one functional group which has a charge transport structure for use in the protective layer is at least one represented by chemical structure (5):

(5)

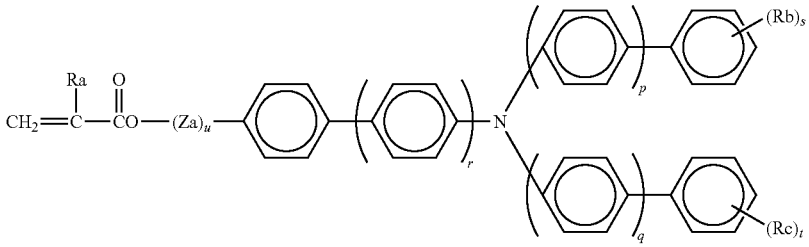

wherein u, r, p, q represent 0 or 1, s and t represent an integer of from 0 to 3, Ra represents a hydrogen atom or a methyl group, Rb and Rc independently represent an alkyl group having 1 to 6 carbon atoms, and Za represents a methylene group, an ethylene group, —$CH_2CH_2O$—, —$CHCH_3CH_2O$—, or —$C_6H_5CH_2CH_2$—.

13. The image forming apparatus according to claim 1, wherein an image writing light for use in the image forming device has a wavelength shorter than 450 nm.

14. The image forming apparatus according to claim 1, comprising a plurality of image bearing members, image forming devices, developing devices, transfer devices, and discharging devices.

15. The image forming apparatus according to claim 1, further comprising a process cartridge detachably attached to a main body of the image forming apparatus and comprising the image bearing member and at least one device selected from the group consisting of the image forming device, the developing device, the discharging device and a cleaning device.

16. An image forming method comprising:

forming a latent electrostatic image on an image bearing member comprising a substrate, an intermediate layer comprising a charge blocking layer comprising N-methoxy methylated nylon and a moiré prevention layer having a layer thickness of from 2 to 5 μm which comprises a metal oxide and is provided on the charge blocking layer, and a photosensitive layer comprising a charge transport layer and a charge generating layer comprising an organic charge generating material;

developing the latent electrostatic image with a toner to form a visualized image;

transferring the visualized image to a recording medium;

fixing the transferred image on the recording medium; and optically discharging remaining charges on the image bearing member by irradiating the image bearing member with light having a wavelength of shorter than 500 nm which is absorbed by the metal oxide in the moiré prevention layer.

17. The image forming method according to claim 16, wherein an image writing light for use in forming the latent electrostatic image has a wavelength shorter than 450 nm.

* * * * *